US010520253B2

(12) United States Patent
Mallory et al.

(10) Patent No.: US 10,520,253 B2
(45) Date of Patent: Dec. 31, 2019

(54) VERTICALLY INTEGRATED DUAL RETURN ASSEMBLY

(71) Applicant: Kiln Drying Systems & Components, Inc., Hendersonville, NC (US)

(72) Inventors: Lee F. Mallory, Horse Shoe, NC (US); Robert K. Pollock, Brevard, NC (US)

(73) Assignee: Kiln Drying Systems & Components, LLC, Hendersonville, NC (US)

( * ) Notice: Subject to any disclaimer, the term of this patent is extended or adjusted under 35 U.S.C. 154(b) by 26 days.

(21) Appl. No.: 15/878,273

(22) Filed: Jan. 23, 2018

(65) Prior Publication Data

US 2018/0209736 A1 Jul. 26, 2018

Related U.S. Application Data

(60) Provisional application No. 62/449,527, filed on Jan. 23, 2017.

(51) Int. Cl.
*F26B 21/02* (2006.01)
*F26B 3/04* (2006.01)

(52) U.S. Cl.
CPC ..... *F26B 21/026* (2013.01); *F26B 3/04* (2013.01); *F26B 21/028* (2013.01); *F26B 2210/16* (2013.01)

(58) Field of Classification Search
CPC .. F26B 21/026; F26B 3/04; F26B 3/06; F26B 15/16; F26B 21/028; F26B 21/10; F26B 23/02; F26B 2210/16
(Continued)

(56) References Cited

U.S. PATENT DOCUMENTS 1,885,418 A 11/1932 Darrah
2,718,713 A 9/1955 Bloxham
(Continued)

FOREIGN PATENT DOCUMENTS

CA 2582012 A1 * 9/2007 ..... F23J 15/025
FR 2074651 A1 * 10/1971 ..... C21D 9/63
(Continued)

OTHER PUBLICATIONS

Boone & Simpson, Chapter 02 Kiln Types and Features—USDA Agricultural Handbook AH-188: Dry Kiln Operator's Manual, 2001, 31 pages, USDA, found at http://www.fpl.fs.fed.us/documnts/usda/ah188/chapter02.pdf.
(Continued)

*Primary Examiner* — Stephen M Gravini
(74) *Attorney, Agent, or Firm* — Kevin E Flynn; Flynn IP Law

(57) ABSTRACT

A mixing chamber assembly for mixing burner output with kiln return air. A first vertical duct that receives kiln return air from the first return duct when the kiln is operated in a first mode and receives kiln return air from the second return duct when the kiln is operated in a second mode. A second vertical duct in fluid communication with the first vertical duct so that the kiln return air enters the first vertical duct, travels upward, and changes direction to then travel downward in the second vertical duct to pass downward into a dispersion chamber to provide downward movement of the kiln return air. The dispersion chamber having a hot duct discharge to convey burner output laterally above a delay table surface. The downward movement of the kiln return air colliding with the burner output to provide mixing of the kiln return air with the burner output.

21 Claims, 38 Drawing Sheets

(58) Field of Classification Search
USPC ..... 34/218
See application file for complete search history.

(56) References Cited

U.S. PATENT DOCUMENTS

| | | | | | |
|---|---|---|---|---|---|
| 3,422,545 | A | | 1/1969 | Wilson | |
| 3,675,600 | A | * | 7/1972 | Jones | F23G 5/16 110/203 |
| 4,098,008 | A | | 7/1978 | Schuette et al. | |
| 4,432,147 | A | | 2/1984 | Chen et al. | |
| 4,530,657 | A | * | 7/1985 | Brashears | F23D 11/001 431/188 |
| 4,713,893 | A | * | 12/1987 | Webb | F26B 21/10 34/485 |
| 4,830,095 | A | | 5/1989 | Friend | |
| 4,972,604 | A | | 11/1990 | Breckenridge | |
| 5,050,314 | A | | 9/1991 | Breckenridge | |
| 5,269,076 | A | | 12/1993 | Breckenridge | |
| 5,276,980 | A | * | 1/1994 | Carter | F26B 21/026 34/191 |
| 5,414,944 | A | | 5/1995 | Culp et al. | |
| 5,416,985 | A | | 5/1995 | Culp | |
| 5,437,109 | A | | 8/1995 | Culp | |
| 5,488,785 | A | | 2/1996 | Culp | |
| 5,595,000 | A | | 1/1997 | Goodwin, III | |
| 5,758,434 | A | * | 6/1998 | Gipson | F26B 3/04 34/340 |
| 6,135,765 | A | * | 10/2000 | Jamaluddin | F23G 7/003 110/236 |
| 6,209,223 | B1 | | 4/2001 | Dinh | |
| 6,219,937 | B1 | | 4/2001 | Culp | |
| 6,370,792 | B1 | | 4/2002 | Culp | |
| 6,393,723 | B1 | | 5/2002 | Culp | |
| 6,467,190 | B2 | | 10/2002 | Nagel | |
| 7,318,288 | B2 | * | 1/2008 | Zahedi | F23J 15/025 34/138 |
| 7,963,048 | B2 | | 6/2011 | Pollard | |
| 8,875,414 | B2 | * | 11/2014 | Blomquist | F26B 3/04 34/396 |
| 9,200,834 | B1 | * | 12/2015 | Ball, Jr. | F26B 25/063 |
| 9,423,176 | B1 | | 8/2016 | Girardi | |
| 9,726,429 | B1 | * | 8/2017 | Jamaluddin | F26B 25/22 |
| 9,874,397 | B1 | * | 1/2018 | Ball, Jr. | F26B 3/04 |
| 10,288,349 | B2 | * | 5/2019 | Swanson | F26B 17/32 |
| 2008/0223269 | A1 | * | 9/2008 | Paoluccio | C10L 5/44 110/342 |
| 2010/0112500 | A1 | | 5/2010 | Maiello et al. | |
| 2016/0273837 | A1 | * | 9/2016 | Girardi | F26B 9/06 |
| 2017/0219286 | A1 | * | 8/2017 | Jamaluddin | F26B 25/22 |
| 2018/0209736 | A1 | * | 7/2018 | Mallory | F26B 21/026 |

FOREIGN PATENT DOCUMENTS

| | | | | | |
|---|---|---|---|---|---|
| GB | 767457 | A | * | 2/1957 | B65G 53/06 |
| GB | 898090 | A | * | 6/1962 | F27B 9/3011 |
| GB | 1326715 | A | * | 8/1973 | C21D 9/63 |
| JP | 5105993 | B2 | * | 12/2012 | |

OTHER PUBLICATIONS

Progressive tunnel drying kilns-screen shot of web page on site maintained by KATRES Ltd.; as shown Jul. 6, 2013 at http://www.katres.cz/en/products/progressive-tunnel-kilns/ showing longitudinal cross section of a kiln and related airflows.

Giroux, Paul, Kiln Fans-From Design to Optimizing Performance, Western Dry Kiln Association Meeting 2004, May 2004, 5 pages, Western Dry Kiln Association, Portland Oregon.

* cited by examiner

100

300

300

2400

2400

2480

2480

2480

2600

2600

2600

Reverse Flow

Forward Flow

Position

Reverse Flow

Forward Flow

Position

Reverse Flow

Forward Flow

Position

Reverse Flow

Forward Flow

Position

Reverse Flow

Forward Flow

Position

Reverse Flow

Forward Flow

Position

Reverse Flow

Forward Flow

Position

Reverse Flow

Forward Flow

Position

Reverse Flow

Forward Flow

Position

Reverse Flow

Forward Flow

Position

Reverse Flow

Forward Flow

Position

Reverse Flow

Forward Flow

Position

Reverse Flow

Forward Flow

Position

Reverse Flow

Forward Flow

Position

FIG. 60 Position
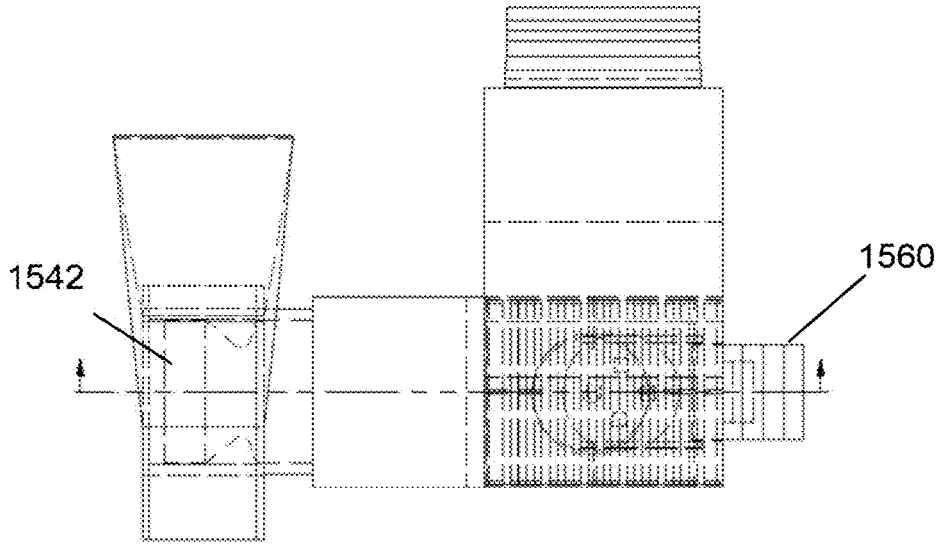
FIG. 61 Forward Flow
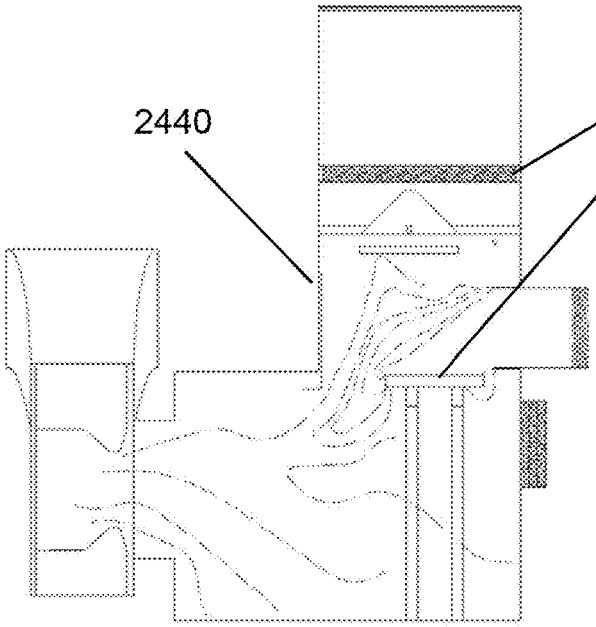
FIG. 62 Reverse Flow
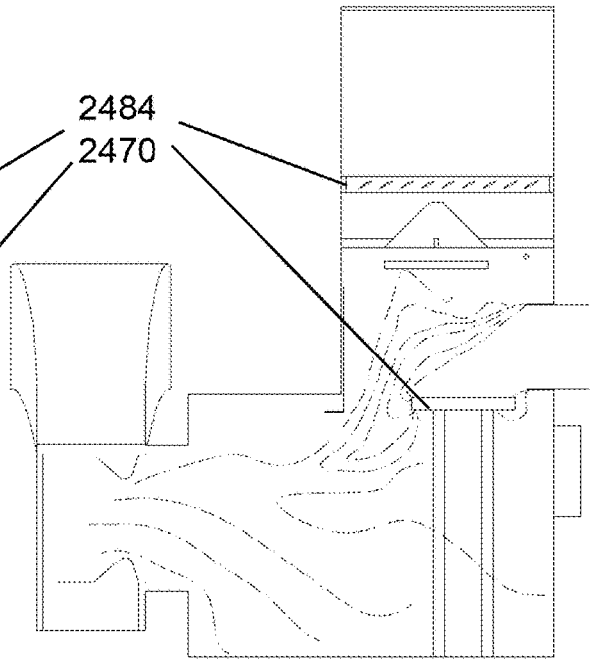

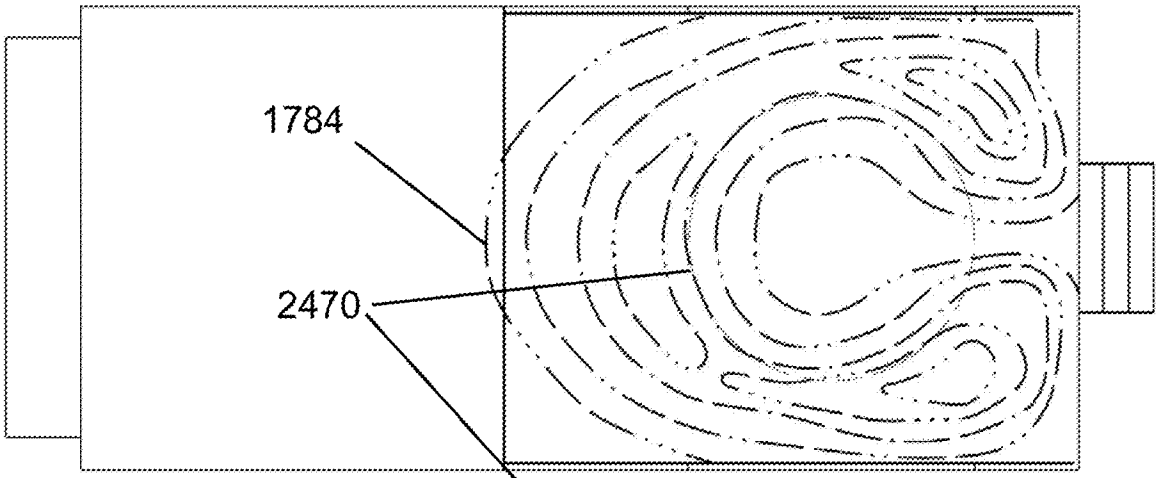
FIG. 64 Forward Flow
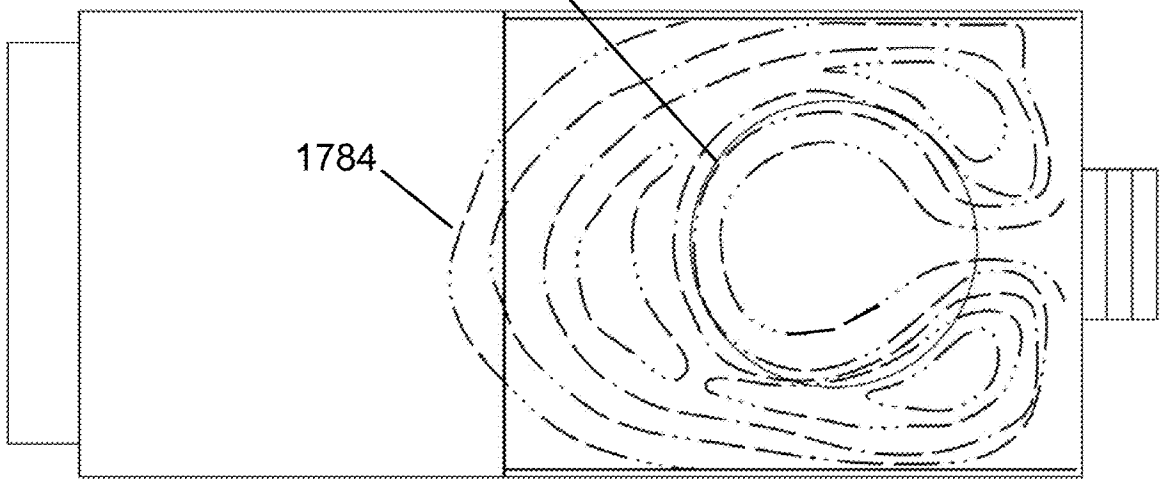
FIG. 65 Reverse Flow
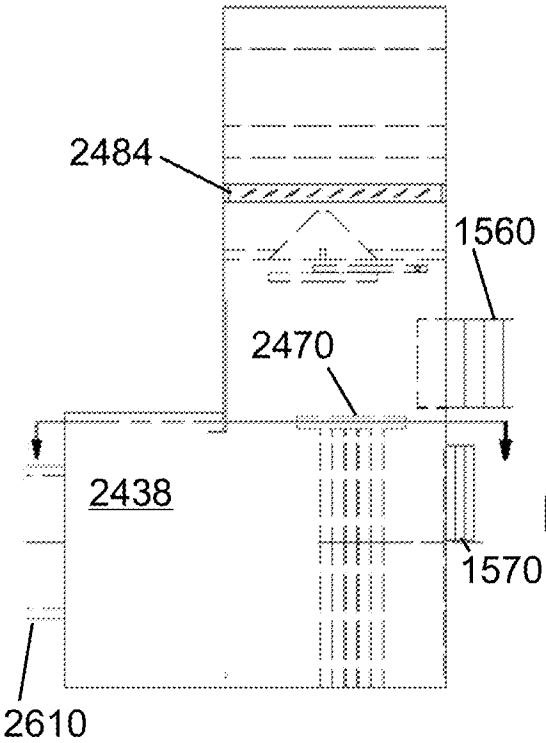
FIG. 63 Position

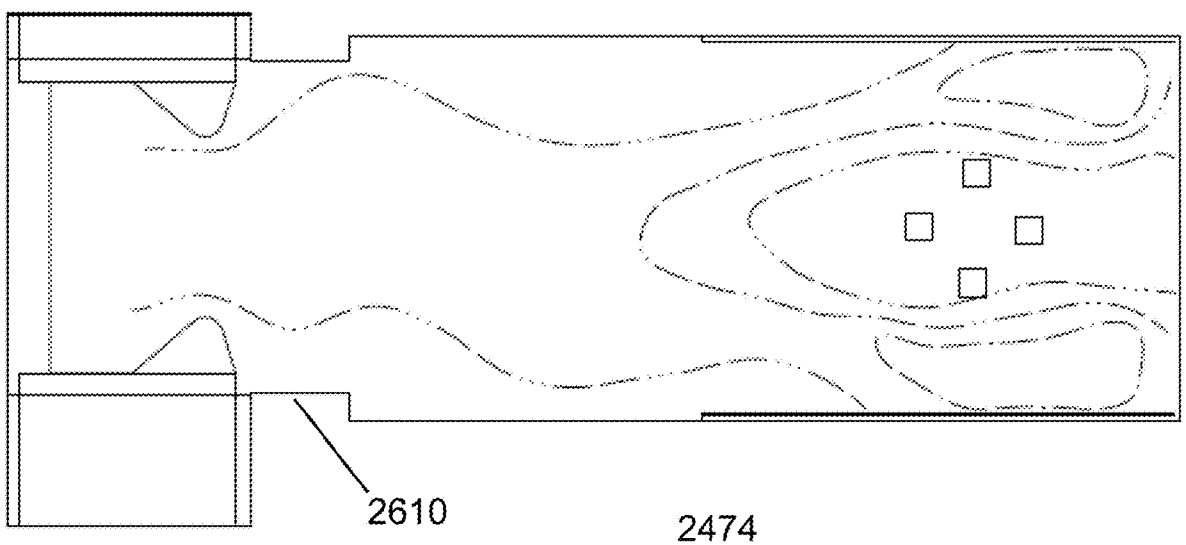
FIG. 67 Forward Flow
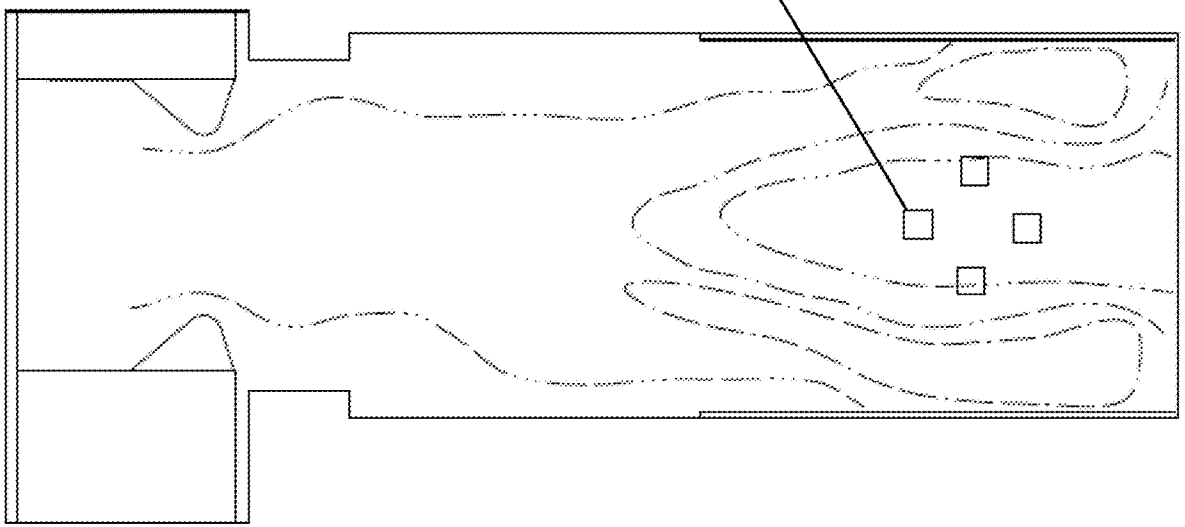
FIG. 68 Reverse Flow
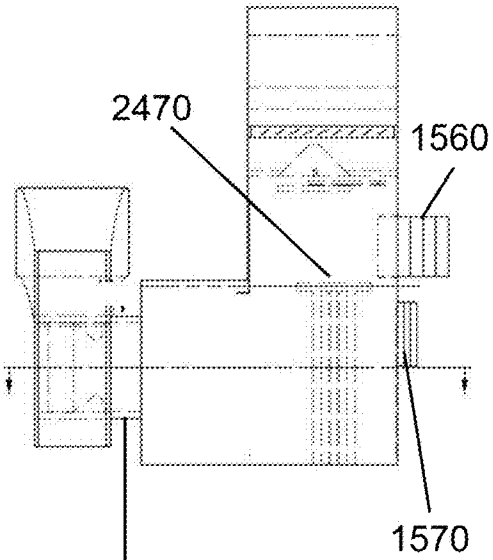
FIG. 66 Position Reverse Flow Forward Flow Position Reverse Flow Forward Flow Position

FIG. 75 Position
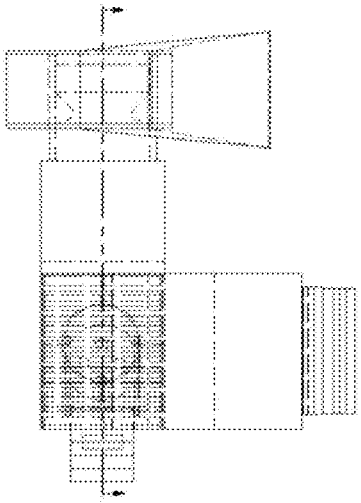
FIG. 76 Forward Flow
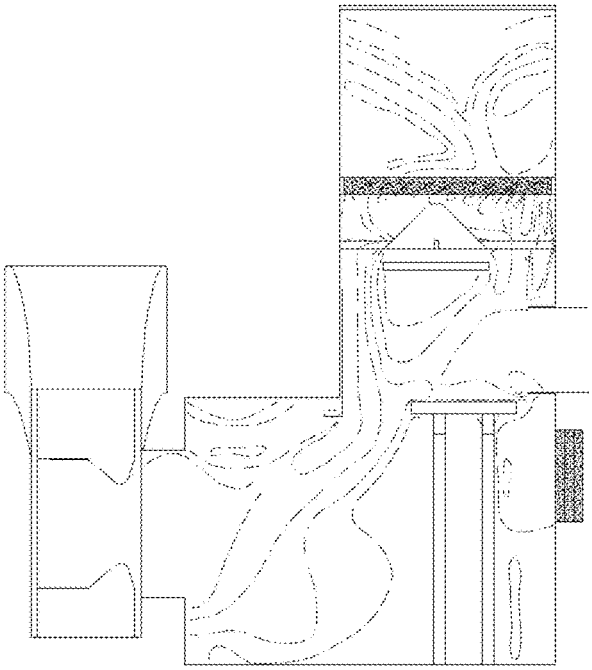
FIG. 77 Reverse Flow
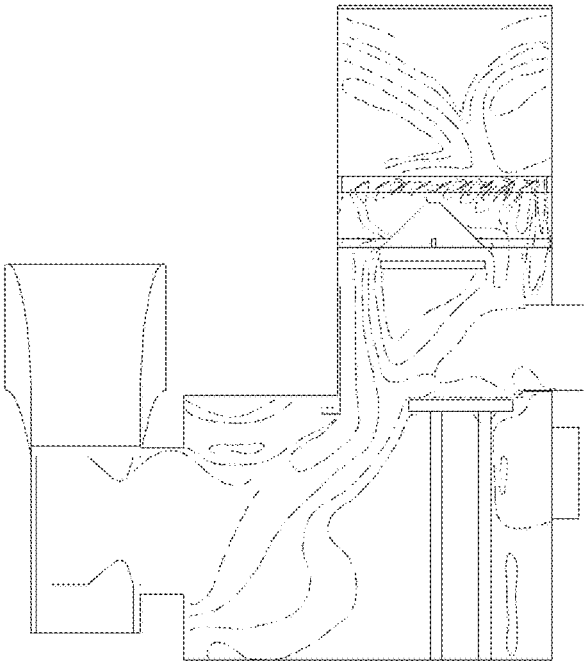

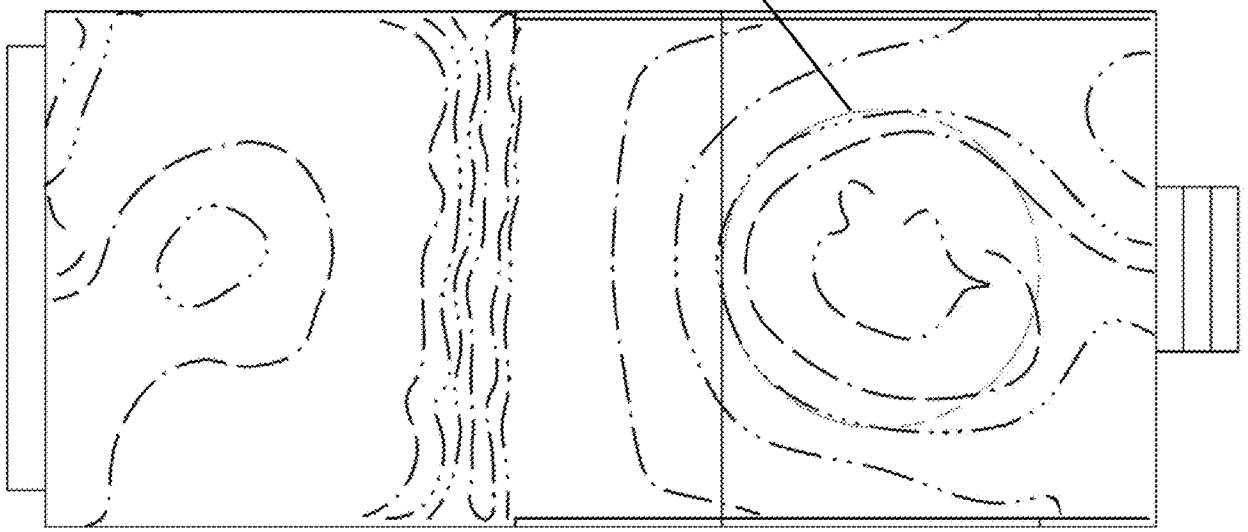
FIG. 79 Forward Flow
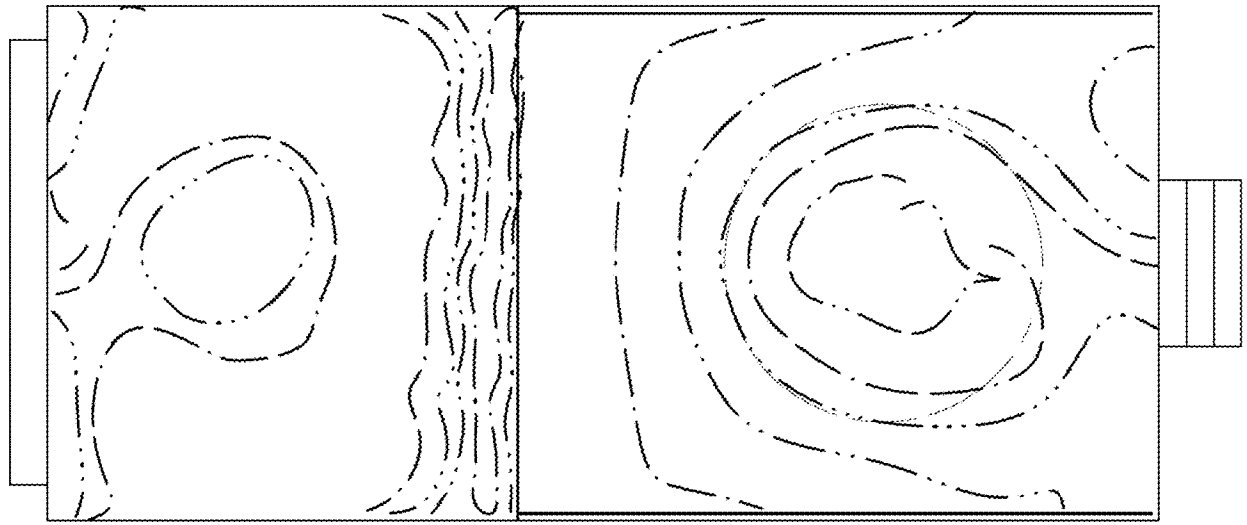
FIG. 80 Reverse Flow
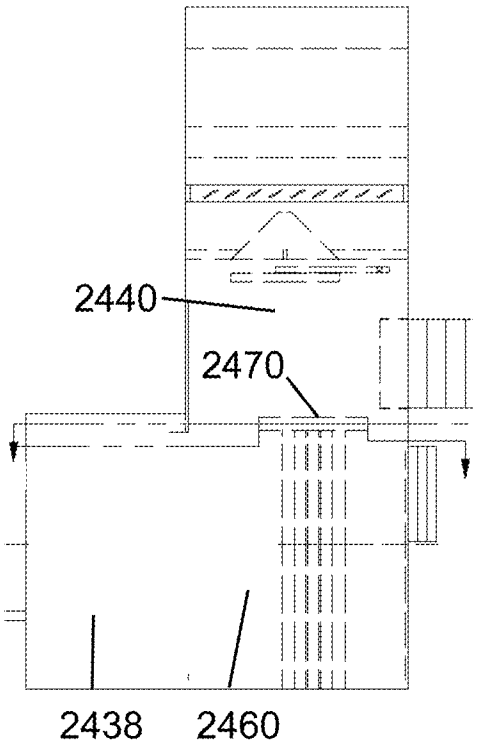
FIG. 78 Position

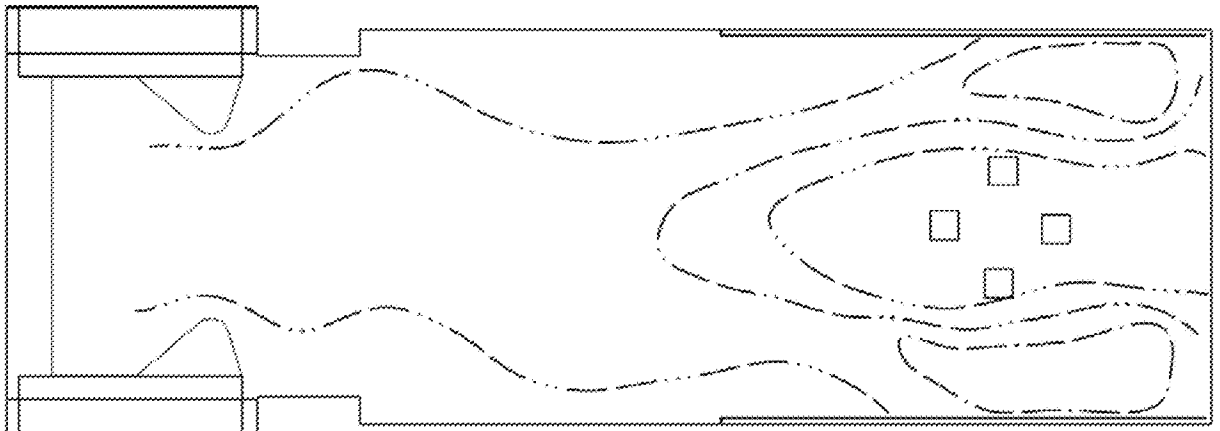
FIG. 82 Forward Flow
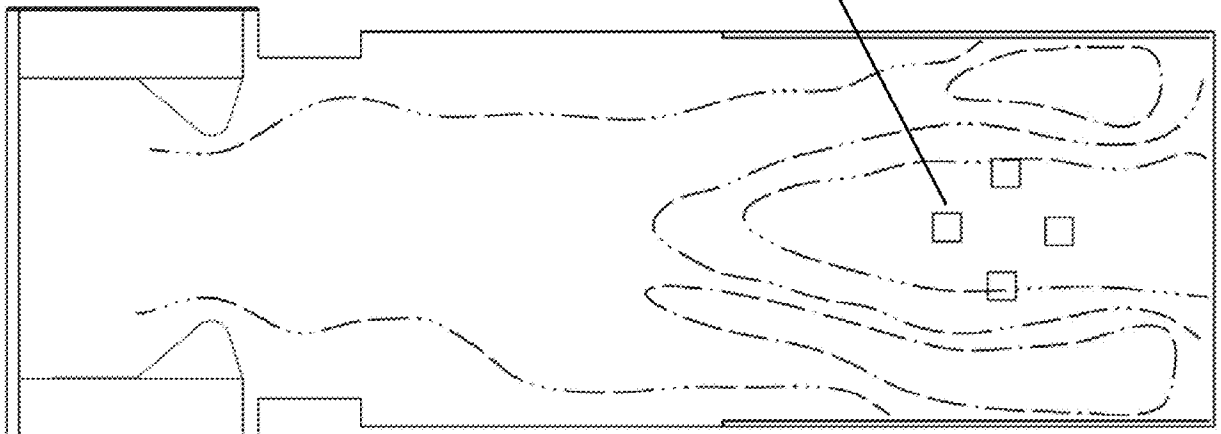
FIG. 83 Reverse Flow
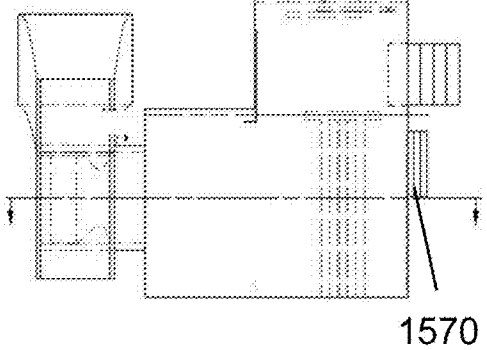
FIG. 81 Position

VERTICALLY INTEGRATED DUAL RETURN ASSEMBLY

This application builds upon and incorporates in its entirety and U.S. Pat. No. 9,423,176 issued Aug. 23, 2016 for System for Balancing Lumber Kiln Return Air.

This application claims the benefit of U.S. Provisional Application No. 62/449,527 filed on Jan. 23, 2017 with title Vertically Integrated Dual Return Assembly. The '527 application including the appendices are incorporated by reference herein.

FIELD OF THE DISCLOSURE

This disclosure applies to systems using direct fired heating systems for the drying of lumber in which the circulation direction of air inside a kiln is periodically reversed, including but not limited to continuous and batch kilns. The continuous drying kiln (CDK) design is one in which two paths of lumber travel in opposite directions through a sequence of chambers in which wood is preheated, dried, equalized and then conditioned. In batch kilns the lumber stays in the kiln without movement until fully treated.

Vocabulary

Frequently, when describing an industrial process, it is useful to note that a given parameter is substantially met. Examples may be substantially parallel, substantially perpendicular, substantially uniform, and substantially flat. In this context, substantially X means that for purposes of this industrial process it is X. So something that may not be absolutely parallel but is for all practical purposes parallel, is substantially parallel. Likewise, mixed air that has substantially uniform temperature would have temperature deviations that were inconsequential for that industrial process.

As recognized in *C. E. Equipment Co.* v. *United States,* 13 U.S.P.Q.2d 1363, 1368 (Cl. Ct. 1989), the word "substantially" in patent claims gives rise to some definitional leeway—thus the word "substantially" may prevent avoidance of infringement by minor changes that do not affect the results sought to be accomplished.

Continuous Drying Kilns.

FIG. 1 introduces a series of elements found in continuous drying kilns 100. Typically a continuous drying kiln will have a structure 104 with a first end 108 and a second end 112 at the opposite end of the structure 104. Running through the structure 104, is a first pathway 116 and a second pathway 120. The pathways frequently use rails 124 to guide a first set of carriages 128 along the first pathway 116 and a second set of carriages 132 along the second pathway 120. The carriages (128 132) may have wheels (not shown) much like those found on railroad cars.

If the first set of carriages 128 enters the structure 104 through the first end 108 and exits through the second end 112, then the second set of carriages 132 enters the structure 104 through the second end 112 and exits through the first end 108. Thus, when lumber 130 is stacked on the carriages (128 and 132) and exposed to heat in the main drying section 300, the heated lumber 136 passes near lumber that has not yet been in the main drying section 300 (green lumber 140).

Note the simplified drawing in FIG. 1 shows the lumber as an essentially solid stack. This is not the case. Spacers (not shown) are placed across each layer of boards within each stack of lumber 130 to provide open area for air movement through the lumber stack 156. Weights (not shown) on top of each lumber stack 156 provide restraint, minimize warping, and prevent boards from falling off of the top of the lumber stack 156.

Turning to FIG. 2, to minimize the air flow that might otherwise go over the top of the lumber stack 156 within the structure 104, structure 104 has longitudinal baffles 220 that are aligned with the long axis of the structure 104 and thus aligned with the direction the lumber stacks travel through the kiln 100 and orthogonal to the flow of air from the first side 144 to the second side 148 of the structure or to the flow of air from the second side 148 to the first side 144 of the structure 104. These longitudinal baffles 220 are designed to minimize the leakage of air between the fan deck 224 and the top 152 of the lumber 130, thus directing the air to flow through the air spaces between the layers of lumber 130 separated by spacers (not shown) in the lumber stacks 156 (FIG. 1).

Returning to FIG. 1, the heated lumber 136 passes heat to the green lumber 140 to partially heat and dry the green lumber 140 and the green lumber 140 cools the heated lumber 136 by absorbing heat and by evaporating the moisture content of the green lumber 140. Thus, lumber stack 156 starts as green lumber 140 stacked upon the first set of carriages 128 with spacers to allow for air flow amongst lumber stacks 156. As the first set of carriages 128 moves along the first pathway 116, the green lumber 140 is exposed to air that is circulating in the first end energy recovery section 310 within kiln structure 104.

Returning to FIG. 2, FIG. 2 shows a cross section of the first end energy recovery section 310, operating in a reverse circulation direction 204 as bidirectional fans 200 push the air in the reverse circulation direction 204. The bidirectional fans 200 operate in openings in a center fan wall 228 that extends above the fan deck 224. The center fan wall 228 helps promote circulation by having a high pressure side downstream of the bidirectional fan 200 and a low pressure side upstream from the bidirectional fan 200.

Having an appropriate pressure gradient from the high pressure side of the center fan wall 228 to the low pressure side will cause a desired distribution of circulating air amongst the lumber 130 across the two sets of carriages (128 and 132).

To reduce the variability between lumber 130 on the first side 144 and the second side 148 of the first set of carriages 132 or the second set of carriages 132, the bidirectional fans 200 are periodically stopped and allowed to coast to a full stop. Then the bidirectional fans 200 are operated in the opposite direction to push air in the forward circulation direction 208 as shown in FIG. 3. In the forward circulation direction 208, air that from the bidirectional fans 200 enters the lumber on the first set of carriages 128 on the first side 144 then enters the lumber on the second set of carriages 132 on the first side 144 then exist on the second side 148. Normal practice is to change the fan direction about once every two to four hours. The period of running the bidirectional fan 200 in one direction is often called a fan cycle.

Returning now to FIG. 1, many structures include intermediate orthogonal baffles 320 within the energy recovery sections (310 and 340). The first end 108, and second end 112 may have some level of orthogonal baffles to limit loss of heat, but the structure 104 is typically far from hermetically sealed as there is a need for water vapor to leave the structure 104 at the first end 108 and second end 112 often as visible fog.

Returning to the processing of lumber stack 156 stacked upon the first set of carriages 128, eventually, the lumber stack 156 progresses from the first end energy recovery section 310 through orthogonal baffles 324 to enter the main drying section 300.

The main drying section 300 is much like the energy recovery sections 310 and 340 with a set of bidirectional fans 200 located above a fan deck 224 circulating air alternatively in the forward circulation direction 208 and the reverse circulation direction 204. Longitudinal baffles 220 (FIG. 2) keep the circulating air from passing between the top 152 of the lumber 130 and the fan deck 224. In the main drying section 300, direct fired kilns require an additional circulation path to move air from the structure 104 to an air blending chamber (not shown here) where hot flue gas from a direct fired burner is mixed with the kiln return air from the structure 104 to create a mix within a prescribed temperature range.

This mix of heated air and flue gas is returned to the main drying section 300 to increase the temperature and decrease the humidity of the main drying section 300. A recirculation blower forces heated air leaving the air blending chamber into a distribution duct 232 (FIG. 4) that extends the length of the main drying section 300. The recirculation blower can be a conventional squirrel cage fan, sometimes called a centrifugal fan. The distribution duct 232 may release heated air in an upward direction through apertures in the top surfaces of the fan deck 224 or the distribution duct 232 may also release heated air in a downward direction through slotted vertical ducts, which are called downcomers, are located between the first pathway 116 and second pathway 120 below the fan deck 224. The apertures and downcomers may be tuned to promote uniform distribution of the heated air. The flue gas leaving the direct fire burner may be near 2000 degrees Fahrenheit but after mixing first with the kiln return air from the structure 104, may return to the main drying section 300 at 450 degrees Fahrenheit which is nearly twice the main drying section set point air temperature which is often between 240 degrees Fahrenheit and 260 degrees Fahrenheit.

Eventually, lumber stack 156 stacked upon the first set of carriages 128 emerges from the main drying section 300 through orthogonal baffle 324 to enter the second end energy recovery section 340. Now the lumber 130 is heated lumber 136 giving off heat and drying green lumber 140 on carriages 132 on the second pathway 120. The heated lumber 136 is exposed to air moving in the forward circulation direction 208 and in the reverse circulation direction 204 as the bidirectional fans 200 are periodically turned off, allowed to coast to a stop, and then restarted in the opposite direction.

The lumber stack 156 emerges from the second end 112 and is eventually removed from the carriage 132.

Lumber on carriages 132 on the second pathway 120 receive the same sequence of treatments but travel in the opposite direction from the second end 112 to the first end 108.

Batch Kilns

In batch kilns, the entire process typically takes about twenty four hours for a complete charge, including time to load and unload the kiln and to carry out clean up or routine maintenance. While the total process time for continuous drying kilns is typically on the order of forty hours per lumber stack, the continuous process includes more even preheating and conditioning steps and produces significantly more board feet per year. The extended process of the continuous drying kilns tends to produce lumber with fewer defects than lumber from batch kilns.

Batch kilns are similar to continuous drying kilns in the essential ways in which operations are affected by pressure differentials caused by the interaction of fan reversals and the return air ducts required for direct fired heating systems. Most batch kilns are also similar in length to the middle drying sections of continuous drying kilns, about 100 feet long. Due to these similarities, many older batch kilns are currently being converted to continuous drying kilns through the process of extending the rail length inside a batch kiln and adding two end energy recovery sections on either side of the pre-existing batch structure.

Return Ducts.

U.S. Pat. No. 9,423,176 for System for Balancing Lumber Kiln Return Air referenced above, modified the prior art by adding a new in-kiln dual return duct design described below to keep the return air inside the warm kiln structure 104 of the kiln 100 to a great extent, reducing the length of the return duct between the structure and the air blending chamber 1538 (See FIG. 4). Other than for a brief transition from kiln structure 104 to the air blending chamber 1538, the in-kiln return duct will frequently not need a separate support structure. Since the majority of the in-kiln return duct will be incorporated into the existing kiln structure 104 of the kiln 100 that is associated with the center fan wall 228, it will cost less to build while resolving heat loss, pressure loss and corrosion problems exhibited by prior art dual-return designs.

FIG. 4 shows supply duct system for the main drying section 300. The operation of the supply duct system remains the same no matter whether the bidirectional fans 200 are operated to cause air flow in the reverse circulation direction 204 (FIG. 2) or the forward circulation direction 208 (FIG. 3). First pathway 116 with first set of carriages 128 and second pathway 120 with second set of carriages 132 convey lumber stacks 156 in opposite directions through the main drying section 300.

FIG. 4 shows an internal second return duct 2330 with opening 2350. Internal second return duct 2330 is placed above fan deck 224 but below roof 660. Internal second return duct 2330 crosses through an opening in center fan wall 228, perhaps by the omission of one or more bidirectional fans 200 from the array of bidirectional fans 200. A damper (not shown here) isolates opening 2350 as a return duct 1530 draws air from the main drying section 300 via opening 1550 (as discussed below).

A direct fired burner 1534 (represented here by a flame) feeds burner exhaust at approximately 2000 degrees Fahrenheit into an air blending chamber 1538 to provide a mix of burner exhaust with kiln return air from the return duct 1530 to provide an output supplied to the main drying section 300 above the main drying section set point which is often between 240 degrees Fahrenheit and 260 degrees Fahrenheit. The heated air is supplied via the supply duct 1546 and distributed to the space between the fan deck 224 and the tops of the lumber stacks 156 via distribution duct 232 as indicated by arrows 246 before entering the main drying section 300 above the fan deck 224 through distribution vents 250. The air moving to and from the air blending chamber 1538 will be moved by a recirculation blower 1542 located after the air blending chamber 1538.

The return air flow is thus from the air blending chamber 1538, to the suction side of recirculation blower 1542, out the discharge side of recirculation blower 1542, through the supply duct 1546 to feed all of the distribution vents 250 via distribution duct 232.

FIG. 4 illustrates what is often called the forward circulation direction 208. Bidirectional fans 200 are operated to cause air flow in the direction away from return duct 1530. As bidirectional fans 200 are forcing air towards the first side 144 away from the opening 1550 to the return duct 1530, there is a pressure gradient from the first side 144 to the second side 148 which causes the circulated air to pass through the spaced lumber on the first set of carriages 128 and the second set of carriages 132.

FIG. 5 illustrates what is often called the reverse circulating direction 204. In the reverse circulation direction 204, the bidirectional fans 200 are operated to cause air flow in the opposite direction of the forward circulation direction 208. Note that the bidirectional fans 200 create a pressure gradient which acts to move air across the lumber stacks 156 on the second set of carriages 132 and then across the lumber on the first set of carriages 128.

FIG. 5 shows internal second return duct 2330 in main drying section 300 operated in the reverse circulation direction 204. Damper operation allows return air to enter opening 2350 rather than opening 1550 to cause return air to travel through internal second return duct 2330 on way to return duct 1530.

The controls for dampers used in a dual return system may be connected together so that the system is precluded from closing both dampers at any one time. The duct selection dampers may either be linked to each other mechanically or by other means. They may be determined to have opposite actions so that only one of the dual return ducts is ever allowed to be open at one time. Alternatively, the duct selection dampers may also be separate and independent, in order to lower pressure in the air blending chamber under certain startup circumstances by receiving return air from both sides of the kiln at the same time.

As designed to minimize or eliminate the pressure differences experienced by the change from forward direction to reverse direction, the damper system may focus on the mixing of burner output gas from the direct fired burner to deliver a desired temperature from the outlet of the air blending chamber.

Damper Example.

FIG. 6 shows one damper arrangement. Internal second return duct 2330 is regulated by damper 2332 which is normally full open (as shown in FIG. 6) or full closed. The air flow through opening 1550 for the forward fan direction is regulated by damper 1552 which is normally full open or full closed (as shown in FIG. 6). Controls can be set up to move the blades for damper 2332 in unison but in the opposite way from the movement of blades for damper 1552 to ensure that both sets of blades for dampers 1552 and 2332 are not closed at the same time as that would cause the recirculation blower 1542 to pull an unusual amount of air flow from the direct fired burner 1534 and fresh air damper 1570.

Heat modulating damper 1536 (also called the heat regulating damper) is used to control the amount of kiln return air entering into the air blending chamber (1538 not shown in detail here). Opening the heat modulating damper 1536 will decrease the draw (suction) on the direct fired burner 1534, and conversely closing the heat modulating damper 1536 will increase the suction on the direct fired burner 1534. Thus, the heat modulating damper 1536 alters the ratio of kiln return air in the air blending chamber 1538 from the return duct 1530 versus burner output gas output from the direct fired burner 1534. By providing similar air flow to the heat modulating damper 1536 under both forward and reverse fan operation, the heat modulating damper 1536 may be used to control the air blending chamber 1538 and thus the output temperature of the air blending chamber rather than partially to compensate for differences in air flow from the forward and reverse fan direction.

Focus on the Air Blending Chamber.

As the focus in U.S. Pat. No. 9,423,176 issued Aug. 23, 2016 for System for Balancing Lumber Kiln Return Air was the use and placement of an internal second return duct 2330, very little detail was provided on the air blending chamber 1538. In fact, the heat input was merely represented symbolically by a flame for the direct fired burner 1534.

As the present disclosure addresses improvements to the air blending chamber, it is useful to discuss the prior art air blending chambers in greater detail. An air blending chamber that could be used in FIG. 4 and FIG. 5 above may receive recirculating kiln return air from either the first side 144 or the second side 148 of the center fan wall 228 at temperatures near 220 degrees Fahrenheit. As indicated in FIG. 4 and FIG. 5 this kiln return air flow would come into the air blending chamber on the kiln side wall of the air blending chamber. Heated products of combustion ("burner output") enter from the burner through the roof of the air blending chamber at temperatures near 2000 degrees Fahrenheit. The burner output may include a flame that extends into the air blending chamber 1538. Primarily because of the differences in temperature, the recirculating kiln return air will have a significantly different density and viscosity from the burner output gas from the burner output. Consequently, gases from kiln return air and burner output gas tend to remain in separate flow streams while traveling through the air blending chamber 1538 into the inlet of the recirculation blower 1542.

Without adequate mixing, computer models indicated that streams of burner output gas continued to have significantly elevated temperatures relative to streams of recirculated kiln return air and these streams of gases of very different temperatures extended through the recirculation blower 1542 and into the distribution duct 232. The differences were stronger with larger systems with a larger burner and a larger blower. Thus the model indicated that the situation was tolerable for a given air blending chamber 1538 with a 35 million BTU/hr burner and a 217,000 CFM blower but became more problematic when scaled to a 40 million BTU/hr burner and a 280,000 CFM blower. The exact place where inadequate mixing becomes problematic will be a function of many design attributes such as duct sizes and blower choice but there appears to be an increased effect of non-homogenous temperature profiles as the burner/blower pair is scaled up.

While perfectly homogenous temperature profiles may not be necessary, severe deviations in from homogenous temperature profiles may mean that portions of the recirculation blower 1542 are frequently exposed to thermal excursions beyond the desired upper temperature limit. Some recirculation blowers 1542 may have a rating for extended exposure of 600 degrees Fahrenheit and may not last as long if portions are exposed to prolonged exposure of temperatures well above that rating. Newer recirculation blowers 1542 may tolerate short temperature excursions of up to 800 degrees Fahrenheit. Alternatively, a system that has a tendency for temperature excursions to reach the recirculation blower 1542 may cause the designers to choose a more expensive blower that is rated for an unusually high temperature rating to compensate. This is not an academic thought experiment. Recirculation blowers do suffer damage and need to be replaced if subject to severe temperature excursions.

But in all events, there is a desire to control the mixing to that the temperatures are substantially uniform. A measured temperature excursion above 500 degrees Fahrenheit in the supply duct 1546 may cause the controls to operate the heat modulating damper to decrease the burner output delivered to the mixing chamber assembly. If this measured value is a local hot spot rather than representative of the blended temperature, then the heat to the kiln will be attenuated and the heat treatment process slowed.

A second incentive for promoting mixing in the air blending chamber 1538 is that any thermal differences that cause some distribution vents 250 to deliver air at a much higher temperature than other distribution vents 250 will make the process of curing lumber less consistent than a kiln that has substantially uniform temperatures for the air coming out the entire set of distribution vents 250. The lack of uniform temperature from the distribution vents 250 will be particularly problematic in a batch kiln rather than a continuous drying kiln as the same lumber stack will receive overheated air repeatedly as opposed to lumber stacks on carts that are exposed to air from different distribution vents 250 over time.

Fresh air provided to the air blending chamber 1538 can quickly drop the temperature of the output of the recirculation blower 1542. A fresh air damper 1574 can be used to mix in drier fresh air as the direct fired burner 1534 is often using sawdust for fuel and that has a high water content which is passed with the burner output gas. There will frequently be a small inflow of fresh air through the fresh air damper 1574 even when the fresh air damper 1574 is nominally closed. Some models assume 5% flow of a full open fresh air damper 1574 will be passing through a closed fresh air damper 1574 as in-leakage.

As the total amount of gas that enters the air blending chamber 1538 is largely controlled by the suction of the recirculation blower 1542, the heat modulating damper 1536 can reduce the amount of air that comes from the kiln and thus increases the amount of draw from the direct fired burner 1534. If the heat modulating damper 1536 closes too rapidly so that the change in draw on the burner might be disruptive, the fresh air damper 1574 may open briefly to avoid a disruptive transient condition within the gasifier portion of the burner.

Focus on Heating Equipment.

Turning now to FIG. 7 and FIG. 8 there are a pair of perspective views of the prior art heating equipment located outside of a kiln. FIG. 7 shows the side of this equipment away from the kiln and FIG. 8 shows the view from the kiln side.

Visible in this pair of drawings is the direct fired burner 1534 which provides heated burner output from the direct fired burner 1534 that moves laterally and enters the top of the air blending chamber 1538. The burner output from the direct fired burner may be in the range of 2000 degrees Fahrenheit. The air blending chamber 1538 receives return air from either the reverse return duct 2334 or the forward return duct opening 1550, but in both cases the actual entry of return air from the kiln is through heat modulating damper 1536 (see FIG. 6) into the air blending chamber 1538.

Also visible in the pair of drawings of FIG. 7 and FIG. 8 are supply duct 1546 that conveys the output from recirculation blower 1542 that pulls mixed and heated air from air blending chamber 1538. For a sense of scale of these components, note stairs 2360.

As noted in the discussion of FIG. 6 the blades for damper 2332 may be moved in unison but in the opposite way from the movement of blades for damper 1552 to ensure that one set of blades for dampers 1552 and 2332 are open when the other set is closed. The use of the dampers 1552 and 2332 allows the return air to be taken from the low pressure side of the center fan wall 228. The heat modulating damper 1536 allows for the control of the mix of kiln return air and burner output to regulate the output temperature in the supply duct 1546.

SUMMARY OF THE DISCLOSURE

Attributes of the improved air blending chamber include:

- Enlarge air blending chamber to increase mixing path length from hot duct discharge to blower inlet.
- Overhead delivery of kiln return air with internal air flow turning vane in duct.
- Overhead location of the automated heat modulating damper.
- Locate horizontal delay plate such as a delay table immediately below the burner outlet.
- Have burner outlet in a dispersion chamber above an extended air balancing chamber to prolong the travel between the burner outlet and the recirculation blower inlet.
- Locate fresh air damper in close proximity below the delay table.

Those of skill in the art will recognize that while the disclosed designs used all of these features, one could benefit from a portion of the benefits of the present disclosure through use of one or more of these features.

A simplified overview of one way to use the teachings of the present disclosure is as follows. The outlet from the burner enters from the side of the vertically integrated dual return assembly in the dispersion chamber above the extended air blending chamber and air blending chamber rather than directly downward into the top of the air blending chamber as before. The hot burner output gas would be driven rapidly downward by the much larger volume of downward flow of the relatively cooler and denser kiln return air. The downward flow of the burner output gas is delayed by the delay table which keeps the burner output gas up in the dispersion chamber in the lower final portion of the vertically integrated dual return assembly. Notice the inward flow of much cooler fresh air (at ambient temperature of approximately 70 degrees Fahrenheit) through the fresh air inlet below the hot duct discharge from the burner. The fresh air inlet does not generally close fully so there is normally an inflow in the range of 5% of full flow. This relative cool air travels for the most part below the delay table.

BRIEF DESCRIPTION OF THE FIGURES

The disclosure can be better understood with reference to the following figures. The components in the figures are not necessarily to scale, emphasis instead being placed upon illustrating the principles of the disclosure. Moreover, in the figures, like reference numerals designate corresponding parts throughout the different views.

FIG. 51 to FIG. 68 are a series of triplet sets of drawings for a model of a vertically integrated dual return assembly using teachings of the present disclosure. The first figure in each triplet set indicates the location of the cross section view, the second figure shows model results for temperature profiles while the bidirectional fans in the kiln are operated to produce forward flow and the third figure shows the same cross section with the temperature profile for the model predictions when the bidirectional fan is operated in the reverse flow direction. These figures illustrate the substantial similarities in temperature profiles when the system is operated in the reverse direction compared with operation in the forward direction.

The figures provided in FIG. 69 to FIG. 83 are a series of triplet sets of figures for a model of a vertically integrated dual return assembly using teachings of the present disclosure. The results of FIG. 69 to FIG. 83 are from the same model used for FIG. 51 to FIG. 68. The first figure of each triplet set indicates the location of the cross section view, the second figure shows model results for flow velocity profiles while the bidirectional fans in the kiln are operated to produce forward flow and the third figure shows the same cross section with the flow velocity profile for the model predictions when the bidirectional fan is operated in the reverse flow direction. These figures illustrate the substantial similarities in flow velocity profiles when the system is operated in the reverse direction compared with operation in the forward direction.

DETAILED DESCRIPTION

Figure 1:
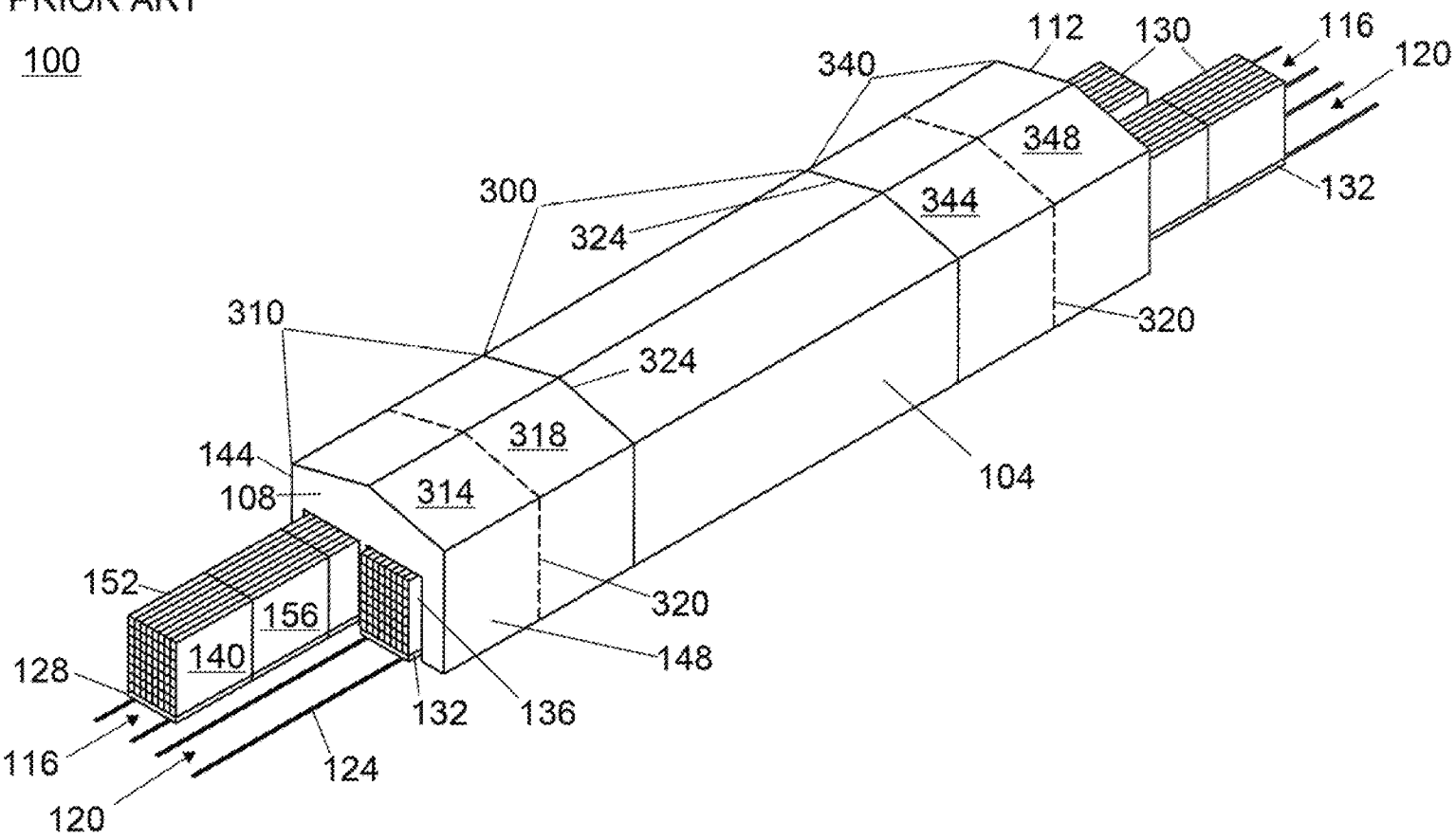
FIG. 1 PRIOR ART
FIG. 1 is a continuous kiln as exists in prior art.
Figure 2:
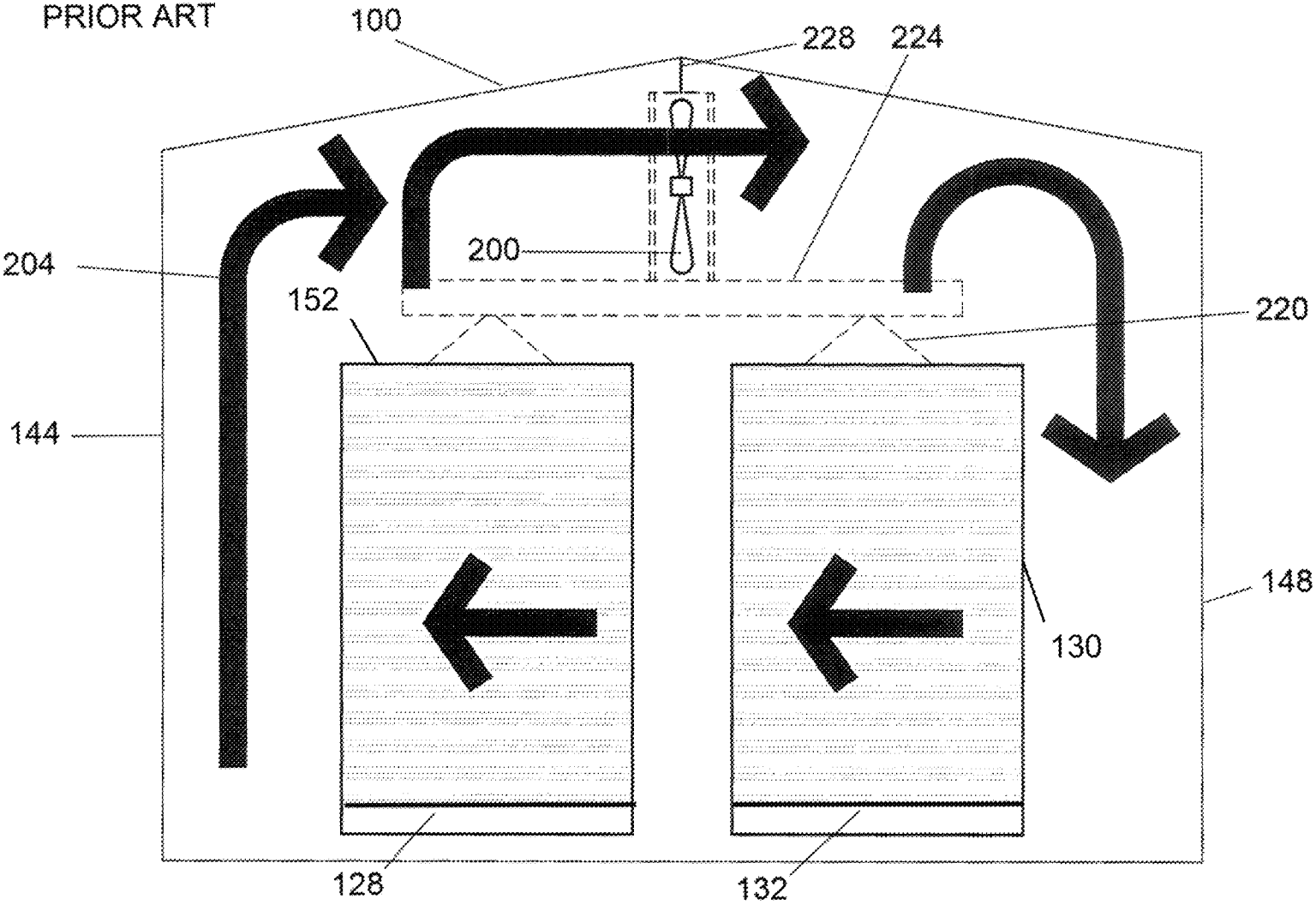
FIG. 2 PRIOR ART
FIG. 2 is a diagram of clockwise rotation of heated air trough lumber stacks
Figure 3:
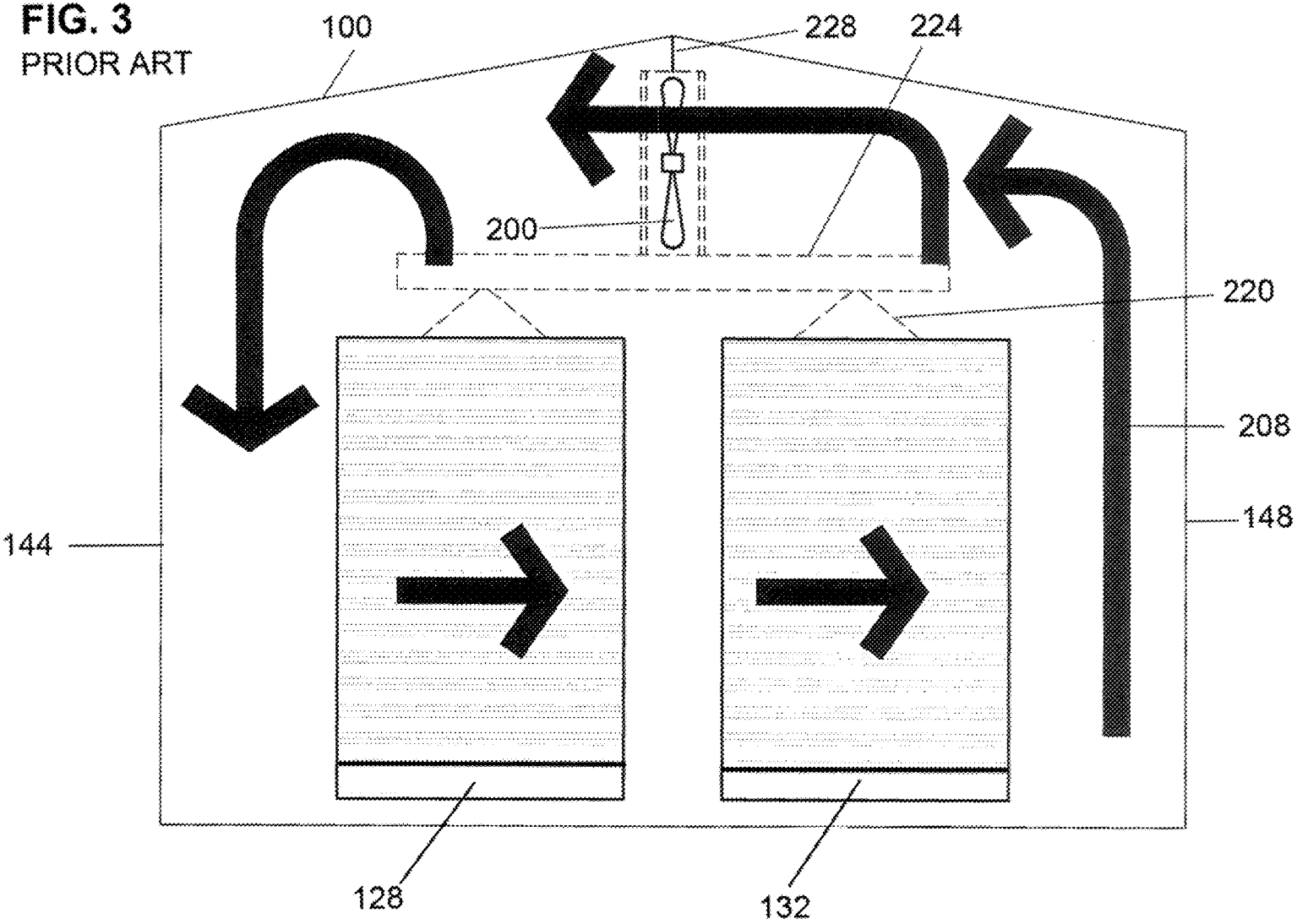
FIG. 3 PRIOR ART
FIG. 3 is a diagram of counter-clockwise rotation of heated air trough lumber stacks.
Figure 4:
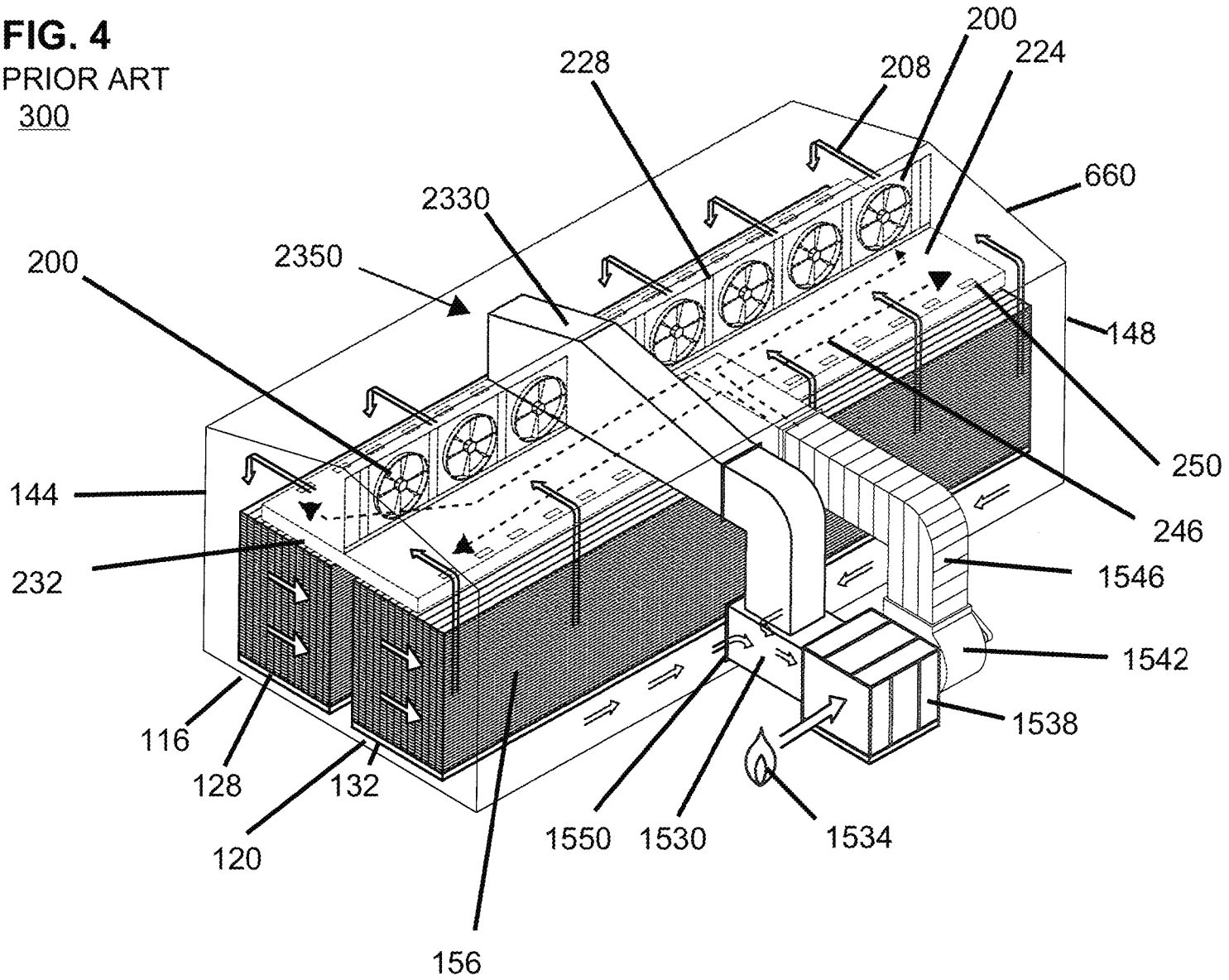
FIG. 4 PRIOR ART
FIG. 4 shows a prior art main drying section with an internal second return duct as operated with forward air flow.
Figure 7:
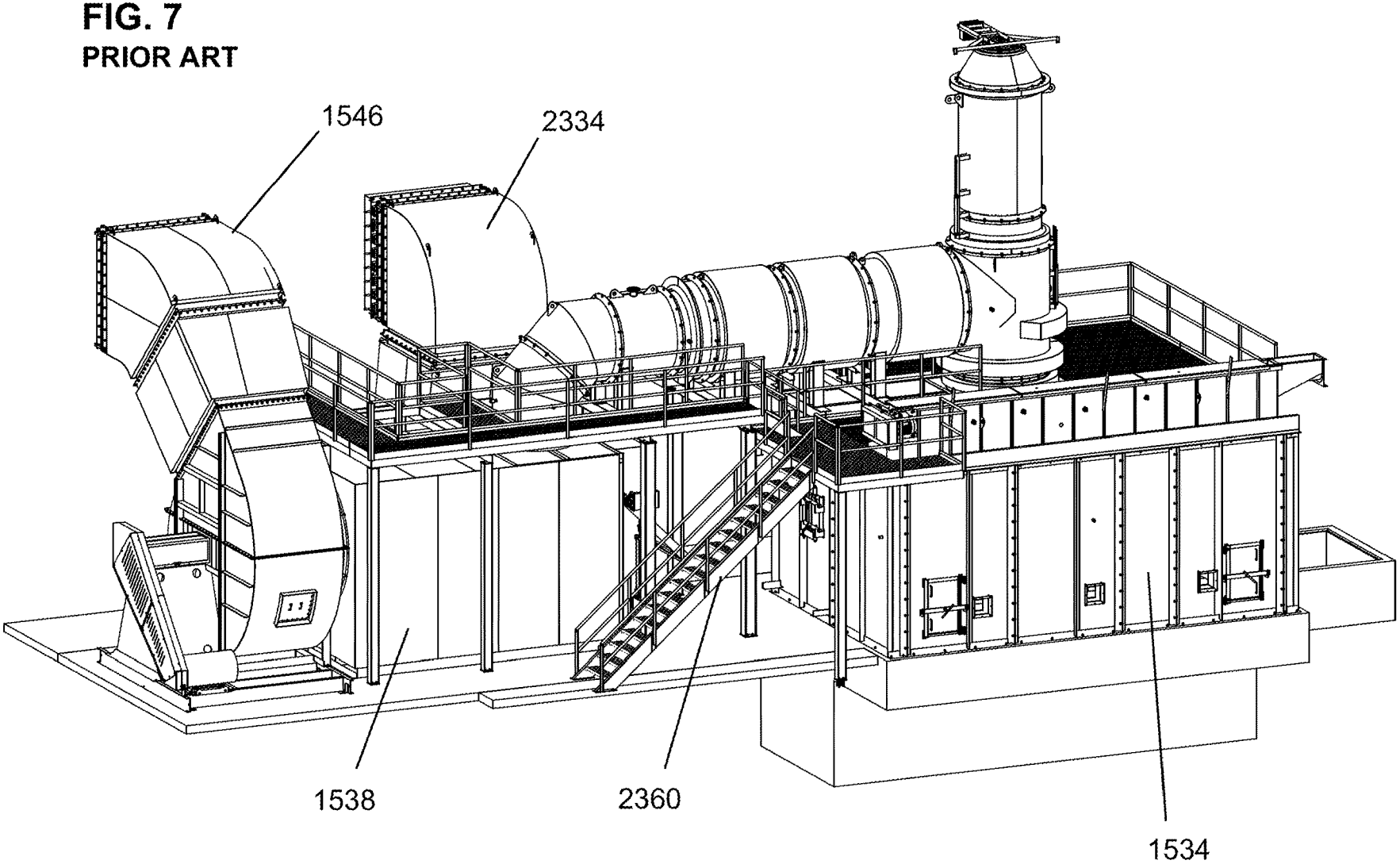
FIG. 7 PRIOR ART
FIG. 7 and FIG. 8 there are a pair of perspective views of the prior art heating equipment located outside of a kiln.
Figure 8:
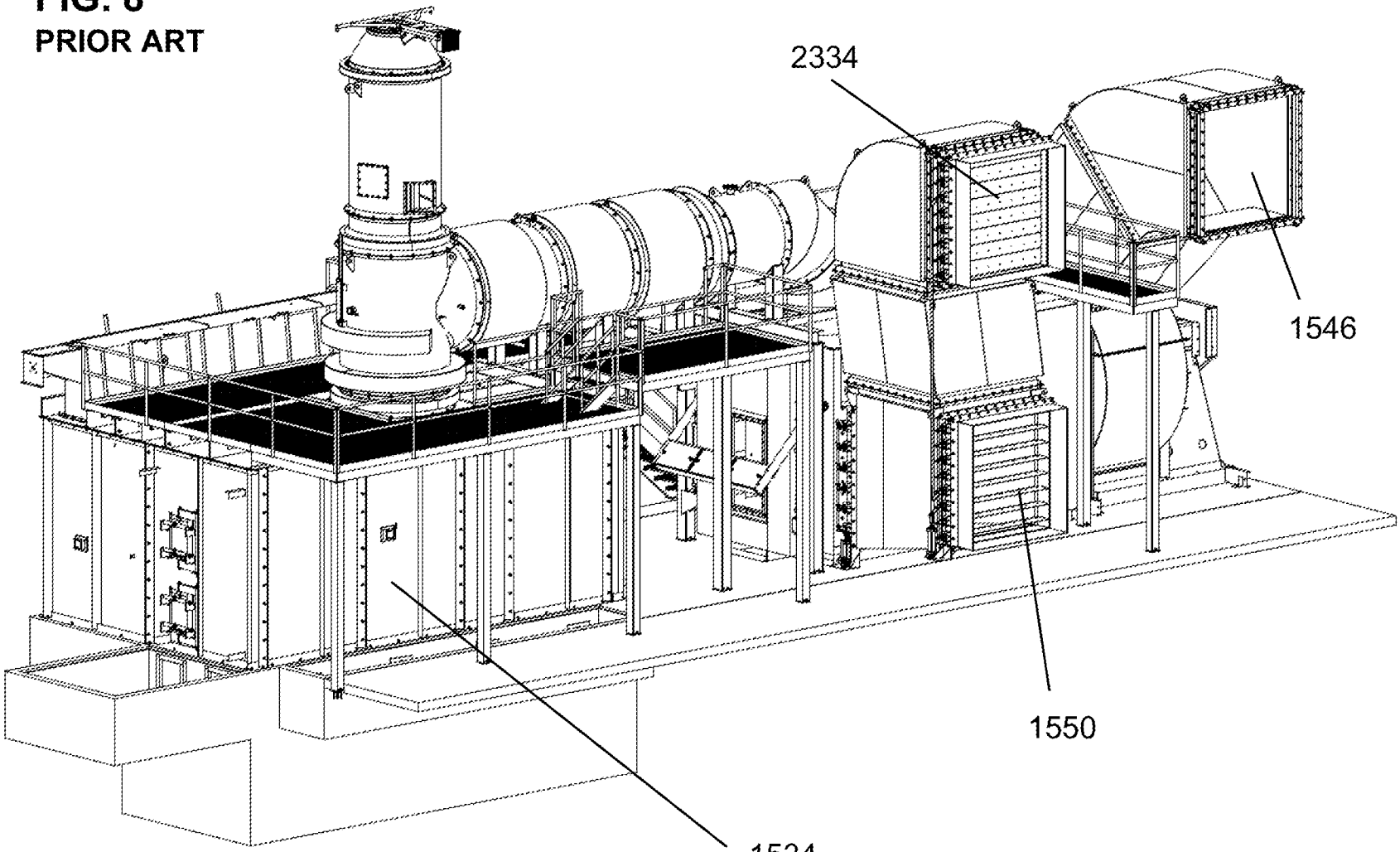
FIG. 8 PRIOR ART

To promote the mixing of kiln return air and much hotter burner output gas than would occur in an air blending chamber and duct work shown in FIG. 7 and FIG. 8 (discussed above), the configuration of components outside of kiln structure 104 was revised. The objectives were to:

- reduce local hot spots within the air blending chamber and recirculation blower; and
- promote a more uniform temperature of supply air provided to distribution duct 232 (FIG. 4).

Figure 10:
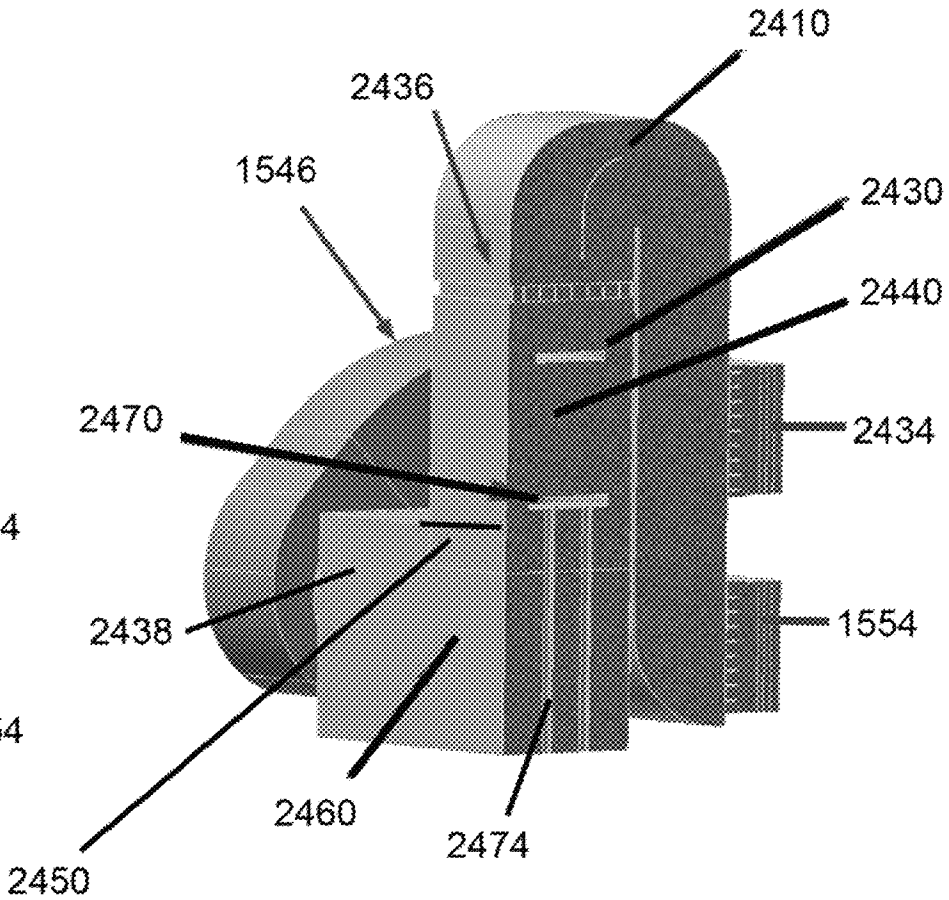
FIG. 10 is a cross section of the vertically integrated dual return assembly of FIG. 9 that has been rotated slightly.
Figure 9:
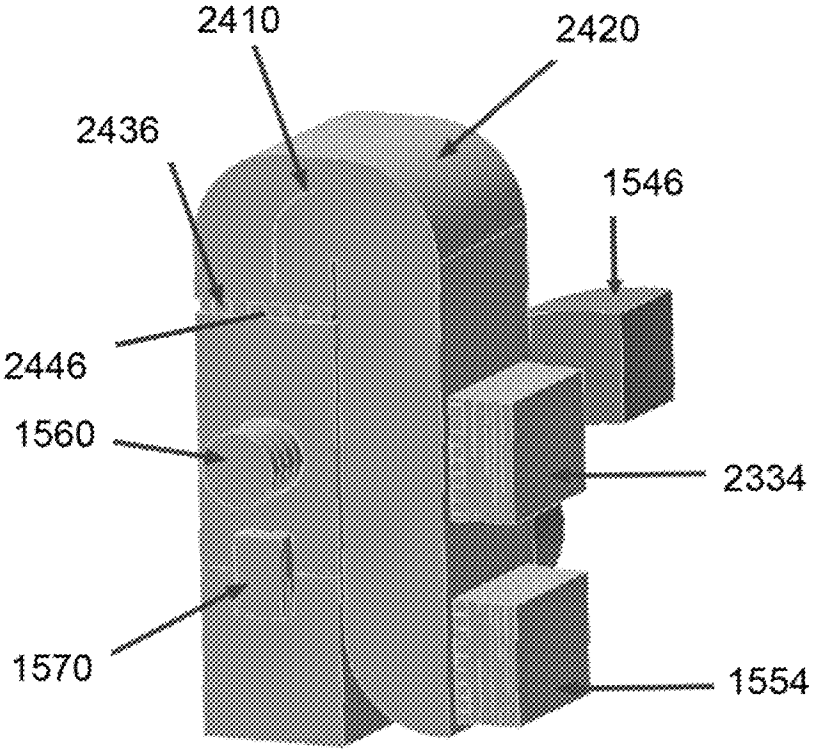
FIG. 9 is a perspective view of the vertically integrated dual return structure as it would be seen with the adjacent burner rendered invisible.

As described above, the prior art solution shown in FIG. 6 had the heat modulating damper 1536 located below the reverse return duct 2334 and blades for damper 2332 and slightly below forward return duct opening 1550 and damper 1552. In stark contrast, as illustrated in FIG. 9 and FIG. 10, the flow from either the reverse return duct 2334 or the forward return duct 1554 goes up, well above the top of the air blending chamber, turns 180 degrees guided by the upper interior of the duct and a turning vane 2410. The turning vane 2410 helps promote a downward flow of kiln return air that is evenly distributed on both sides of the hot duct discharge leaving hot duct 1560. Those of skill in the art will recognize that the same advantages may be had through the use of more than one turning vane or by having an extended downward vertical duct before reaching the heat modulating damper 2436.

After the change in direction and a brief downward flow, the kiln return air goes through the heat modulating damper 2436. The heat modulating damper 2436 performs the traditional task of controlling the temperature of heated air in the supply duct 1546 to the kiln by changing the ratio of relatively cool kiln return air (approximately 220 degrees Fahrenheit) and the much hotter burner output gas (approximately 2000 degrees Fahrenheit). The kiln return air is the overwhelming majority of the air flow into the air blending chamber accounting normally for 80 to 90 percent of the air flow with the remainder split between the burner output gas from hot duct 1560 and the cooler fresh air through fresh air damper 1570.

While the prior art introduced the burner output gas into the air blending chamber, the present disclosure moves the entry point of the burner output gas from the hot duct 1560 up into a dispersion chamber 2440 in the downward vertical portion of the vertically integrated dual return assembly 2400 so there is initial mixing of the kiln return air and the burner output gas within the dispersion chamber 2440 before entry into an extended air blending chamber 2438 below the dispersion chamber 2440.

First Example

FIG. 9 is a perspective view of the vertically integrated dual return structure 2400 as it would be seen with the adjacent burner rendered invisible. FIG. 10 is a cross section of the vertically integrated dual return assembly 2400 of FIG. 9 that has been rotated slightly. A fresh air damper 1570 is visible in FIG. 9 and allows fresh air to be added to the extended portion of the air blending chamber 2460 if needed to add fresh air as done in the prior art. As previously noted, the fresh air damper 1570 when closed normally allows some air in-leakage, often about 5% of full open flow. The boundary 2450 between the dispersion chamber 2440 and the air blending chamber 2438 and extended air blending chamber 2460 is shown to assist with discussion although boundary 2450 is not a physical item.

An external indication of the presence of the turning vane 2410 is shown in FIG. 9 and other figures showing the external portions of the vertically integrated dual return assembly 2400. This indication is for purposes of expressing the teachings of the disclosure. In actual practice, the only time the turning vane 2410 would actually be visible would be in a cross section or when viewed through another opening. Note that the heat modulating damper 2436 (sometimes called the heat regulating damper) is now horizontal instead of vertical (compare heat modulating damper 1536 in FIG. 6).

Note that in order to present the best possible view of the vertically integrated dual return assembly 2400, the vertically integrated dual return assembly 2400 is not shown after insulation. One of skill in the art will appreciate that duct work containing air and gases heated to well above ambient air temperature would benefit from substantial insulation, perhaps three or more inches thick.

Other components visible is FIG. 9 include the forward return duct 1554, the reverse return duct 2334, the combined return duct 2420 that runs upward and then downward so that the return air from the kiln is introduced downward rather than horizontally. Visible in both FIG. 9 and FIG. 10 is the supply duct 1546 that provides the output from the recirculation blower 1542 back to the kiln 100 through distribution duct 232 (FIG. 4).

The burner discharge comes via hot duct 1560 and enters the vertically integrated dual return assembly 2400 horizontally below the heat modulating damper 2436 and above the fresh air damper 1570. The output from the hot duct 1560 may be in the range of 2000 degrees Fahrenheit.

As noted above, FIG. 10 shows a cross section of the vertically integrated dual return assembly 2400 of FIG. 9 that has been rotated slightly. An isolation damper 2430 for the hot duct 1560 is visible in FIG. 10 in the open position. This isolation damper is an optional component that may be included if there is a wish to provide an isolation damper on the boundary between the hot duct 1560 discharge from the direct fired burner 1534 to the dispersion chamber 2440.

The present disclosure introduces a dispersion chamber 2440 between the heat modulating damper 2436 and the extended air blending chamber 2460. The dispersion chamber 2440 allows for the output from the direct fired burner 1534 (FIG. 7) to exit the hot duct discharge 1560 and begin mixing with the kiln return air conveyed in the combined return duct 2420 before entry into the air blending chamber 1538 and eventual entry into the inlet of the recirculation blower 1542.

FIG. 10 includes a cross section of a delay table 2470 within the dispersion chamber 2440 including cross sections of two of the four legs 2474 that support the delay table 2470 to receive the output of burner output gas exiting the hot duct 1560 into the vertically integrated dual return assembly 2400. The downward flow of kiln return air from combined return duct 2420 tends to push the output from the hot duct 1560 downward. The delay table 2470 changes the flow path of this burner output gas from hot duct 1560 by delaying the fall of the stream of burner output gas from hot duct 1560. The delay table 2470 promotes better mixing of the hotter, less dense burner output gas from hot duct 1560 with the cooler, denser kiln return air from combined return duct 2420.

Another Design.

Figure 11:
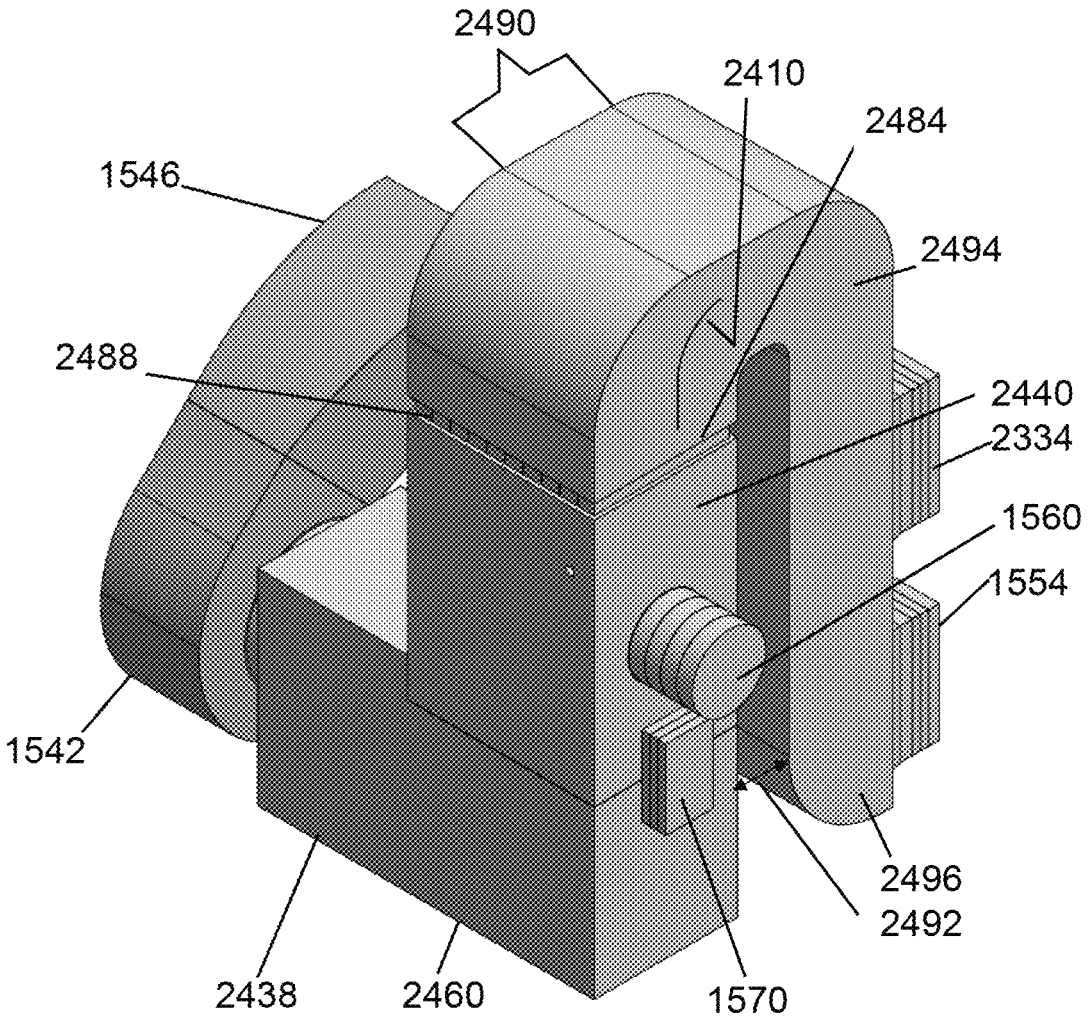
FIG. 11 provides a top, front side, and burner side perspective view of another design for the vertically integrated dual return assembly.

FIG. 11 provides a top, front side, and burner side perspective view of another design for the vertically integrated dual return assembly 2480. While this design for the vertically integrated dual return assembly 2480 shares many characteristics with the design shown in FIG. 9 and FIG. 10, there are a number of differences.

Figure 12:
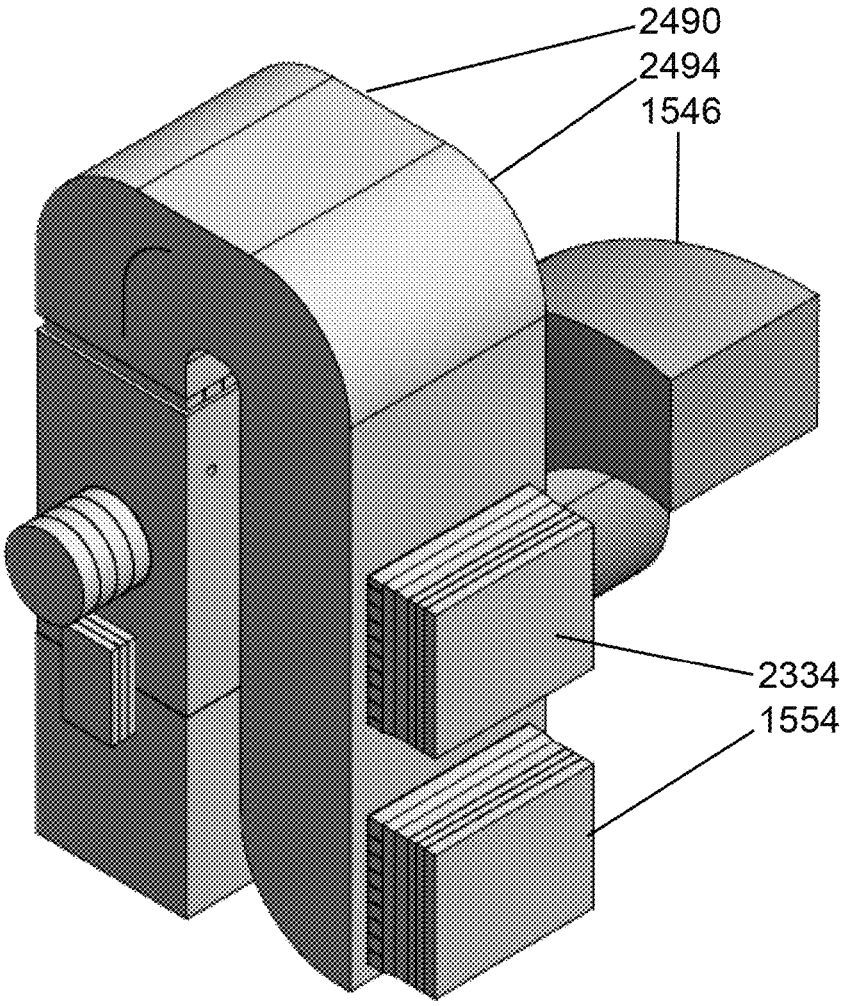
FIG. 12 provides a top, kiln side, and burner side perspective view of the vertically integrated dual return assembly from FIG. 11.

One difference is that a preferred arrangement for the heat modulating damper 2484 is to have the vanes 2488 running from kiln side (with reverse return duct 2334 and forward return duct 1554) to front side as shown in FIG. 11, and FIG. 12. In contrast, the vertically integrated dual return assembly 2400 shown in FIG. 9 and FIG. 10 has a heat modulating damper 2436 with vanes 2446 oriented to blower side to burner side.

Placing the heat modulating damper 2484 of vertically integrated dual return assembly 2480 with a vane orientation of kiln side to front side avoids having the vanes direct the kiln return air to either the kiln side or the burner side of the integrated dual return assembly 2480.

Notice that FIG. 11 shows a combined return air duct 2494 with an extended horizontal run 2490 at the top of the vertically integrated dual return assembly 2480. The extended horizontal run 2490 reduces pressure drops and provides a more favorable air flow pattern of the return air from the kiln entering into the dispersion chamber 2440. For a sense of scale, the gap 2492 between upward portion 2496 and the dispersion chamber may in excess of three feet.

Also visible in FIG. 11 is an indication of the presence of the turning vane 2410 which would not be visible here but for the addition of the indication. Other elements visible in FIG. 11 include hot duct 1560, fresh air damper 1570, extended air blending chamber 2460, air blending chamber 2438, recirculation blower 1542 and supply duct 1546.

FIG. 12 provides a top, kiln side, and burner side perspective view of the vertically integrated dual return assembly from FIG. 11. FIG. 12 does not introduce any new components and has been marked to show a few components for the sole purpose of providing orientation for the viewer.

Figure 13:
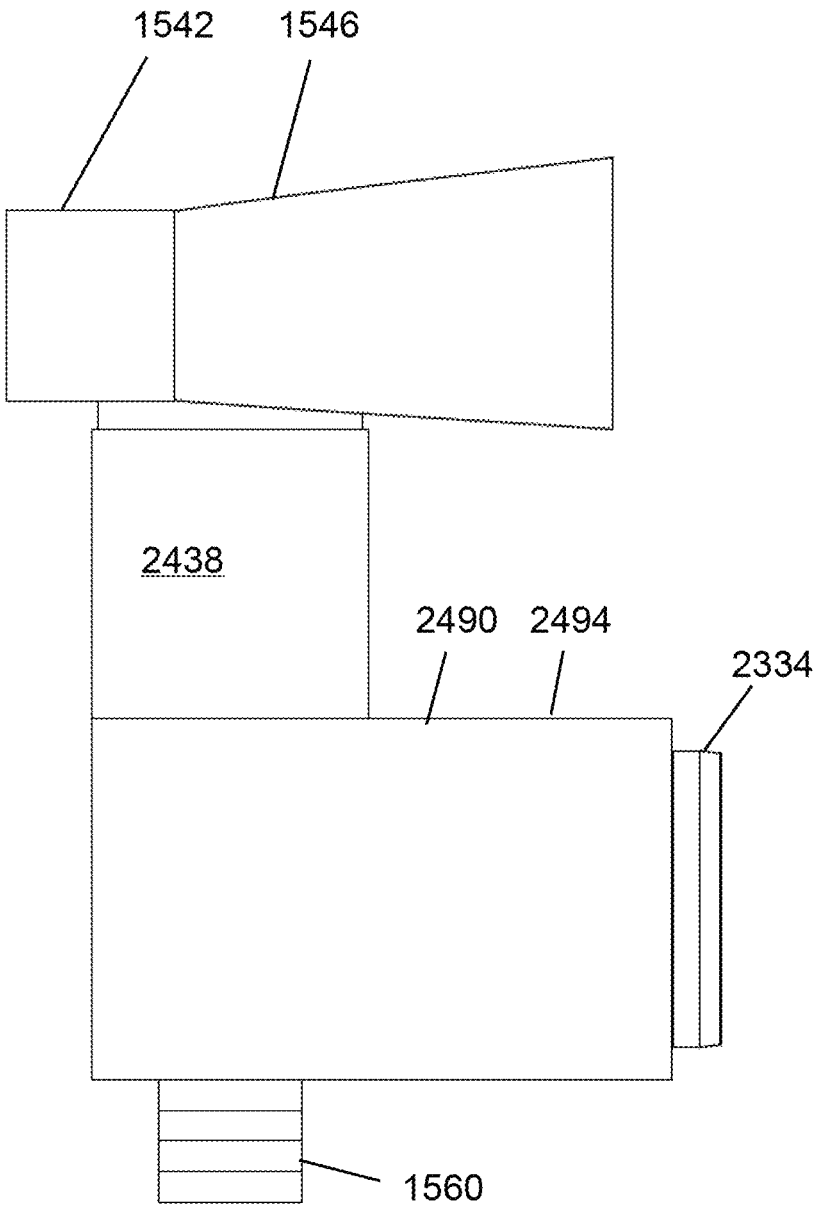
FIG. 13 provides of top plan view of the vertically integrated dual return assembly from FIG. 11.

FIG. 13 provides of top plan view of the vertically integrated dual return assembly 2480 from FIG. 11. FIG. 13 augments the disclosure of FIG. 11 but does not introduce any new elements.

Figure 14:
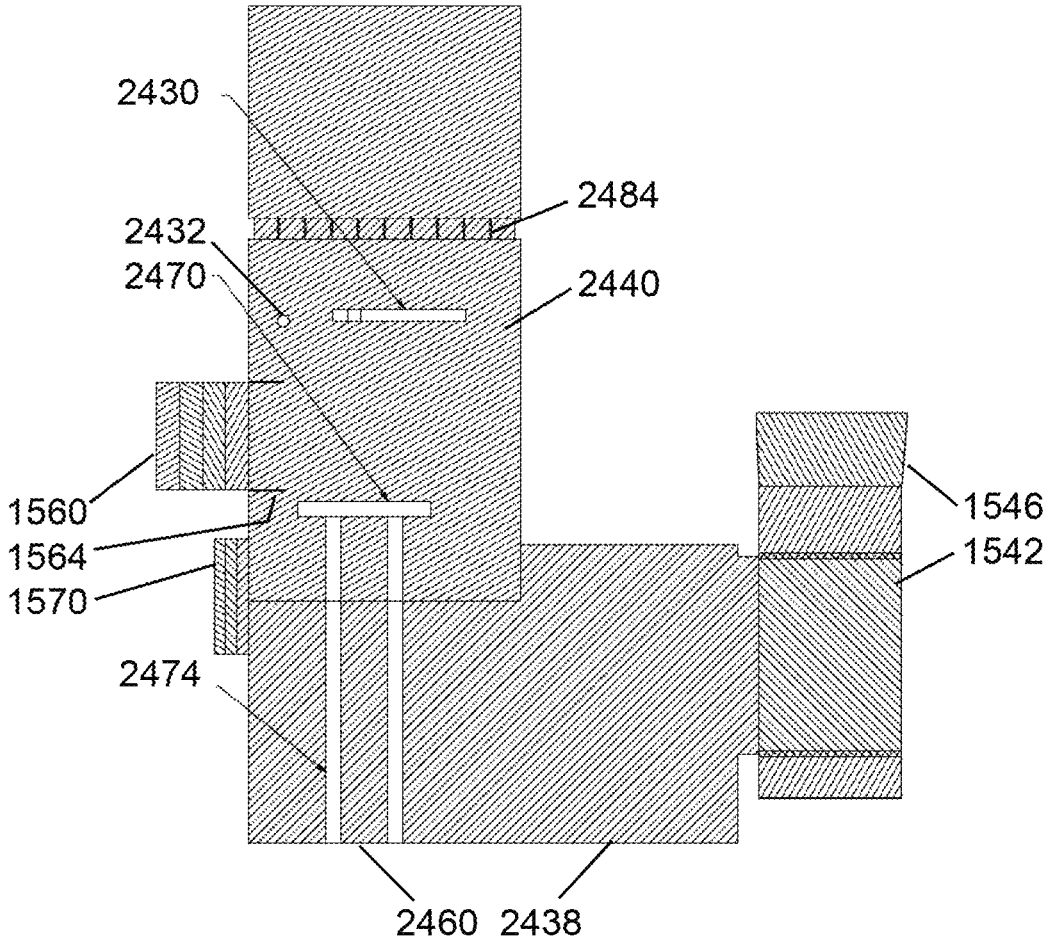
FIG. 14 is a kiln-side view of a cross section of the vertically integrated dual return assembly from FIG. 11.

FIG. 14 is a kiln side view of a cross section of the vertically integrated dual return assembly 2480 from FIG. 11. The cross section is taken vertically through the middle of the hot duct 1560 and fresh air damper 1570. Visible in this cross section are a number of components previously introduced including heat modulating damper 2436, dispersion chamber 2440, air blending chamber 2438, extended air blending chamber 2460, recirculation blower 1542, supply duct 1546, and fresh air damper 1570

Also visible in FIG. 14 are delay table 2470 supported by a set of legs 2474. The delay table 2470 receives the output from the direct fired burner 1534 (not shown here). The output from the direct fired burner 1534 passes through the hot duct 1560 and hot duct extension 1564 where the incoming heated air intersects with the much cooler air returning from the kiln that passes through the heat modulating damper 2436. The delay table 2470 delays the downward movement of the output from the hot duct 1560 as illustrated in the outputs from flow models discussed below.

The cross section of the isolation damper 2430 does not show the connection of the isolation damper 2430 with pin 2432 which is the axis of rotation for the isolation damper 2430. The isolation damper 2430 can move from the open position shown here to a closed position that caps the hot duct extension 1564 to isolate the burner from the vertically integrated dual return assembly 2480.

An optional horizontal plate (not shown here) may be permanently located above the location of the isolation damper 2430 for the burner outlet when the isolation damper 2430 is in the horizontal open position. This horizontal plate may be useful in prolonging the useful life of the isolation damper 2430 as it will reduce the vibration imposed upon the isolation damper by the downward flow of the kiln return air from the heat modulating damper 2436.

Additional Improvements.

Figure 15:
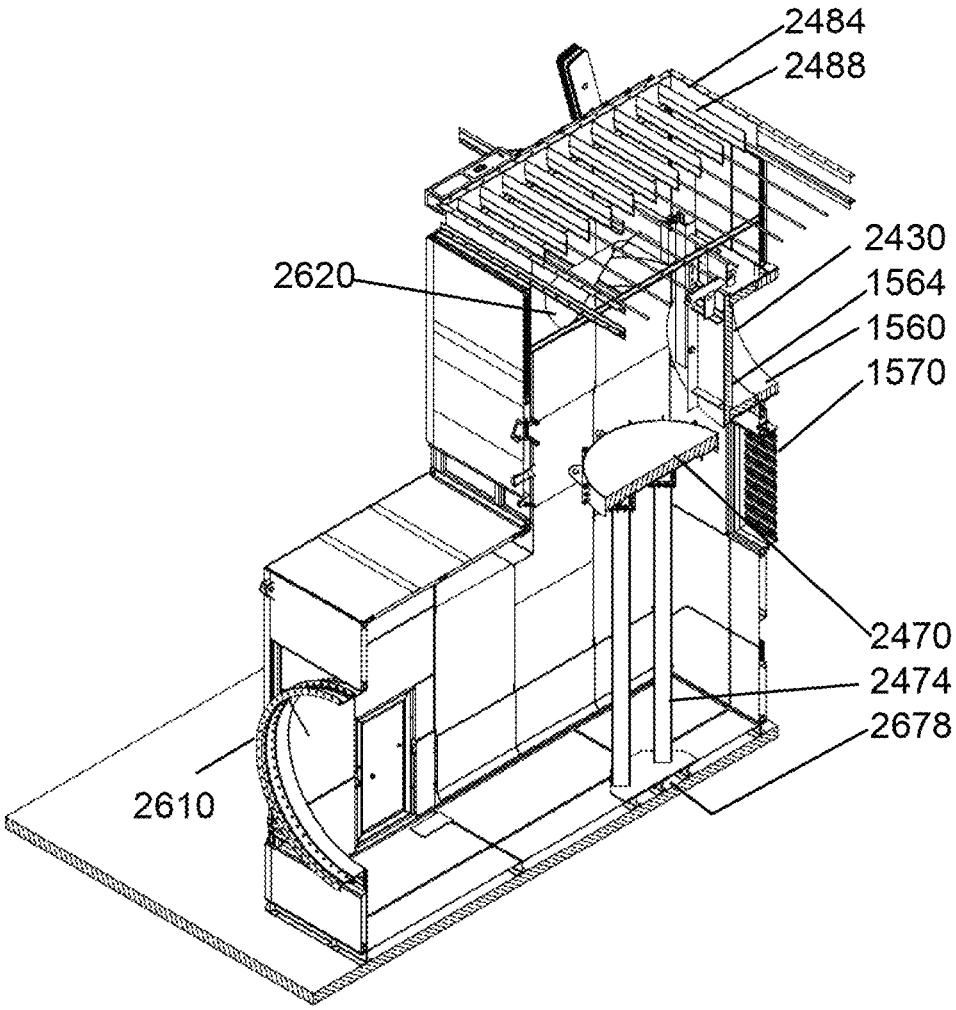
FIG. 15 is a perspective view looking at the top and fan side of the vertically integrated dual return assembly 2600 from the kiln side.
Figure 16:
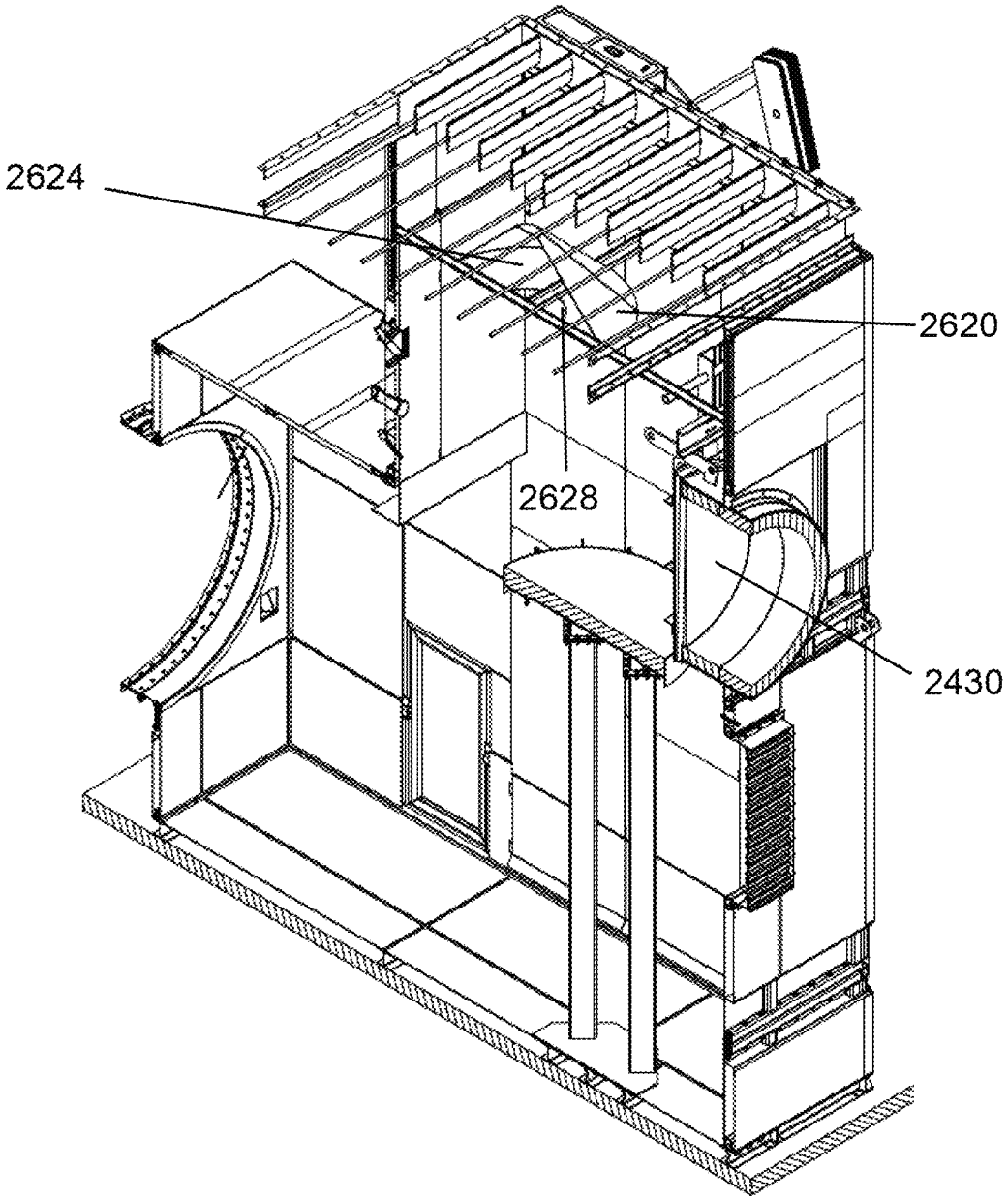
FIG. 16 shows the same cross section of vertically integrated dual return assembly introduced in FIG. 15 but rotated to be viewed from the top, kiln, and burner side rather than the top, kiln, and blower side.
Figure 17:
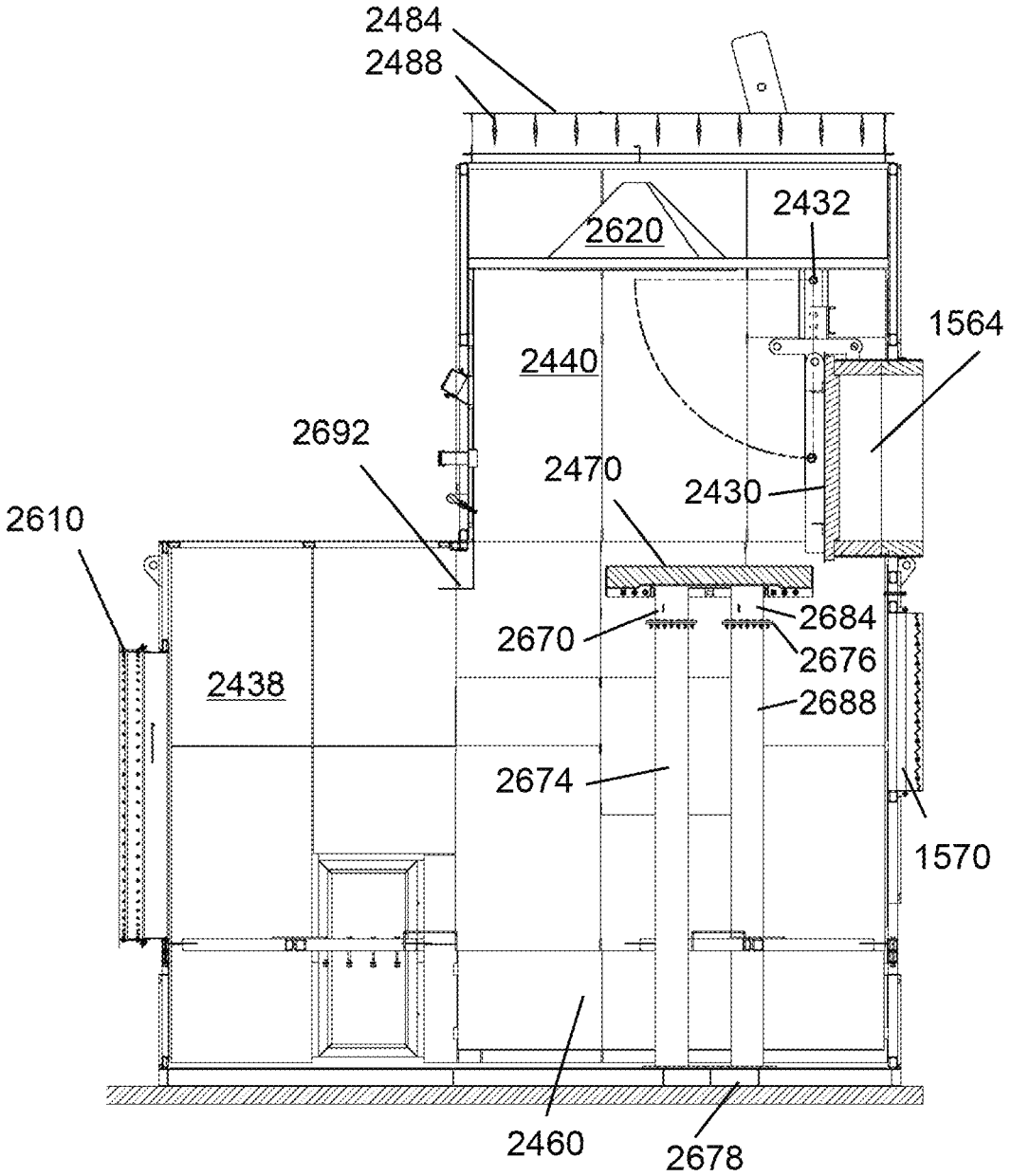
FIG. 17 is the same cross section from FIG. 15 and FIG. 16 but providing a kiln-side view.

FIG. 15, FIG. 16 and FIG. 17 introduce a third iteration of a vertically integrated dual return assembly 2600 builds upon features in vertically integrated dual return assembly 2480 in FIG. 11, FIG. 12, FIG. 13, and FIG. 14. FIG. 15 is a perspective view looking at the top and fan side of the vertically integrated dual return assembly 2600 from the kiln side.

FIG. 15 ends with the mixing chamber outlet 2610 and does not show the recirculation blower 1542 discussed elsewhere. The delay table 2470 is positioned below the bottom of the hot duct extension 1564 of the hot duct 1560 and above the top of the fresh air damper 1570. As noted above, the in-leakage from a closed fresh air damper is about 5% of the full flow of the fresh air damper and the fresh air flows below the delay table 2470. The legs 2674 have been modified to have a flow of fresh air to cool the legs 2674. The fresh air travels through cooling air inlet 2678 into the base of the legs 2674 and flows up through the legs 2674 to exit below the delay table 2470.

The legs 2674 may be round in cross section or square as shown here. The table legs 2674 may be oriented with a corner facing the oncoming air flow from the fresh air damper 1570.

A cone 2620 is maintained by cross bars to be above the isolation damper 2430 when the isolation damper 2430 is in the horizontal open position. To allow for clear views of other components not previously introduced, the isolation damper 2430 is shown in the closed vertical position covering the hot duct extension 1564. The use of an isolation damper 2430 is known in the art and not central to the understanding of the present disclosure beyond the placement of the cone 2620 to divert the return air coming from the heat modulating damper 2484. More specifically, the return air comes from the kiln 100, then up the upward portion 2496 (FIG. 11) of the duct, across the horizontal run 2490 (FIG. 11), downward with the help of turning vane 2410 (FIG. 11), and through the heat modulating damper 2484 between vanes 2488. FIG. 15 has been modified to cut away portions of the vanes 2488 to allow a better view of cone 2620.

FIG. 16 shows the same cross section of vertically integrated dual return assembly 2600 introduced in FIG. 15 but rotated to be viewed from the top, kiln, and burner side rather than the top, kiln, and blower side. Isolation damper 2430 is again shown in the vertical closed position. Additional details of cone 2620 are visible from this view, including cone bottom 2624 and opening 2628 in cone bottom 2624. The opening 2628 in the cone bottom 2624 is provided to facilitate installation by allowing access to the interior of the cone 2620 and is not central to the air flow modifications provided by the present disclosure.

One of skill in the art will recognize that the cone 2620 is perhaps better characterized as a cone shaped protector. The cone shaped protector does not have to have a pointy apex as one would find in a cone defined in a geometry textbook. The top can be flat to make the shape technically frusto-conical as the top flat face would be considered a frustum. The cone shaped protector could be at least partially rounded to resemble a hemisphere. The base of the cone shaped protector would not have to be a pure circle but could be an ellipse, or an octagon or some other multisided geometric shape having at least five sides that approximates a circle.

FIG. 17 is the same cross section of vertically integrated dual return assembly 2600 from FIG. 15 and FIG. 16 but providing a kiln-side view. For purpose of orientation, FIG. 17 notes mixing chamber outlet 2610 and fresh air damper 1570. As evident from FIG. 17, rotating isolation damper 2430 around center of rotation running through pin 2432 would place the isolation damper 2430 under the protection of the cone 2620. Return air from kiln 100 would come through the heat modulating damper 2484 with a set of vanes 2488, go around the cone 2620 and the open isolation damper 2430 before engaging with the burner output coming in through the hot duct extension 1564.

The mixing of the return air flow from the kiln 100 and the burner output would start in the dispersion chamber 2440 above the top of the delay table 2470. Note that the top of the delay table 2470 is above the lower projection 2692 of the dispersion chamber 2440. Lower projection 2692 is actually part of a heat shield that allows cooler air from the top of the dispersion chamber 2440 to get behind the heat shield and travel downwards towards the top of the blending chamber 2438.

Note that as the top surface of the delay table 2470 is above the lower projection 2692 of the dispersion chamber 2440, the top surface of the delay table 2470 is too high up for burner output to move purely laterally from the top surface of the delay table 2470 directly into the air blending chamber 2438 and then downward into the mixing chamber outlet 2610. It is extremely important that there is not an easy path between the top of the delay table 2470 and the mixing chamber outlet 2610 as the lack of an easy path produces the conditions necessary for the breakup of the intense heat within the burner output. Allowing the burner output from the hot duct 1560 to reach the mixing chamber outlet 2610 without mixing with the significantly cooler air returning from the kiln would be a problem as the output from the burner output from the hot duct 1560 may be in the range of 2000 degrees Fahrenheit which is much too hot for contact with the recirculation blower 1542.

Instead the burner output from the hot duct extension 1564 is pushed downward and outward from the center of the delay table 2470 by the more massive, cooler, denser, kiln return air coming though the heat modulating damper 2484. It is useful to note that the mass of return air coming from the heat modulating damper 2484 is many times the mass of the relatively smaller amount of burner output at about 2000 degrees Fahrenheit coming from the hot duct 1560 to warm the return kiln air from a temperature of about 220 degrees Fahrenheit to a mixing chamber outlet temperature of around 500 degrees Fahrenheit.

As the heated air pours off the perimeter of the delay table 2470, the heated air strikes cool air from the in-leakage of the fresh air damper 1570. Mixing of the three air flows continue as the upper two flows move downward and towards the mixing chamber outlet 2610 while traversing the extended air blending chamber 2460 and the air blending chamber 2438.

FIG. 17 includes flange joint 2676 that allows the delay table 2470 to be manufactured connected to upper leg portions 2684 which are joined in the field to lower leg portions 2688 at flange joint. This arrangement is not a requirement of the teachings of the disclosure but can be useful given the size and weight of these components.

FIG. 17 includes cooling air discharge ports 2670. Given that the recirculation blower 1542 will be pulling suction on the interior of vertically integrated dual return assembly 2600, relatively small openings will allow for the movement of cooling air up through the legs 2474 and out cooling air discharge ports 2670. While the legs may be made from stainless steel or some other material that can withstand prolonged exposure to burner output, it may be reassuring to designers to add this cooling air.

Establishing the Improved Design is an Improvement.

A first way to look for evidence of improvement is to model the air flow velocities in the air balancing chamber. Ideally, the flow profiles are similar when the kiln is run in the forward air flow and reverse air flow directions.

The prior art design shown for a dual return as discussed above (See FIG. 4, FIG. 5 and FIG. 6). While the prior art design worked well for a given size of burner and recirculation blower, models of performance of a kiln using a larger burner and larger recirculation blower indicated that there would be problems with continued use of the prior art design. The use of the prior art design with the scaled up burner and recirculation blower resulted in modeled air flows that differed greatly from the forward flow and reverse flow operation.

In order to illustrate this concept, U.S. Provisional Application No. 62/449,527 filed on Jan. 23, 2017 with title Vertically Integrated Dual Return Assembly made extended use of color coded model outputs to indicate visually the areas for the highest flow or the highest temperatures. In order to keep to the preferred format for a non-provisional application, this type of data is now being conveyed by black and white graphs with isolines showing the contours of areas with similar flow rates or temperatures.

Unless otherwise indicated, the legends for interpreting these graphs are as follows:

| Velocity Graphs Repeating Isoline Pattern | Indicates Flow rates in Feet/Minute |
|---|---|
| __. (Dash, dot) | 4000-5000 |
| __.. (Dash, dot, dot) | 3000-4000 |
| __... (Dash, dot, dot, dot) | 2000-3000 |
| __ __. (Dash, Dash, dot) | 1000-2000 |
| __ __.. (Dash, Dash, dot, dot) | 0-1000 |

| Temperature Graphs Repeating Isoline Pattern | Indicates Temperatures in Degrees Fahrenheit |
|---|---|
| __. (Dash, dot) | 2000-1700 |
| __.. (Dash, dot, dot) | 1700-1400 |
| __... (Dash, dot, dot, dot) | 1400-1100 |
| __ __. (Dash, Dash, dot) | 1100-800 |
| __ __.. (Dash, Dash, dot, dot) | 800-500 |
| __ __... (Dash, Dash, dot, dot, dot) | 500-200 |

Temperature Results for Model of Prior Art Solution.

Figures 18, 19, 20:
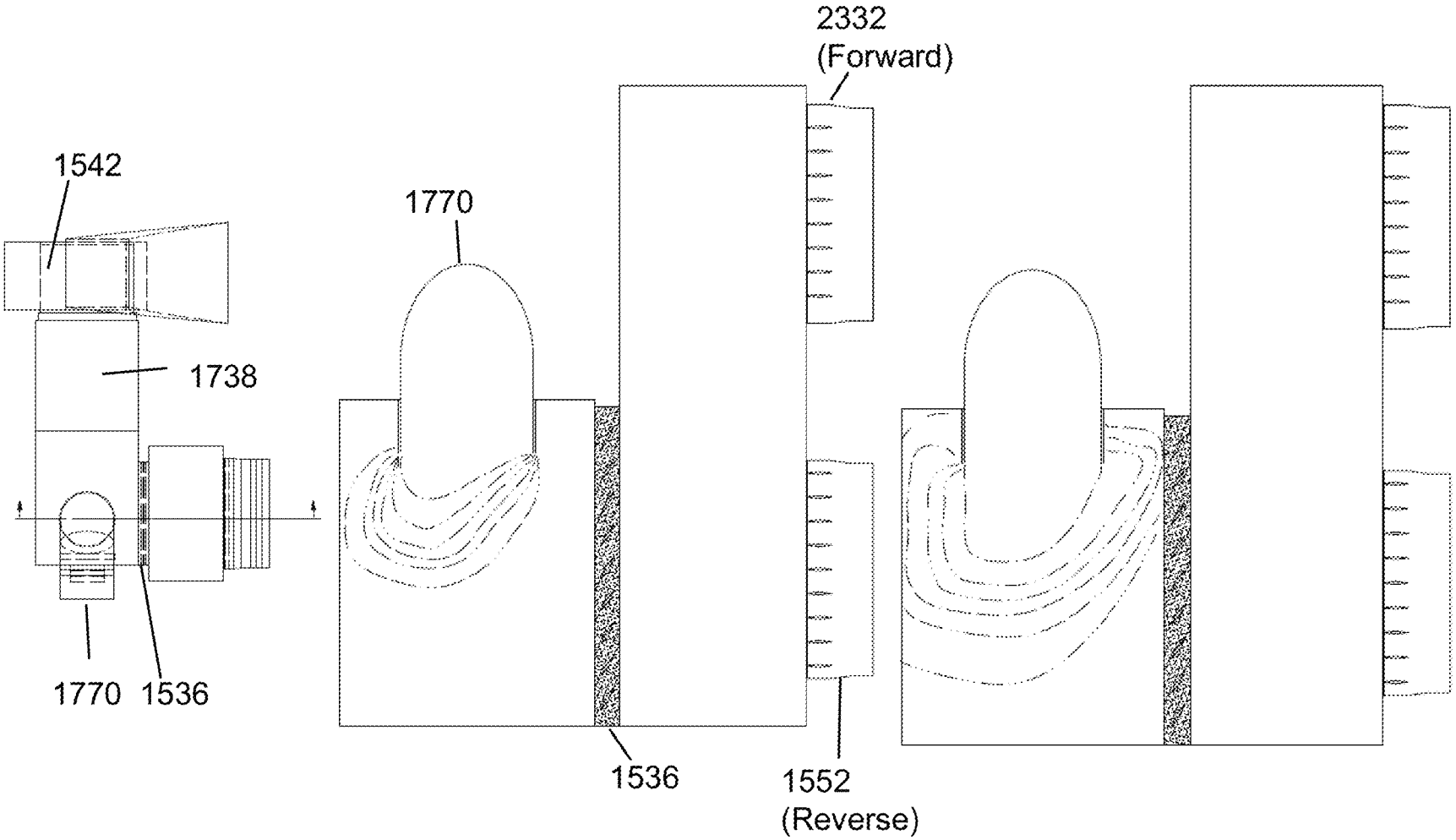
FIG. 18 to FIG. 35 are a series of triplet sets of drawings. The first figure in each triplet set indicates the location of the cross section view, the second figure shows model results for temperature profiles while the bidirectional fans in the kiln are operated to produce forward flow and the third figure shows the same cross section with the temperature profile for the model predictions when the bidirectional fan is operated in the reverse flow direction. These figures illustrate the substantial differences in temperature profiles when the system is operated in the reverse direction compared with operation in the forward direction.

Moving to the first triplet of figures, FIG. 18 provides a top view of air blending chamber 1738 with an outlet feeding a recirculation blower 1542. Hot duct 1770 conveys the output of a direct fired burner 1534 (not shown here). As better seen in side view drawings, the hot duct 1770 enters the mixing chamber horizontally and then has two 45 degree turns to result in discharge of the heated air vertically downward into the air blending chamber 1738.

FIG. 19 shows predicted temperatures for the flow model when the bidirectional fans 200 are operated in the forward flow direction. As discussed in connection with FIG. 4 and FIG. 6, return air from the kiln 100 comes via forward return duct opening 1550 (FIG. 4) past damper 1552 and heat modulating damper 1536 into the air blending chamber.

Figure 5:
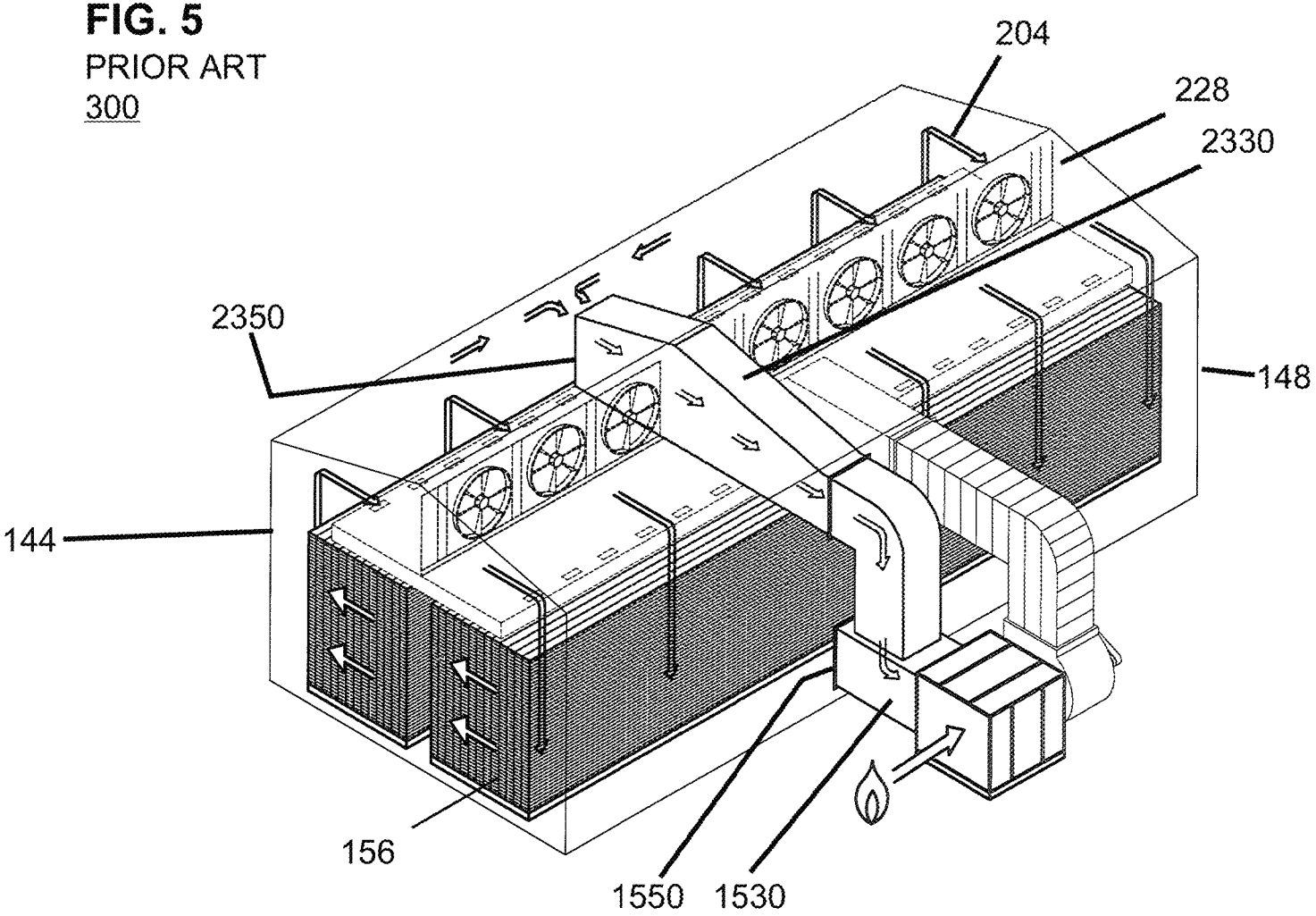
FIG. 5 PRIOR ART
FIG. 5 shows a prior art main drying section with an internal second return duct as operated with reverse air flow.

FIG. 20 shows the predicted temperatures for the flow model when the bidirectional fans 200 are operated in the reverse flow direction as shown in FIG. 5. As discussed in connection with FIG. 5 and FIG. 6, return air from the kiln 100 comes via opening 2350 past damper 2332 and heat modulating damper 1536 into the air blending chamber.

Figure 6:
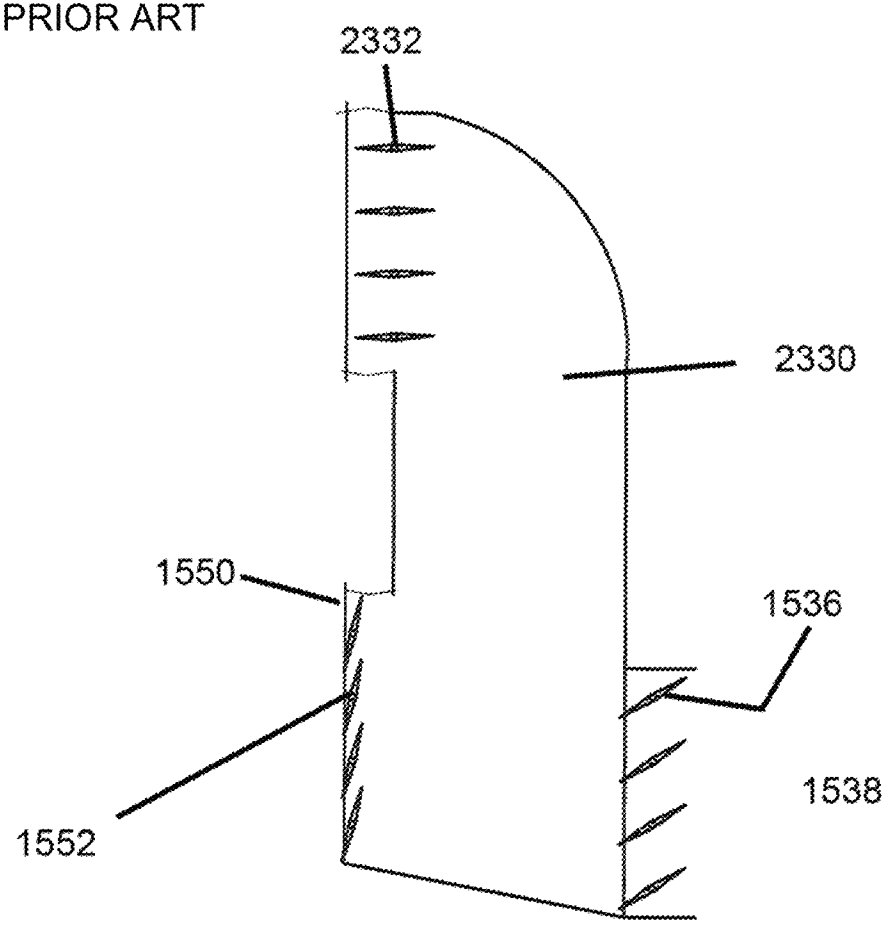
FIG. 6 PRIOR ART
FIG. 6 shows one damper arrangement.

As discussed in connection with FIG. 6, normal operation would have either damper 2332 open or damper 1552 open. The flow model did not use damper position to regulate flow but simply added or subtracted a solid surface to change from forward flow operation of bidirectional fans 200 to receive return air through damper 1552 or to change to reverse flow operation of bidirectional fans 200 through damper 2332.

As evident in a comparison of FIG. 19 and FIG. 20, the temperature profiles are not similar. This pattern will be repeated for the flow estimates and temperature estimates at various locations in the air blending chamber 1738 based upon the flow model of this prior art layout. Of interest is comparing similar triplets of figures of location, forward flow operation, and reverse flow operation from a flow model based upon a vertically integrated dual return assembly 2600 created in accordance with teachings from the present disclosure.

Figure 23:
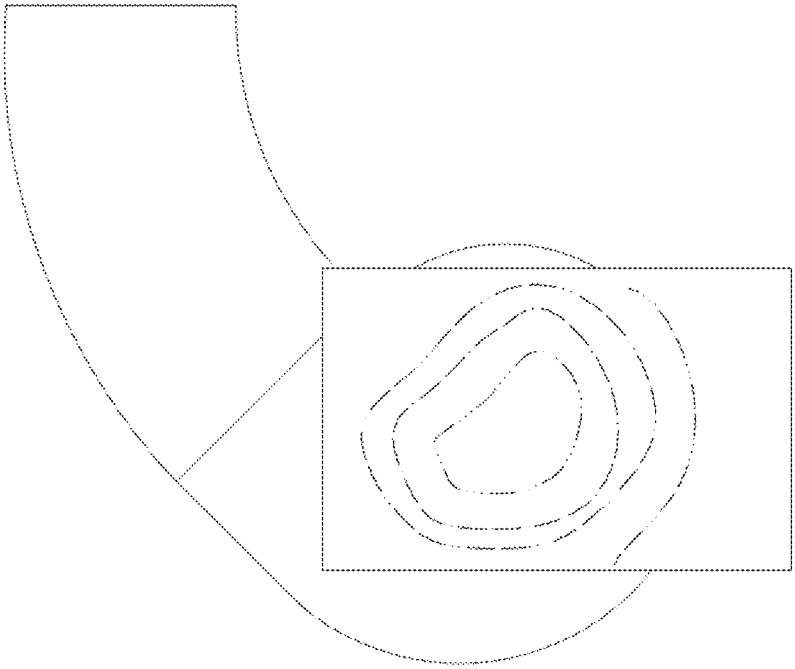
Figure 22:
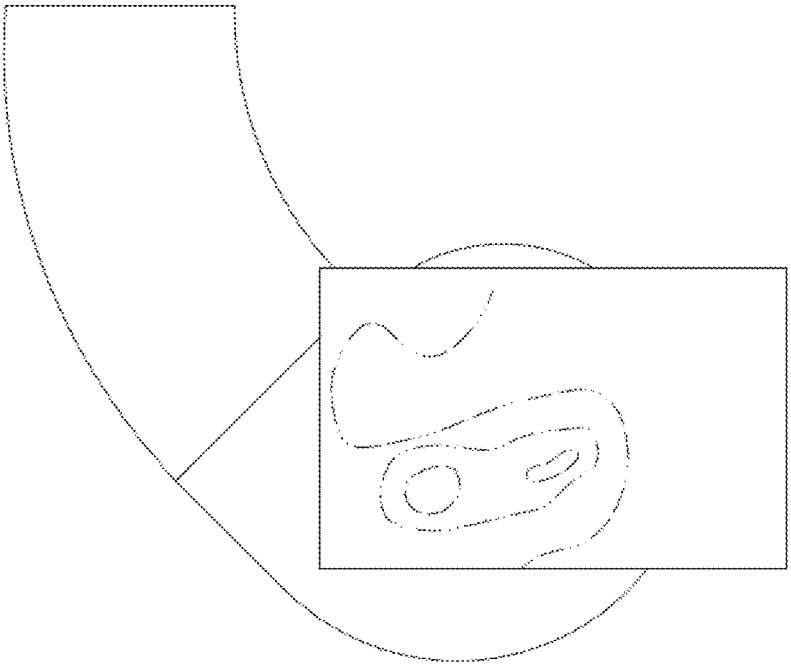
Figure 21:
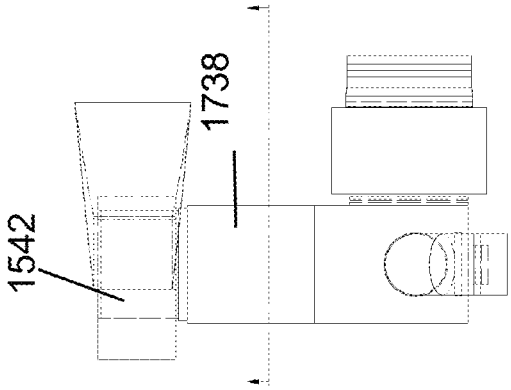

Likewise, the triplet of figures FIG. 21, FIG. 22, and FIG. 23 shows significant differences in temperature profiles between forward flow and reverse flow operation. As indicated by FIG. 21, this view is within air blending chamber 1738 looking towards the recirculation blower 1542.

Figure 26:
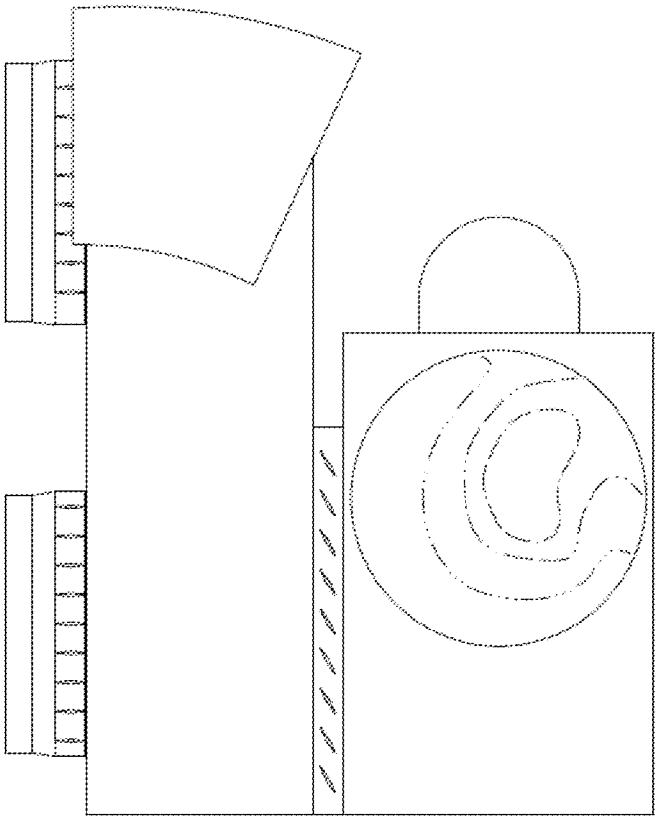
Figure 25:
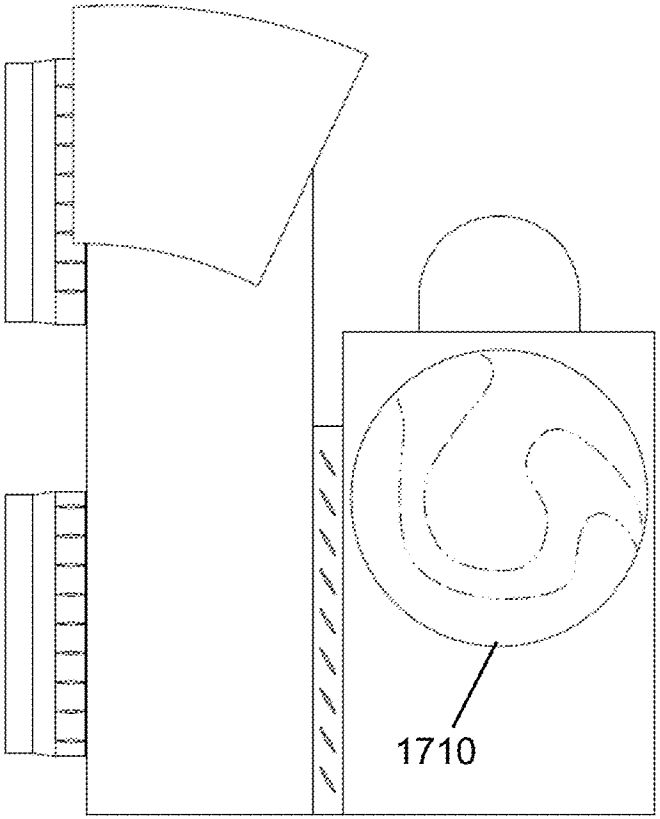
Figure 24:
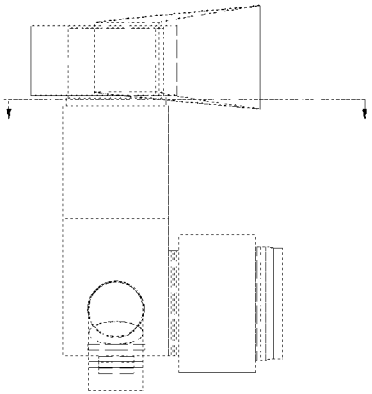

FIG. 24 indicates a view looking back through the mixing chamber outlet 1710. The triplet of figures: FIG. 24, FIG. 25, and FIG. 26 shows significant differences in temperature profiles between forward flow and reverse flow operation.

Figure 29:
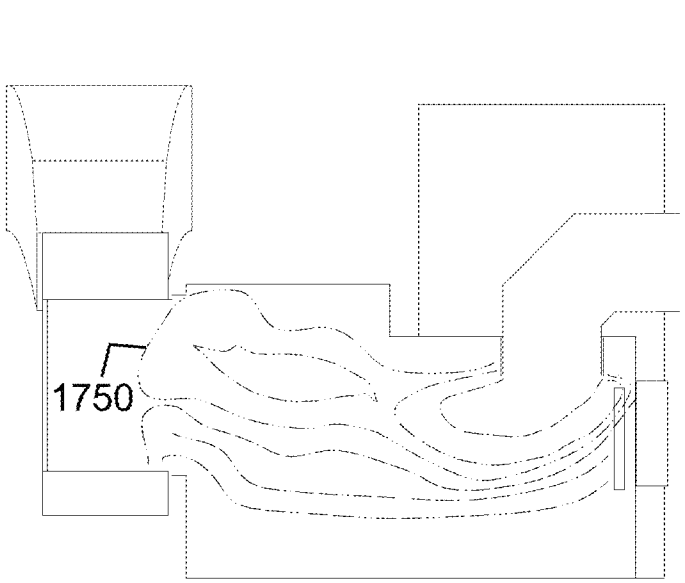
Figure 28:
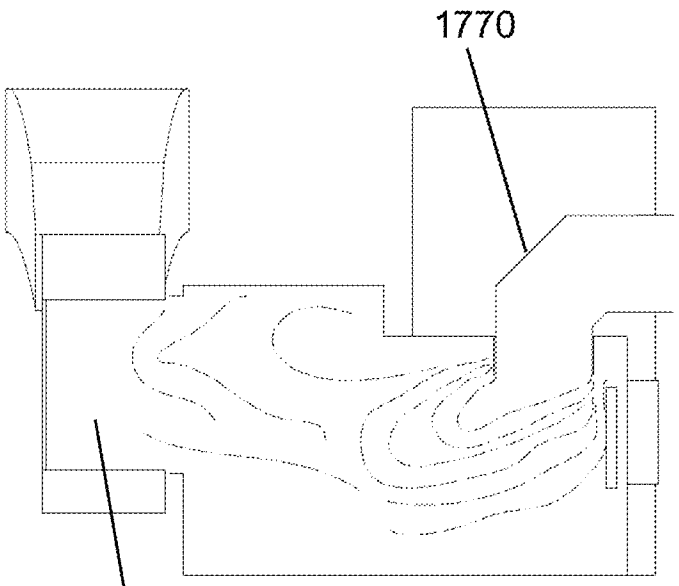
Figure 27:
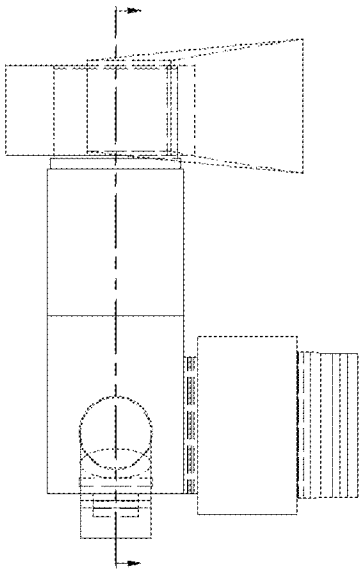

FIG. 27 indicates that the view will be towards the kiln. Visible in FIG. 28 are hot duct 1770 with the two 45 degree turns and the enclosure for recirculation blower 1542. The triplet of figures: FIG. 27, FIG. 28, and FIG. 29 shows significant differences in temperature profiles between forward flow operation and reverse flow operation. Note the elevated temperature level at location 1750 within the enclosure for recirculation blower 1542 as this isoline indicates a model temperature of 1100 to 1400 degrees Fahrenheit. As noted above, some recirculation blowers 1542 may have a rating for extended exposure of 600 degrees Fahrenheit and may not last as long if portions are exposed to prolonged exposure of temperatures well above that rating.

Figure 32:
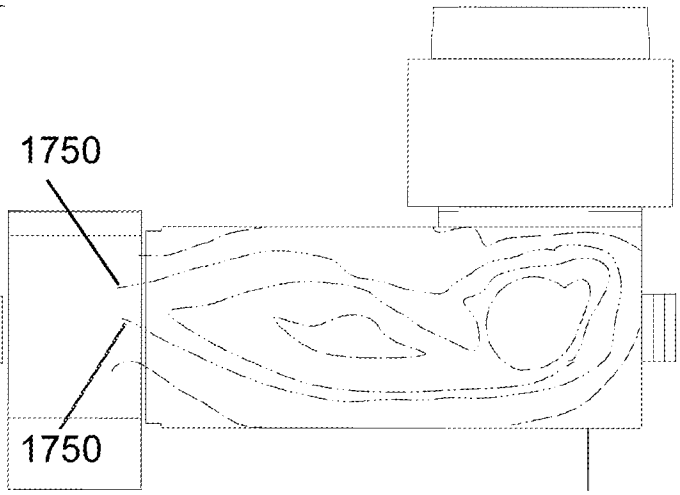
Figure 31:
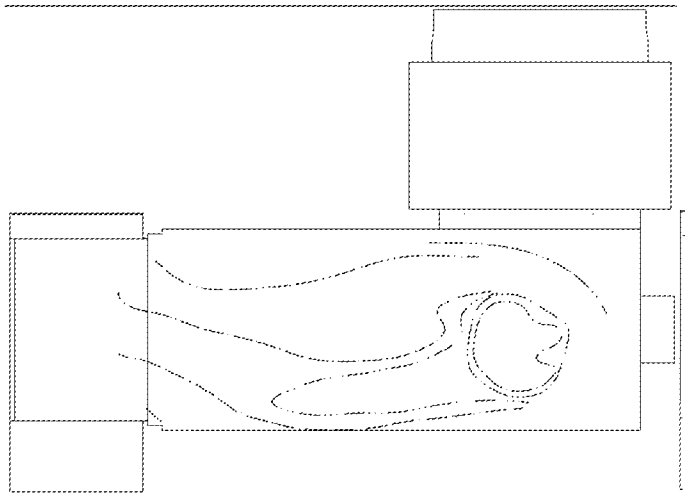
Figure 30:
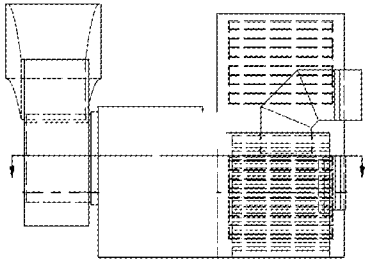

The triplet of figures: FIG. 30, FIG. 31, and FIG. 32 is consistent with the triplet of figures: FIG. 27, FIG. 28, and FIG. 29. Note again, the elevated temperature level at location 1750 within the enclosure for recirculation blower 1542 as this isoline indicates a model temperature of 1100 to 1400 degrees Fahrenheit.

Figure 35:
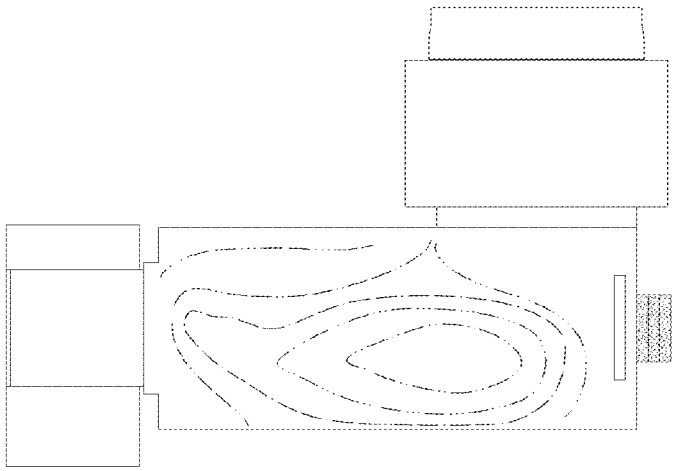
Figure 34:
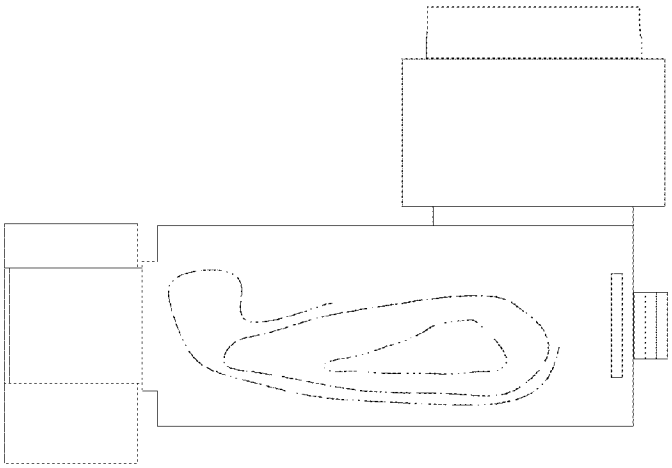
Figure 33:
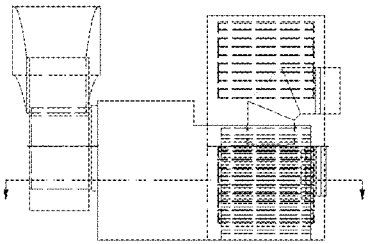

The triplet of figures: FIG. 33, FIG. 34, and FIG. 35 again shows significant differences in temperature profiles between forward flow operation and reverse flow operation.

Flow Velocity Results for Model of Prior Art Solution.

Figure 38:
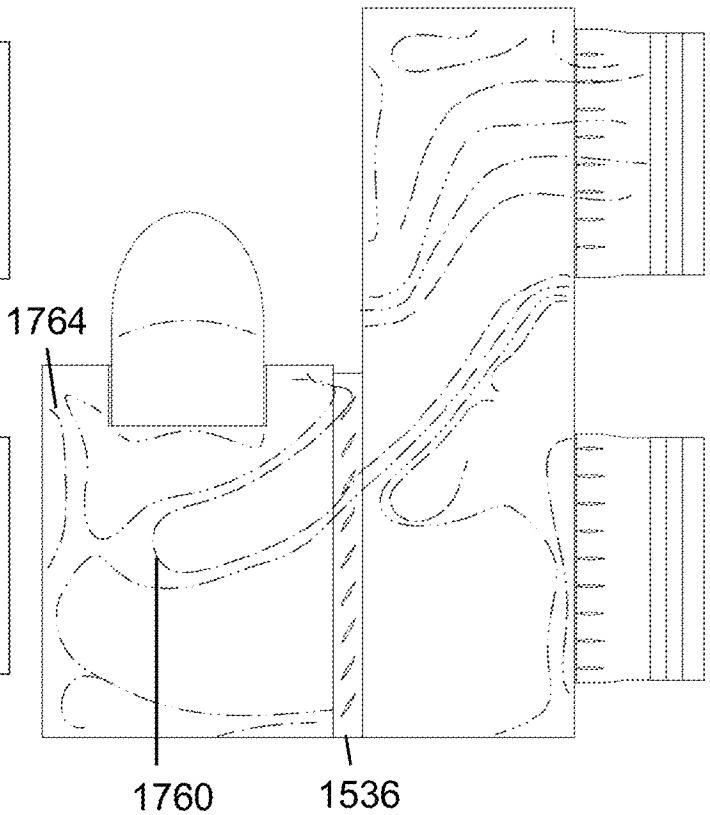
FIG. 36 to FIG. 50 are a series of triplet sets of drawings. The first drawing in the triplet set indicates the location of the cross section view, the second figure shows model results for flow velocity profiles while the bidirectional fans in the kiln are operated to produce forward flow and the third figure shows the same cross section with the flow velocity profile for the model predictions when the bidirectional fan is operated in the reverse flow direction. The results of FIG. 36 to FIG. 50 are from the same model used for FIG. 18 to FIG. 35. These triplet sets of figures illustrate the substantial differences in flow velocity profiles when the system is operated in the reverse direction compared with operation in the forward direction.
Figure 37:
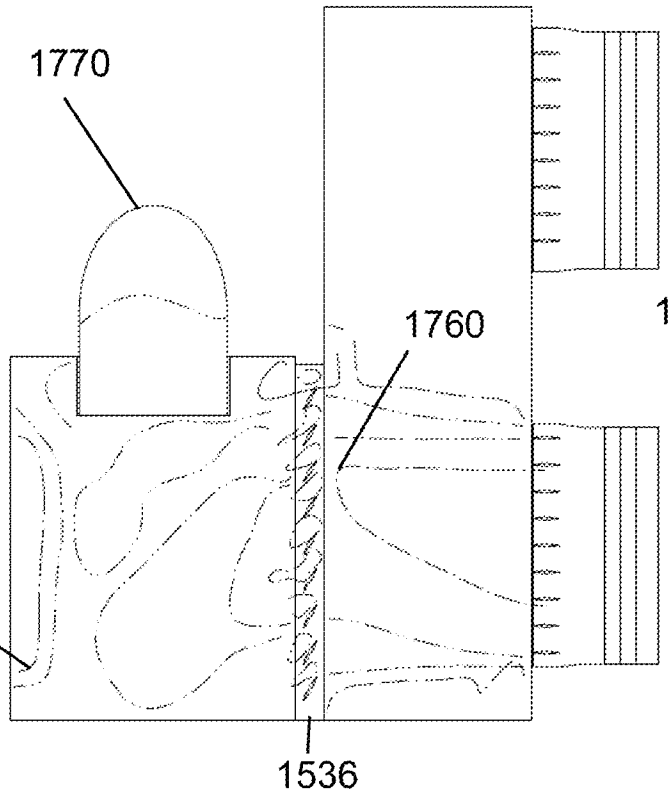
Figure 36:
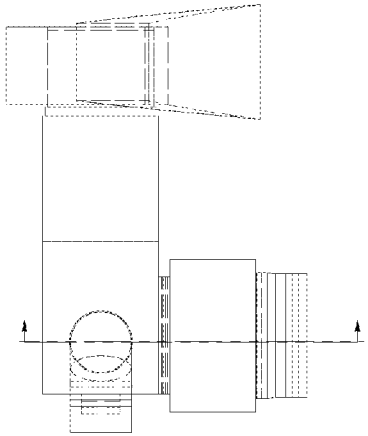

FIG. 36, FIG. 37, and FIG. 38 are the first triplet set of figures showing the modeled flow velocities. Again there are significant differences between the model results when the bidirectional fans are operated in the forward flow direction versus the reverse flow direction. Notice the leading edge of high velocity air between 4000 and 5000 feet per minute (Dash, dot repeating pattern) 1760 in FIG. 38 extends well beyond) heat modulating damper 1536. Note that in both FIG. 37 and FIG. 38 there is a surprising high rate of movement (4000 to 5000 feet per minute) along the far wall as indicated by element number 1764. Movement of this sheet of air along the wall does not assist in mixing of the heated output from the burner coming through hot duct 1770 and the cooler air returning from the kiln through heat modulating damper 1536.

Figure 41:
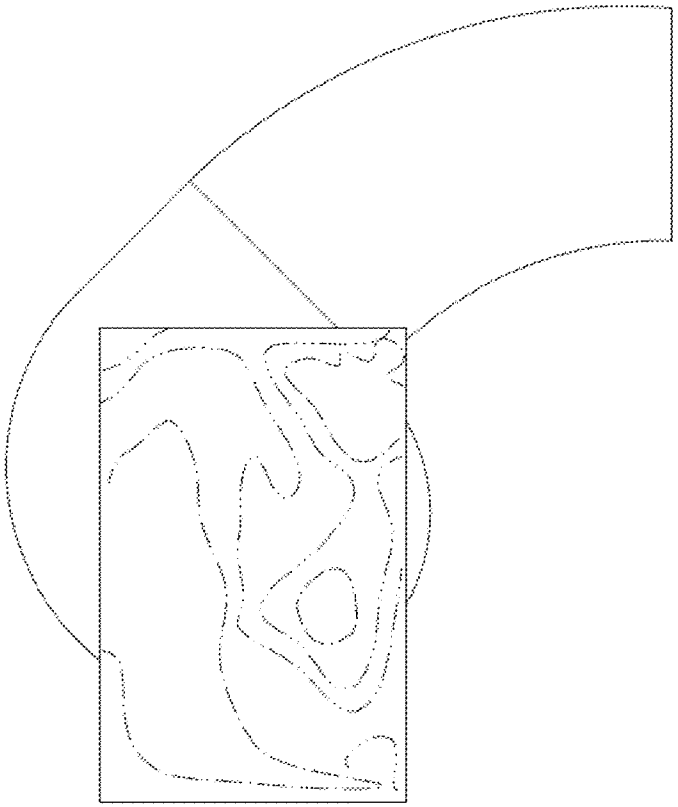
Figure 40:
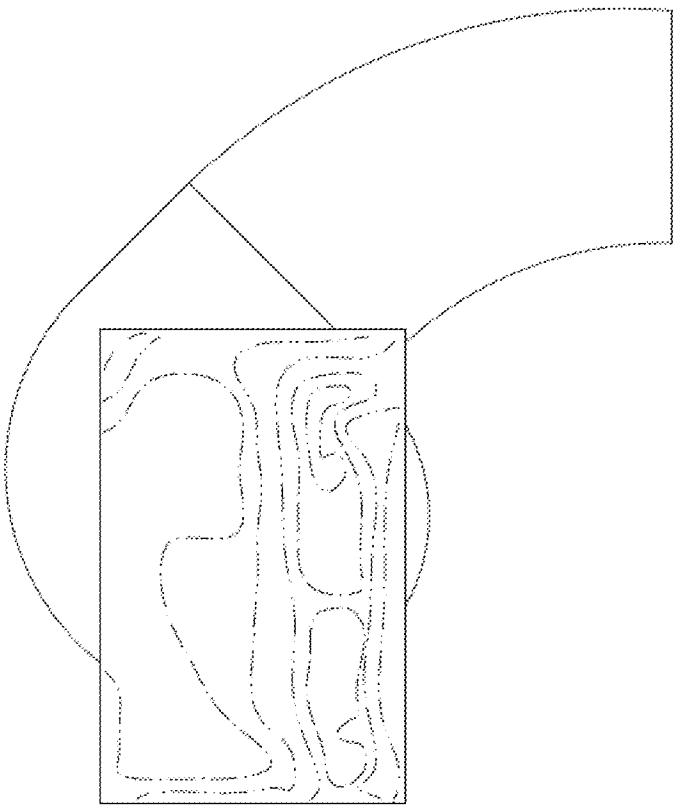
Figure 39:
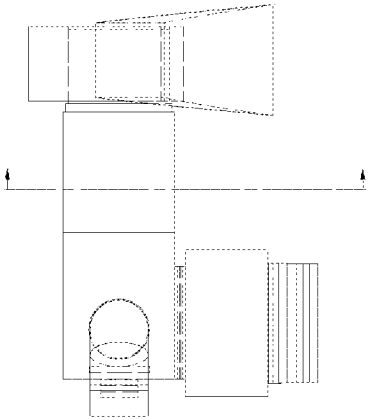

FIG. 39, FIG. 40, and FIG. 41 are the next triplet set of figures showing the modeled flow velocities. Again there are significant differences between the model results when the bidirectional fans are operated in the forward flow direction versus the reverse flow direction.

Figures 42, 43, 44:
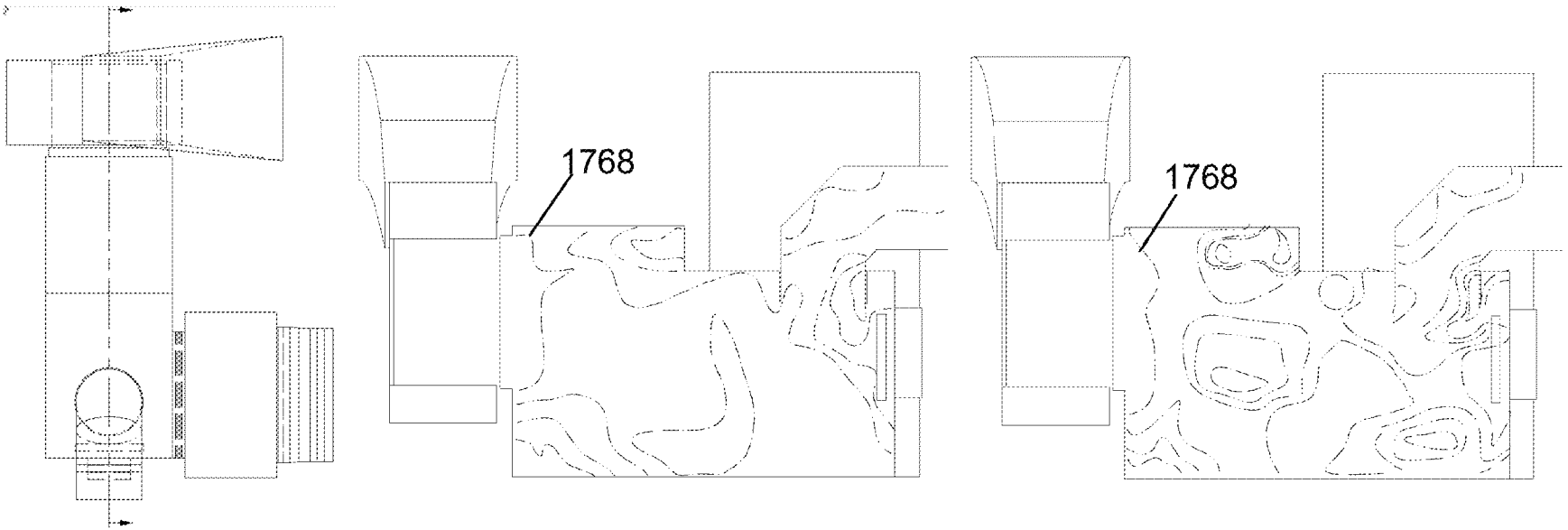
Figure 47:
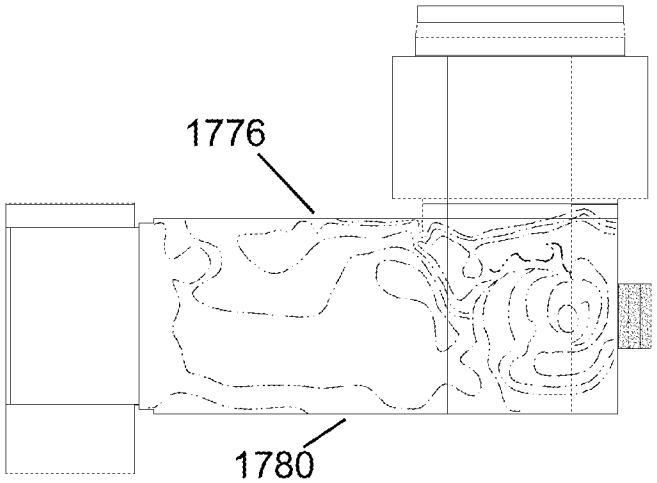

FIG. 42, FIG. 43, and FIG. 44 are the next triplet set of figures showing the modeled flow velocities. This set looks at a cross section that looks towards the kiln along a cross section from the burner side to the blower side. In both cases the higher flow velocity appears near the constricted blower inlet as indicated by isoline 1768. However, the general pattern repeats that the flow pattern during the state when the bidirectional fans are operated in the forward direction as shown in FIG. 43 is different from the more chaotic flow pattern during the state when the bidirectional fans are operated in the reverse direction as shown in FIG. 44.

Figure 46:
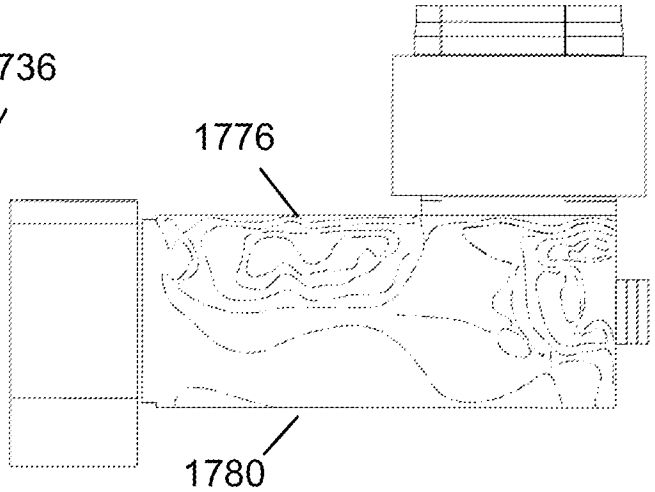
Figure 45:
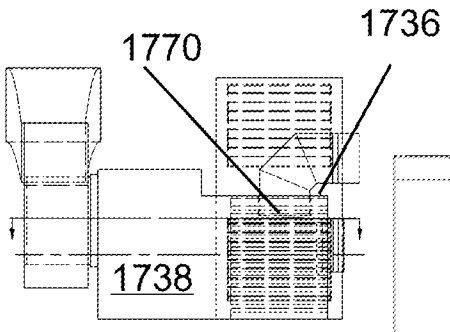
Figure 48:
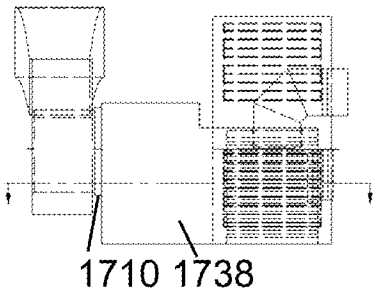

FIG. 45, FIG. 46, and FIG. 48 are the next triplet set of figures showing the modeled flow velocities. This set looks at a cross section that looks downward within the air blending chamber 1738 from the outlet of the hot duct 1770. Interestingly, there are areas of much lower flow velocities on the kiln side wall 1776 of the air blending chamber 1738 in both the forward and reverse direction with higher flow velocities on the non-kiln side wall 1780. This disparity in flow rates across the air blending chamber 1738 may indicate laminar flow instead of substantial mixing. Given that the purpose of an air blending chamber 1738 is to blend the hot burner output from the hot duct 1770 with the kiln return air that emerges from the heat modulating damper 1536, this indicates a failure of the essential purpose.

Figure 50:
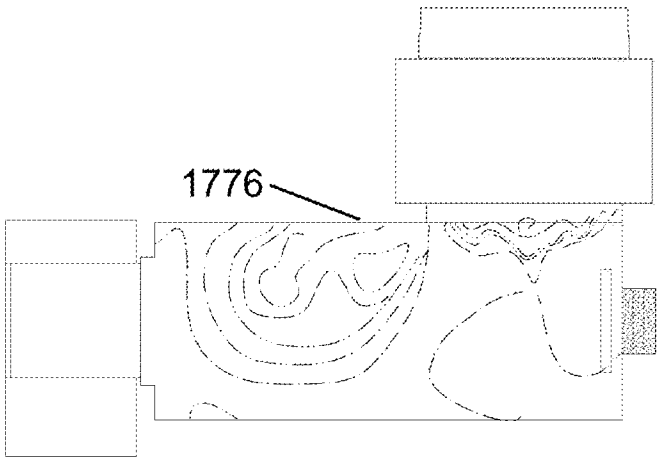
Figure 49:
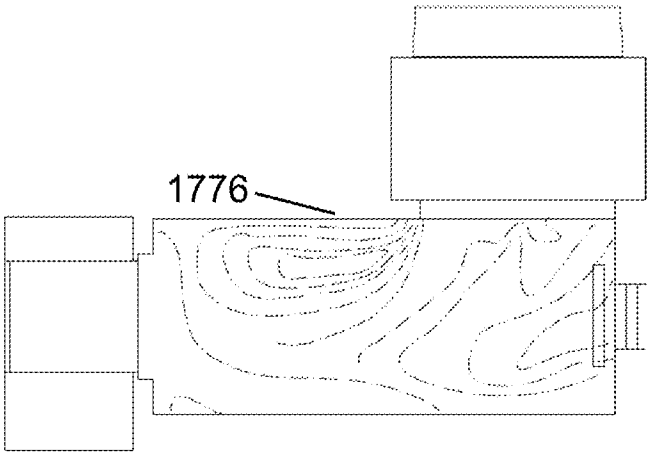

FIG. 48, FIG. 49, and FIG. 50 are the next triplet set of figures showing the modeled flow velocities. This set looks at a cross section that looks downward within the air blending chamber 1738 from the lower end of the mixing chamber outlet 1710. As with the last triplet, there are localized zones of low flow rates close to the kiln side wall 1776 during both forward and reverse operation.

Temperature Results for Model of Improved Solution.

Before turning to the results, it is useful to note what features were in the model. The changes to the table legs as shown in FIG. 15, FIG. 16, and FIG. 17 with the path for cooling air were not part of this model. The flow of air out of the cooling air discharge ports 2670 (FIG. 17) will be so small compared with the other flows in the model that this will not impact the model results. The table legs 2474 used in the model had their flat faces perpendicular to the flow from the fresh air damper 1570 to mixing chamber outlet 2610 although the most recent design has rotated the legs 45 degrees so that the table leg corners face the fresh air damper 1570 and the mixing chamber outlet 2610. This change is not likely to greatly alter the model results.

As with the prior art model, this model assumes in-leakage across the "closed" fresh air damper 1570 equal to about 5% of the full open flow. The model excluded the impact from the vanes in the dampers at the edge of the reverse return duct 2334 and at the edge of the forward return duct 1554 and simply used boundary conditions to change the source of the return air.

The vanes in the heat modulating damper 2436 were modeled at various levels of open and closed. A closed heat modulating damper 2436 will still allow about 30% of full flow. An open heat modulating damper 2436 will have some small reduction of flow from the drag from the open vanes. The model results show the output when the heat modulating damper 2436 was full open. Although the results were similarly good at various modeled levels of partial closure of the heat modulating damper 2436.

Figure 53:
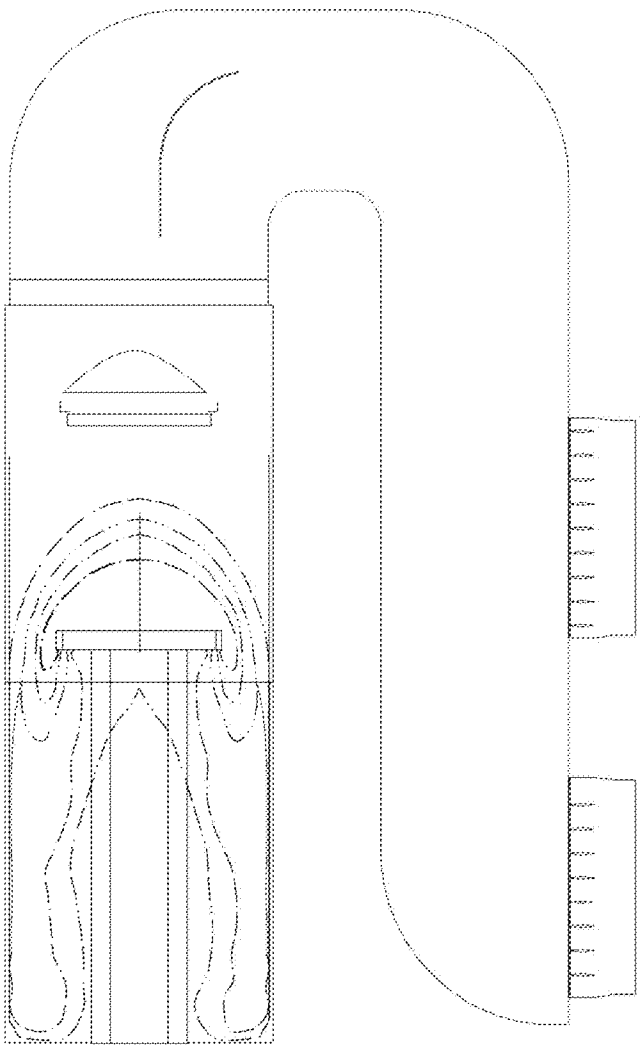
Figure 52:
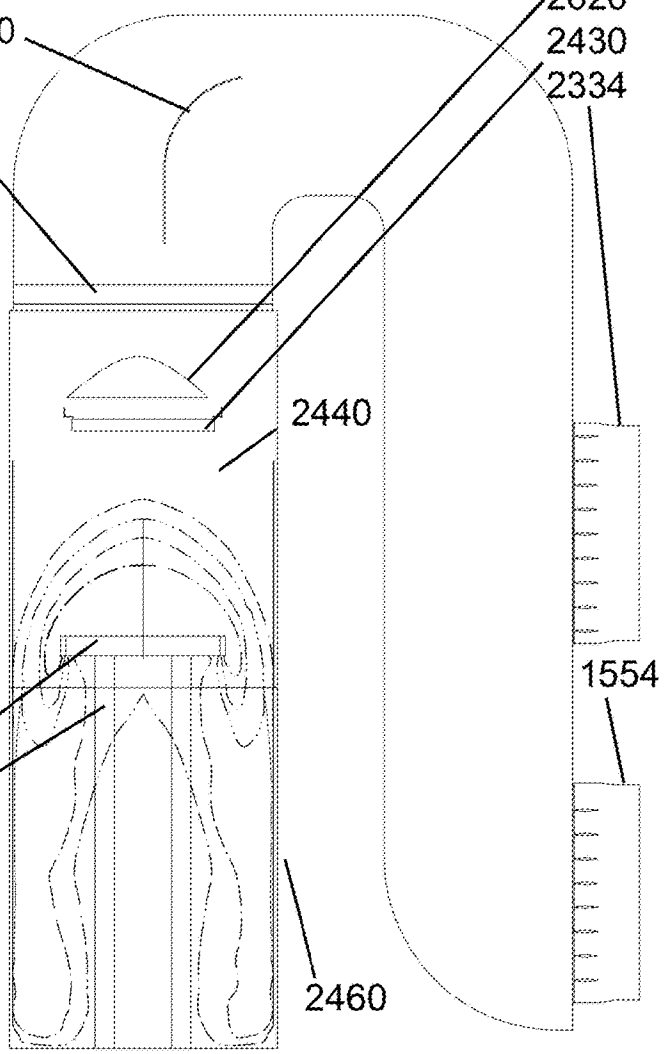
Figure 51:
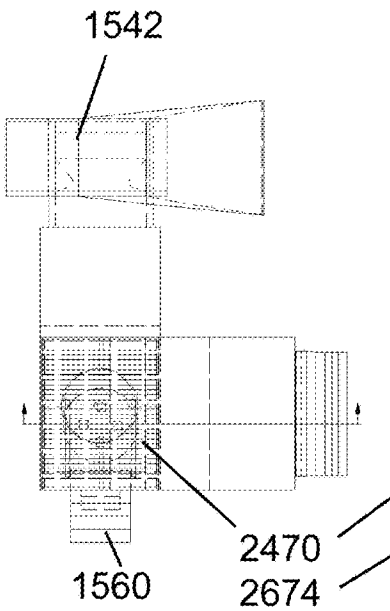

FIG. 51, FIG. 52, and FIG. 53 form the first triplet set of figures showing the position, forward flow results, and reverse flow results for a vertically integrated dual return assembly 2600 as shown in FIG. 15, FIG. 16, and FIG. 17.

FIG. 51 indicates the view of the cross section used in the model results shown in FIG. 52 and FIG. 53. This cross section is taken vertically, midway through delay table 2470 looking towards the recirculation blower 1542. The temperature of the return air from the kiln before the heat modulating damper 2484 would be in the range of 220 degrees Fahrenheit.

Components of vertically integrated dual return assembly 2600 have been labelled in FIG. 52. Visible in FIG. 52 are forward return duct 1554 and reverse return duct 2334, turning vane 2410, heat modulating damper 2484 which is now above the dispersion chamber 2440, and extended air blending chamber 2460. Cone 2620 is above open isolation damper 2430.

A remarkable item to focus upon is the modeled differences between forward flow operation and reverse flow operation temperature gradients have been substantially eliminated. The differences between the temperature model for forward flow in FIG. 52 and reverse flow in FIG. 53 can be discerned by a careful examination of the color coded output, but the differences are very small and subtle.

Figure 56:
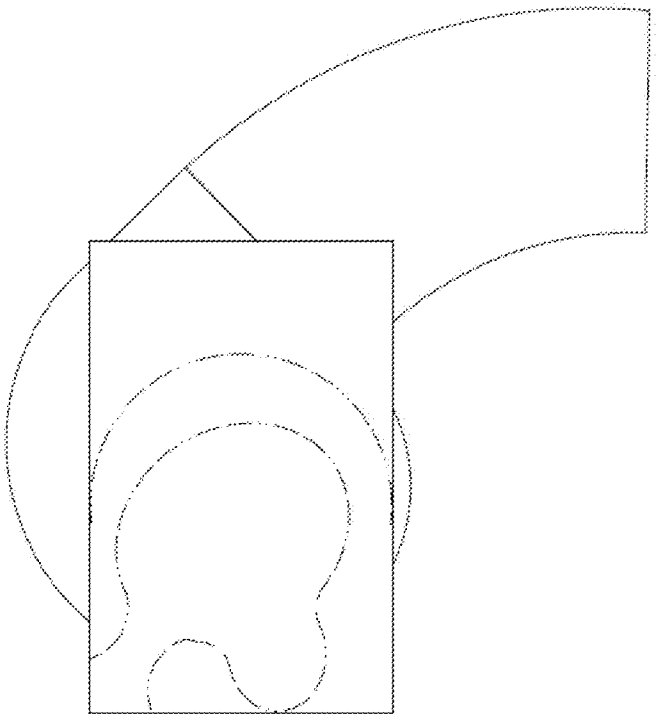
Figure 55:
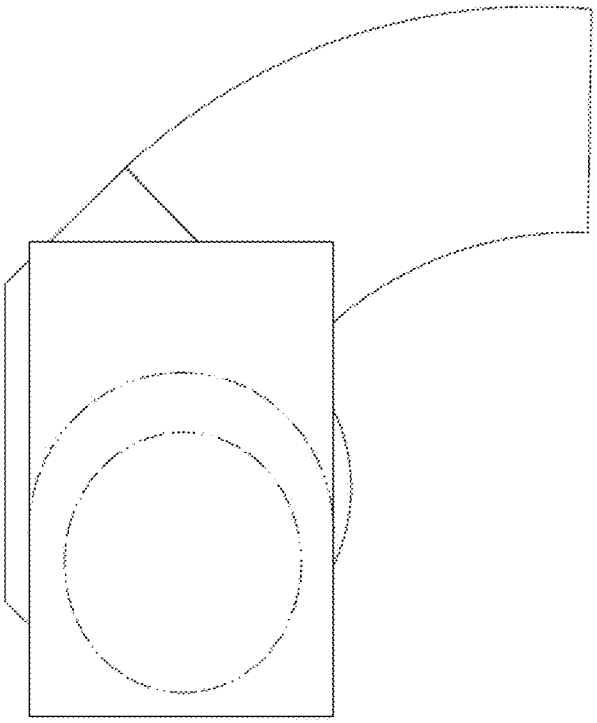
Figure 54:
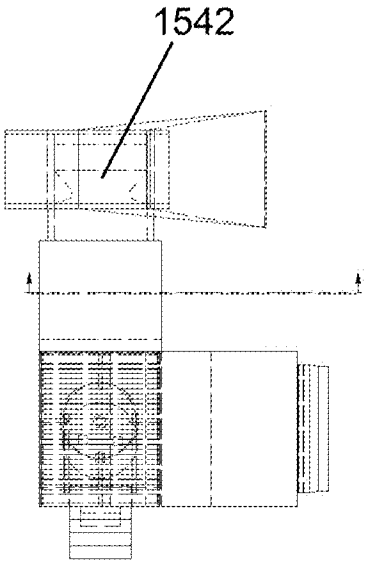

The next triplet of figures includes FIG. 54 indicating a cross section taken closer to recirculation blower 1542 and looking towards recirculation blower 1542 combined with forward flow model results in FIG. 55 and reverse flow model results in FIG. 56. Again the model results indicate substantially similar temperature profiles of the blended air heading towards the recirculation blower 1542 without hot spots. The substantial similarity makes the forward and reverse cycles deliver the same distribution of heat to the kiln through the distribution duct 232 (FIG. 4) and minimizes the need for control system intervention between the forward flow fan cycle and the reverse flow fan cycle.

The lack of hot spots in the heated air moving toward the recirculation blower 1542 protects the recirculation blower 1542 and helps keep the treatment of the lumber within the kiln consistent across areas as inconsistent heat entering the recirculation blower 1542 results in inconsistent heat delivered to various distribution vents 250 (FIG. 4) within the kiln 100.

Figure 59:
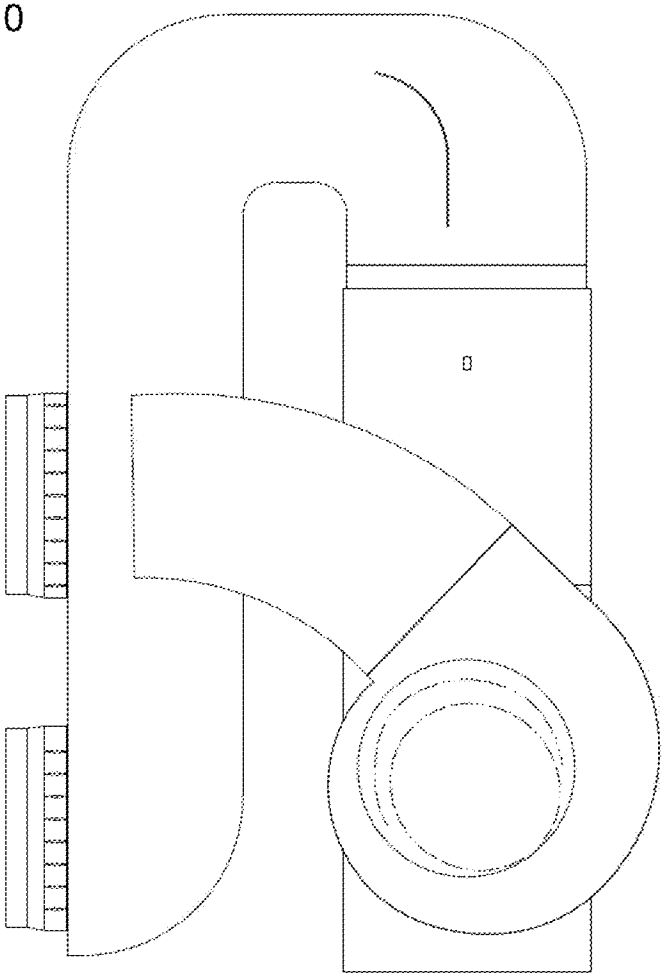
Figure 58:
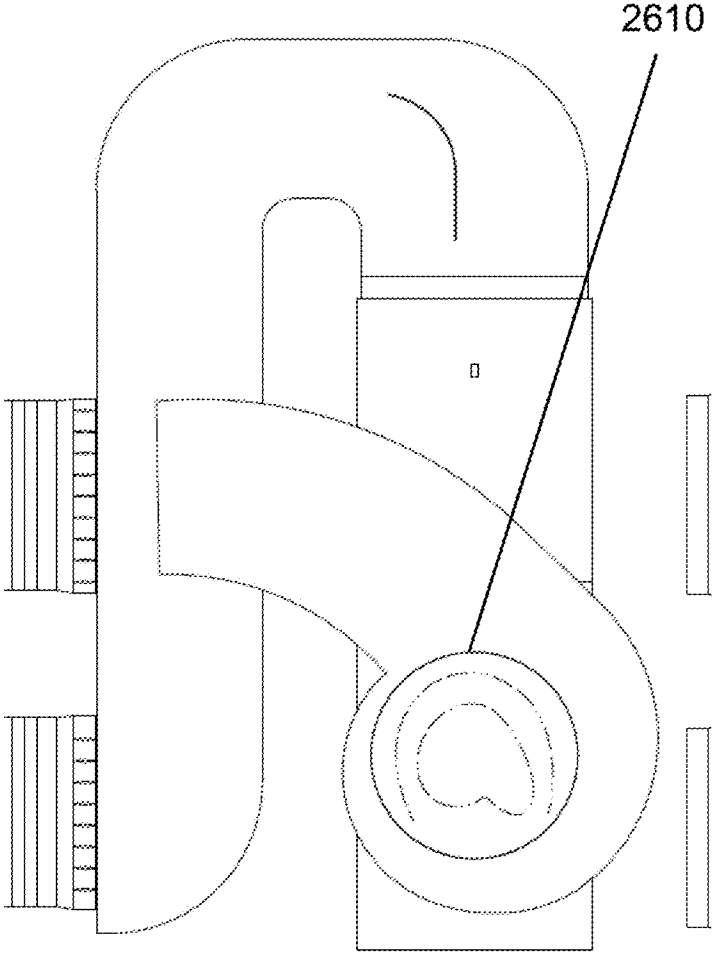
Figure 57:
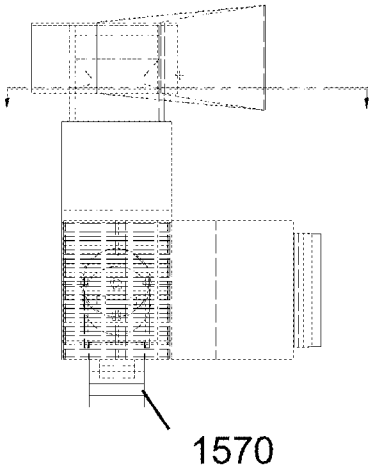

The next triplet of figures begins with FIG. 57 that indicates that the cross section is looking back towards the hot duct 1560 at the mixing chamber outlet 2610. Note that FIG. 58 and FIG. 59 provide substantially similar temperature profiles but more importantly, the profiles lack hot spots. The hottest isoline pattern is dash, dash, dot, dot which equates to 800-500 degrees Fahrenheit. The model temperature results for the new vertically integrated dual return assembly are much lower than the hot spots reaching the recirculation blower 1542 with the modeled prior art.

The next triplet of figures begins with FIG. 60 that indicates that the cross section is looking towards the kiln with the hot duct 1560 at one end and the recirculation blower 1542 at the other end. As shown in FIG. 61 for forward flow operation and FIG. 62 for reverse flow operation, the differences between forward flow operation and reverse flow operation are very small due to the overhead delivery of return air from the kiln through heat modulating damper 2484. The delay table 2470 keeps the output from hot duct 1560 up in the dispersion chamber 2440 to promote mixing of the return air from the kiln with the high temperature burner output from hot duct 1560.

The triplet of figures beginning at FIG. 63 provides a particularly useful illustration of the advantages of employing the teachings of the present disclosure.

ADVANTAGE 1—the temperature profiles visible in FIG. 64 for forward flow operation and in FIG. 65 for reverse flow operation are almost indistinguishable. This consistency between flow directions of the bidirectional fans 200 makes the control process easier and promotes more uniform treatment of the lumber without localized hot spots.

ADVANTAGE 2—The blending of the hot burner output from the direct fired burner 1534 (not shown here) delivered via hot duct 1560 with the return air from the kiln delivered through heat modulating damper 2484 collide over the surface of the delay table 2470. One can imagine the hot burner output from the hot duct 1560 is present on an anvil surface (delay table 2470) and is stuck by the momentum of the return air from the kiln traveling perpendicular to the surface of the delay table 2470. The hot burner output from hot duct 1560 is dispersed and prevented from forming laminar sheets of hot burner output to travel unmixed to the mixing chamber outlet 2610.

Proof of the superior mixing shows up in the lowest band 1784 of shown temperatures being in the range of 200 to 500 degrees Fahrenheit (isoline _ _ . . . (Dash, Dash, dot, dot, dot)). Presumably, additional mixing will occur between lowest band 1784 and the mixing chamber outlet 2610 to further homogenize the temperature of the mixed air.

The results of the final temperature results triplet in FIG. 66, FIG. 67, and FIG. 68 are very similar to the results in FIG. 63, FIG. 64, and FIG. 65. As indicated in FIG. 66, the view is taken looking downward below the bottom of the fresh air damper 1570. The four square table legs 2474 are visible. As with the prior triplet of figures, the results in FIG. 67 for forward flow and FIG. 68 for reverse flow are close to identical. The effective mixing leads to a lack of streams of hot discharge of burner output from the hot duct 1560 reaching the mixing chamber outlet 2610.

Flow Velocity Results for Model of Improved Solution.

The flow model used to provide flow velocities is the same model that provided the temperature profiles discussed in FIG. 51 to FIG. 68. As previously discussed, the flow model assumed a solid boundary or no boundary at the inlets to the return air duct 2494 rather than model the damper vanes within the forward return duct 1554 and the reverse return duct 2334.

Figure 71:
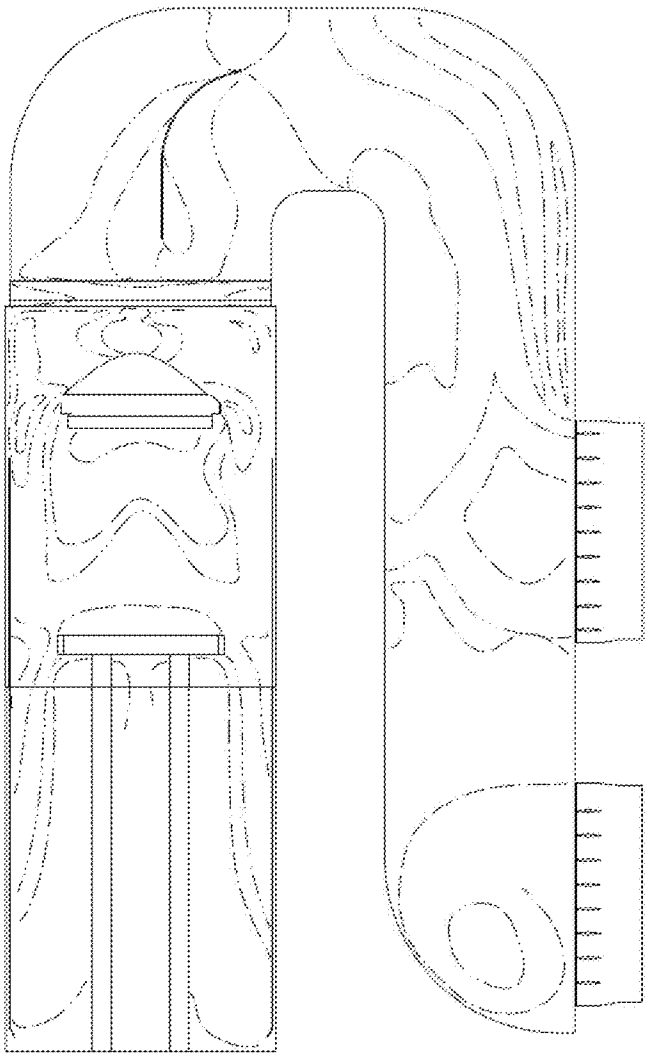
Figure 70:
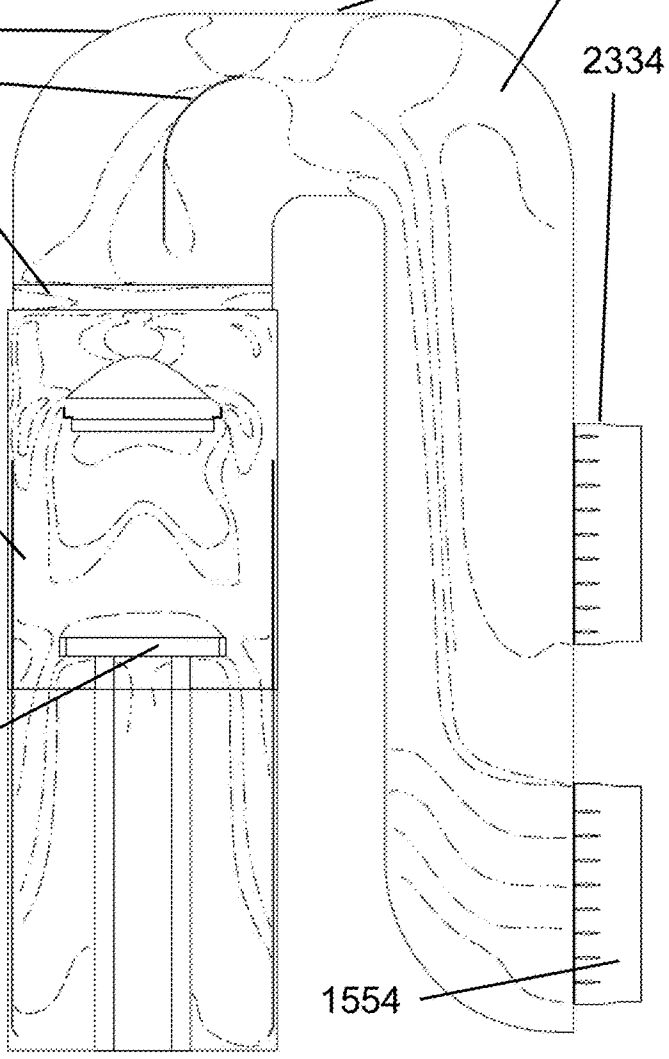
Figure 69:
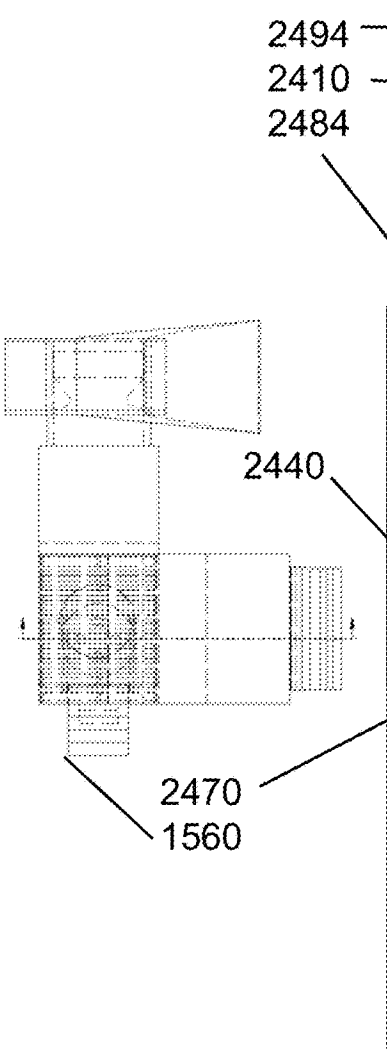

Triplet figure set with FIG. 69, FIG. 70, and FIG. 71 provide indication of where the cross section is taken and then the model results for a vertically integrated dual return assembly 2600 in both the forward operating direction for the bidirectional fans 200 and the reverse operating direction for the bidirectional fans 200.

The return air duct 2494 takes the return from either the reverse return duct 2334 or forward return duct 1554 and routes the return air upward through upward portion 2496 of the return air duct 2494, across the extended horizontal run 2490, and back downward with an assist from turning vane 2410 to exit through the heat modulating damper 2484 into the dispersion chamber 2440 where the return air impacts with and disperses the burner output from the hot duct 1560.

The flow velocities from the model appear essentially the same for either the forward flow model shown in FIG. 70 or the reverse flow model shown in FIG. 71. This is in stark contrast from the model results discussed in FIG. 19 and FIG. 20 that was highly dependent on the operation of the bidirectional fan 200.

Figure 74:
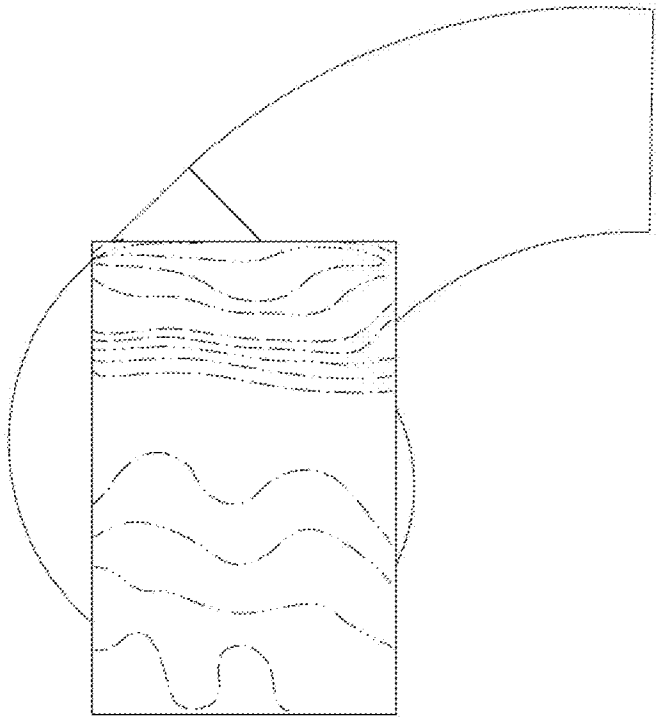
Figure 73:
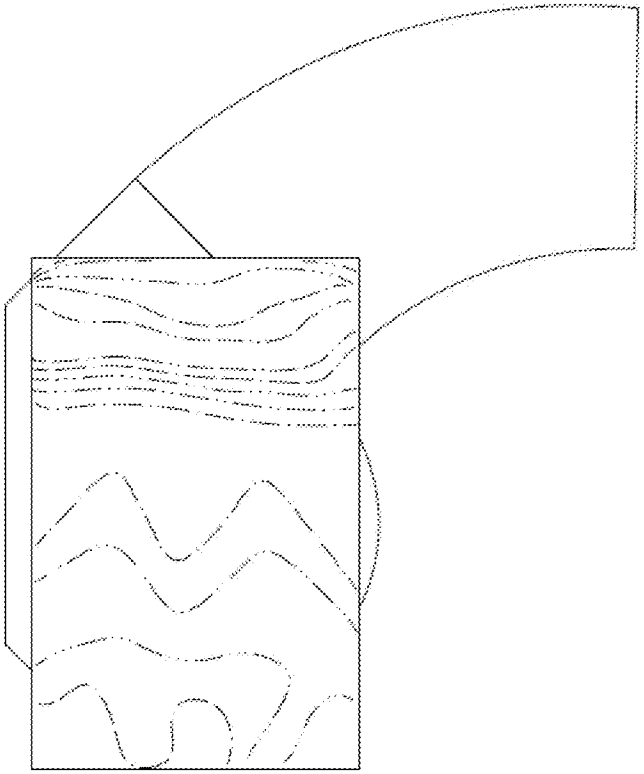
Figure 72:
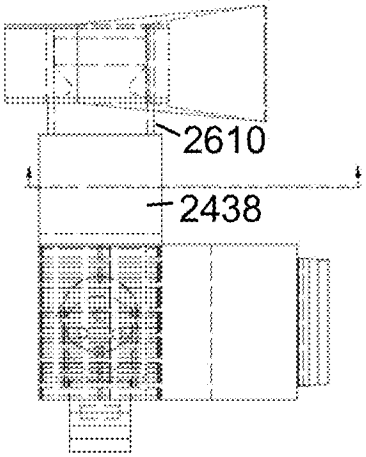

Triplet figure set with FIG. 72, FIG. 73, and FIG. 74 provides indication of where the cross section is taken and then the model results for a vertically integrated dual return assembly 2600 in both the forward operating direction for the bidirectional fans 200 and the reverse operating direction for the bidirectional fans 200. The view is within the air blending chamber 2438 looking towards the mixing chamber outlet 2610. The flow patterns are very much the same in FIG. 73 and FIG. 74, with both showing elevated flow velocities along the upper portion of the air blending chamber 2438 which would be expected given the elevated sources of both the kiln return air and the burner output and the impact of the delay table 2470 delaying the downward movement of the burner output.

Triplet figure set with FIG. 75, FIG. 76, and FIG. 77 provides indication of where the cross section is taken and then the model results for a vertically integrated dual return assembly 2600 in both the forward operating direction for the bidirectional fans 200 and the reverse operating direction for the bidirectional fans 200. The results again show very little difference in the flow velocity patterns between the forward flow operation and reverse flow operation.

Triplet figure set with FIG. 78, FIG. 79, and FIG. 80 provides indication of where the cross section is taken and then the model results for a vertically integrated dual return assembly 2600 in both the forward operating direction for the bidirectional fans 200 and the reverse operating direction for the bidirectional fans 200. As indicated in FIG. 78, the view is looking downward at the height of the midline of the delay table 2470 into the air blending chamber 2438 and the extended air blending chamber 2460 below the dispersion chamber 2440. The results again show very little difference in the flow velocity patterns between the forward flow and reverse flow states.

The final triplet figure set with FIG. 81, FIG. 82, and FIG. 83 provides indication of where the cross section is taken and then the model results for a vertically integrated dual return assembly 2600 in both the forward operating direction for the bidirectional fans 200 and the reverse operating direction for the bidirectional fans 200. As indicated in FIG. 81, the view is looking downward at the height just below the fresh air damper 1570 into the air blending chamber 2438 and the extended air blending chamber 2460 below the dispersion chamber 2440 (see FIG. 78). The results again show very little difference in the flow velocity patterns between the forward flow and reverse flow states.

Summary of Model Results.

In summary, the operation of the return air duct 2494 virtually eliminates any difference in the model results for temperature profiles or flow velocities profiles between the forward flow operation and reverse flow operation. This lack of differences will reduce the need for control systems to attempt to compensate for differences and will help promote more uniform treatment of the lumber as the temperature of the air entering the kiln through the various distribution vents 250 (FIG. 4) from the distribution duct 232 (FIG. 4) will be substantially equal without hot spots.

The use of the delay table 2470 to help prevent laminar flow from the burner output coming from the outlet of the hot duct 1560 all the way to the mixing chamber outlet 2610 promotes substantially uniform temperatures of the mixed air as the mixed air reaches the mixing chamber outlet 2610. Avoiding hot spots protects the recirculation blower 1542 and prevents portions of the distribution duct 232 ((FIG. 4)) from having some distribution vents 250 (FIG. 4) providing much hotter output than other outlets.

With more substantially uniform blending, the total amount of heat provided to the kiln by the direct fired burner 1534 can be increased without incurring damage to the recirculation blower 1542 or to lumber within the kiln. Providing more heat under controlled circumstances results in faster processing rates for the lumber and thus more throughput for a kiln of a given size.

Details on the Delay Table.

The delay table 2470 needs to be created from a material that will tolerate extended exposure to temperatures of 2000 degrees Fahrenheit or more. The top surface of the delay table 2470 needs to be able to tolerate prolonged exposure to flame of the burner gas without erosion. A suitable material would be refractory material that can withstand thermal shock and has a high concentration of stainless steel needles. The refractory material is high density and low cement. One suitable material is sold by Allied Mineral Products, Inc. under the ARMORMAX® brand as ARMORMAX® 70 SR although those of skill in the art would be able to select other refractory materials that would have suitable durability for exposure to the flame from the burner which may extend into the dispersion chamber and make contact with the top surface of the delay table.

An additional benefit of the substantial refractory mass of the delay table is that the thermal mass of the refractory material in the delay table will tend to stabilize temperature.

For initial testing, the size and shape of the delay table 2470 was based upon the size and shape of the isolation damper 2430. The isolation damper 2430 is a circle with a diameter that is twelve inches wider than the inside diameter of the hot duct extension 1564 conveying the heated output from the burner to the dispersion chamber. While the model is sensitive to the size and shape of the table top, it is possible that some other sizes and shapes will provide satisfactory results. Varying the size, shape, and precise positioning of the delay table 2470 for systems with different ratings of recirculation blower and burner output are within the normal tuning activities of those of skill in the art.

Computational Fluid Dynamics.

Computational Fluid Dynamic (CFD) modelling is a difficult task. Frequently the models are adjusted after taking physical measurements and comparing those to the model output. This validation work often leads to modifications of the model. The present disclosure uses model results before validation so the specific temperature and flow profiles may be somewhat different from the model results.

The model work was done using Autodesk CFD, Computational Fluid Dynamics Software described at http://www.autodesk.com/products/cfd/overview.

Alternatives and Variations

Orientation.

The present disclosure had the flow of the kiln return air going up in the upward portion 2496 of the return air duct 2494, turning and traveling horizontally in the extended horizontal run 2490 and coming downward through the heat modulating damper 2484 into the dispersion chamber 2440 to collide with the output from the hot duct 1560 on the delay table 2470.

As the impact of gravity on air flow is not the driving factor in this suction driven system, one of skill in the art could rotate the design elements suggested by the present disclosure so that the delay table was vertical instead of horizontal and the kiln return air came perpendicular to the vertical surface of the delay table to strike the output from the hot duct.

Likewise, the design could be rotated 180 degrees so that the hot duct output travels on the bottom side of a delay table mounted to the ceiling of the assembly and the return kiln air would come upward perpendicular to the delay table surface to strike the output from the hot duct.

If the design could be rotated 90 degrees and 180 degrees and still function, then one of skill in the art would appreciate that any other rotation from this disclosure would be viable as long as the output from the hot duct is placed upon a delay table surface and struck by the return kiln air traveling substantially perpendicular to the relevant surface of the delay table.

In all cases, the teachings of the present disclosure could be used to eliminate differences between forward flow and reverse flow operation no matter what the final trajectory of the kiln return air is set to be, vertically down, vertically up, horizontal, or some other angle.

One can imagine that the operation or the mounting position of the isolation damper may need to be adjusted for these alternative orientations.

Burner Choices.

The present disclosure discusses the use of the vertically integrated dual return assembly which receives heat from a green fuel gasifier that uses a fuel such as sawdust. Such burners are challenging as they do not have fans to drive burner output gas out of the burner and thus are reactive to the recirculation blower and the heat regulating damper.

Nothing should be interpreted as limiting the use of the vertically integrated dual return assemblies to green fuel gasifier burner assemblies. Other burners with forced drafts could use natural gas, a suspension shaving burner, or some other burner known to those of skill in the art.

Batch Kilns.

The operation of a batch kiln is very much like the operation of a main dryer section except that the thermal treatment starts after carriages loaded with lumber, spacers, and weights are placed in the batch kiln and the carriages are not moved until after the completion of the thermal processing of the lumber, when the carriages are cool enough to be moved and the treated lumber unloaded from the carriages. As batch kilns do not have moving carriages during the heating process, there is not a need for energy recover sections to move heat from heated lumber to green lumber. Thus a batch kiln does not need to have a pair of pathways for carriages. There may be only one carriage pathway, two carriage pathways, or more than two carriage pathways.

As batch kilns operate with a sequence of fan cycles with heated air circulated by bidirectional fans in a forward direction and fan cycles with heated air circulated by bidirectional fans in a reverse direction, the teaching of the present disclosure apply equally to batch kilns as the do to continuous drying kiln (CDK) designs.

Differences in Supply.

One of skill in the art will appreciate that the recirculation blower 1542 could be placed after duct work rather than directly on the outlet of the air blending chamber 1538 and that the distribution of heated air to the structure may deviate from that described in FIG. 9 while still making use of the in-kiln second return ducts taught with this disclosure.

Differences in Fan Layout.

One of skill in the art will appreciate that one could create forward and reverse air flows using bidirectional fans, two sets of unidirectional fans, unidirectional fans that are rotated from a first orientation to a second orientation, or any other plan to get circulation in the forward and reverse directions while still enjoying the benefits of in-kiln second return air ducts as taught with this disclosure.

SUMMARY AND CONCLUSION

One of skill in the art will recognize that some of the alternative implementations set forth above are not universally mutually exclusive and that in some cases additional implementations can be created that employ aspects of two or more of the variations described above. Likewise, the present disclosure is not limited to the specific examples or particular embodiments provided to promote understanding of the various teachings of the present disclosure. Other systems, methods, features and advantages of the disclosed teachings will be or will become apparent to one with skill in the art upon examination of the following figures and detailed description. Moreover, the scope of the claims which follow covers the range of variations, modifications, and substitutes for the components described herein as would be known to those of skill in the art.

That which is claimed:

1. A mixing chamber assembly for mixing burner output with kiln return air from a kiln taken from either a first return duct or a second return duct, the mixing chamber assembly comprising:

a first vertical duct that receives kiln return air from the first return duct when the kiln is operated in a first mode and receives kiln return air from the second return duct when the kiln is operated in a second mode;

a second vertical duct in fluid communication with the first vertical duct so that the kiln return air enters the first vertical duct, travels upward, and changes direction to then travel downward in the second vertical duct to pass downward through a heat modulating damper into a dispersion chamber to provide downward movement of the kiln return air;

the dispersion chamber having a hot duct discharge to convey burner output laterally into a dispersion chamber portion of the mixing chamber assembly above a delay table surface which is horizontal, and the downward movement of the kiln return air through the dispersion chamber colliding with the burner output as the burner output traverses the delay table surface to provide mixing of the kiln return air with the burner output.

2. The mixing chamber assembly of claim 1 wherein the mixing chamber assembly has:

an air blending chamber adjacent to a mixing chamber outlet which provides mixed air to a recirculation blower; and an extended air blending chamber adjacent to the air blending chamber and below the dispersion chamber so that air moving downward off the delay table surface in the dispersion chamber travels through the extended air blending chamber before entering into the air blending chamber and the mixing chamber outlet.

3. The mixing chamber assembly of claim 1 wherein the burner output cannot move purely laterally from the delay table surface into an air blending chamber adjacent to a mixing chamber outlet.

4. The mixing chamber assembly of claim 1 wherein the first vertical duct is connected to the second vertical duct by a crossover duct that moves the kiln return air horizontally.

5. The mixing chamber assembly of claim 1 wherein the first mode is forward operation of a set of bidirectional circulating fans within the kiln and the second mode is reverse operation of the set of bidirectional circulating fans within the kiln.

6. The mixing chamber assembly of claim 2 wherein a delay table with the delay table surface is connected to a set of legs that support the delay table surface a distance above the extended air blending chamber.

7. The mixing chamber assembly of claim 6 wherein cooling air passes into a set of opening in bottoms of the set of legs, travels within interior passages within each of the set of legs and exits into the mixing chamber assembly after moving vertically through at least a portion of the set of legs.

8. The mixing chamber assembly of claim 1 wherein the mixing chamber assembly has a fresh air damper that allows air that is cooler than the kiln return air to pass under the delay table surface as the delay table surface is above a top end of the fresh air damper.

9. The mixing chamber assembly of claim 1 wherein the hot duct discharge exits a hot duct extension that terminates within the dispersion chamber;

an isolation damper can be rotated to a vertical position to substantially cover the hot duct extension and may be rotated upward to a horizontal position to not obstruct the hot duct extension; and a permanent flow protector located above a portion of the isolation damper used to cover the hot duct extension when the isolation damper is rotated upward to the horizontal position.

10. The mixing chamber assembly of claim 9 where in the permanent flow protector is a cone shaped protector.

11. A mixing chamber assembly to foster air stream collisions to promote mixing, the mixing chamber assembly comprising:

a mixing chamber outlet at one end; and a hot duct discharge at an opposite end, opposite the one end, the hot duct discharge positioned relative to a flat surface so that burner output from a burner in fluid communication with the hot duct discharge leaves the hot duct discharge and the burner output flowing adjacent to the flat surface; and a kiln return air supply positioned to deliver kiln return air substantially perpendicular to the burner output flowing adjacent to the flat surface so that the kiln return air collides with the burner output which is constrained by the flat surface which is adjacent to the burner output, the kiln return air colliding to promote mixing of the kiln return air and the burner output.

12. The mixing chamber assembly of claim 11 wherein the flat surface is horizontal and the burner output is flowing above the flat surface.

13. The mixing chamber assembly of claim 11 wherein the flat surface is horizontal and the burner output is flowing below the flat surface.

14. The mixing chamber assembly of claim 11 wherein the flat surface is vertical and the burner output is flowing downward.

15. The mixing chamber assembly of claim 11 wherein kiln air return supply alternates between providing kiln air gathered from a first location in a kiln when a set of at least one kiln bidirectional fans are moving kiln air in a first direction providing kiln air gathered from a second location in the kiln when the set of at least one kiln bidirectional fans are moving kiln air in a second direction, opposite from the first direction.

16. The mixing chamber assembly of claim 15 further comprising a U-shaped duct; the U-shaped duct comprising:

a first duct portion that receives kiln air gathered from the first location in the kiln in a first duct connection and receives kiln air gathered from the second location in the kiln in a second duct connection, different from the first duct connection, the first duct portion for carrying kiln air away from the flat surface; and the first duct portion in fluid communication with a second duct portion for carrying kiln air towards the flat surface and in fluid communication with the kiln return air supply which provides kiln return air to the mixing chamber assembly.

17. The mixing chamber assembly of claim 16 wherein the U-shaped duct further comprises a perpendicular duct portion oriented parallel to the flat surface; the perpendicular duct portion providing fluid communication between the first duct portion and the second duct portion.

18. The mixing chamber assembly of claim 11 wherein the kiln return air supply passes through a heat modulating damper which serves to adjust a ratio of kiln return air to burner output with the mixing chamber assembly.

19. A system for circulating heated air to treat lumber, the system comprising:

a structure having a floor, a roof above the floor, a first end and a second end with at least the first end having an opening so that lumber may be moved into and out of the structure so that stacks of spaced lumber may be treated, a wall along a first side extending from the first end to the second end, and a wall along a second side opposite from the first side a direct fired burner which provides heat to an air blending chamber which provides heated air to the structure though use of a supply duct and a blower;

a set of at least one circulating fan located on in a center wall located above a horizontal fan deck and below the roof;

set of dampers and a pair of return ducts to allow for kiln return air to be drawn from the first side of the structure relative to the center wall when the at least one circulating fan is causing a pressure gradient to force air through the stacks of spaced lumber from the second side to the first side; and from the second side of the structure relative to the center wall when the at least one circulating fan is causing a pressure gradient to force air through the stacks of spaced lumber from the first side to the second side;

both return duct feeding kiln return into a first section of a vertically integrated dual return assembly and flowing in a first direction before crossing over into a second section of the vertically integrated dual return assembly and proceeding in a second direction, opposite of the first direction, the kiln return air entering into a dispersion chamber with a delay table that receives a flow of burner output gas from a burner hot duct discharge oriented perpendicular to the flow of the kiln return air entering into the dispersion chamber, and the kiln return air and burner output gas at least partially mixing before entering an air balancing chamber and traversing the air balancing chamber to enter a suction side of a blower and returning to the structure through a supply duct.

20. The system for circulating heated air to treat lumber of claim 19 wherein the structure is a batch kiln for heat treatment of lumber.

21. The mixing chamber assembly of claim 11 wherein the hot duct discharge is positioned relative to the flat surface so that burner output from the burner in fluid communication with the hot duct discharge leaves the hot duct discharge and moves outward away from a center of the flat surface and spills downward around a perimeter of the flat surface.

* * * * *